United States Patent [19]

Cox

[11] Patent Number: 4,581,757

[45] Date of Patent: Apr. 8, 1986

[54] SPEECH SYNTHESIZER FOR USE WITH COMPUTER AND COMPUTER SYSTEM WITH SPEECH CAPABILITY FORMED THEREBY

[75] Inventor: Leon W. Cox, Lubbock, Tex.

[73] Assignee: Texas Instruments Incorporated, Dallas, Tex.

[21] Appl. No.: 295,198

[22] Filed: Aug. 21, 1981

Related U.S. Application Data

[63] Continuation of Ser. No. 36,931, May 7, 1979, abandoned.

[51] Int. Cl.[4] ..... G10L 1/00

[52] U.S. Cl. ..... 381/51

[58] Field of Search ..... 179/1 SM, 1 SA; 364/200 MS File, 724, 513, 513.5; 340/148

[56] References Cited

U.S. PATENT DOCUMENTS

| | | | |
|---|---|---|---|
| 3,641,496 | 2/1972 | Slavin | 340/148 |
| 4,022,974 | 5/1977 | Kohut et al. | 179/1 SM |
| 4,060,848 | 11/1977 | Hyatt | 364/200 |
| 4,104,720 | 8/1978 | Gruner | 364/200 |
| 4,228,503 | 10/1980 | Waite et al. | 364/200 |

OTHER PUBLICATIONS

Soucek, "Microprocessors and Microcomputers", Wiley, pp. 514–517, 544, 545, 548.

Dec, "Small Computer Handbook; PDP-8", Catalog, 1972, FIG. 1.1.

*Primary Examiner*—E. S. Matt Kemeny

*Attorney, Agent, or Firm*—William E. Hiller; James T. Comfort; Melvin Sharp

[57] ABSTRACT

Speech synthesizer and a computer system having the speech synthesizer operably coupled thereto to provide speech capability for the computer system. The speech synthesizer is capable of electronically synthesizing human speech from coded speech data including parameters as stored either in a solid state memory on a permanent basis or alternatively as temporarily stored in another memory, wherein the coded speech data is made available from an external source, such as a central processing unit of a commercial or home-type computer, as coupled to the speech synthesizer. The speech synthesizer may be in the form of a speech module including a speech synthesizer processor for converting coded speech data into digital speech signals in combination with a mode selector which selectively applies either the coded speech data from a read-only-memory within the speech module or the coded speech data obtained from the external source to the speech synthesizer processor in response to a control signal provided by the external source for determining which of the two alternative operating modes will be employed in a given instance. The computer system is provided with speech capability by including the speech module as a component thereof in combination with a computer input device, the central processing unit of the computer, and an audio amplifier and speaker connected to a digital-to-analog converter of the speech module so as to generate audible human speech from the digital speech signals provided by the speech synthesizer processor of the speech module.

28 Claims, 44 Drawing Figures

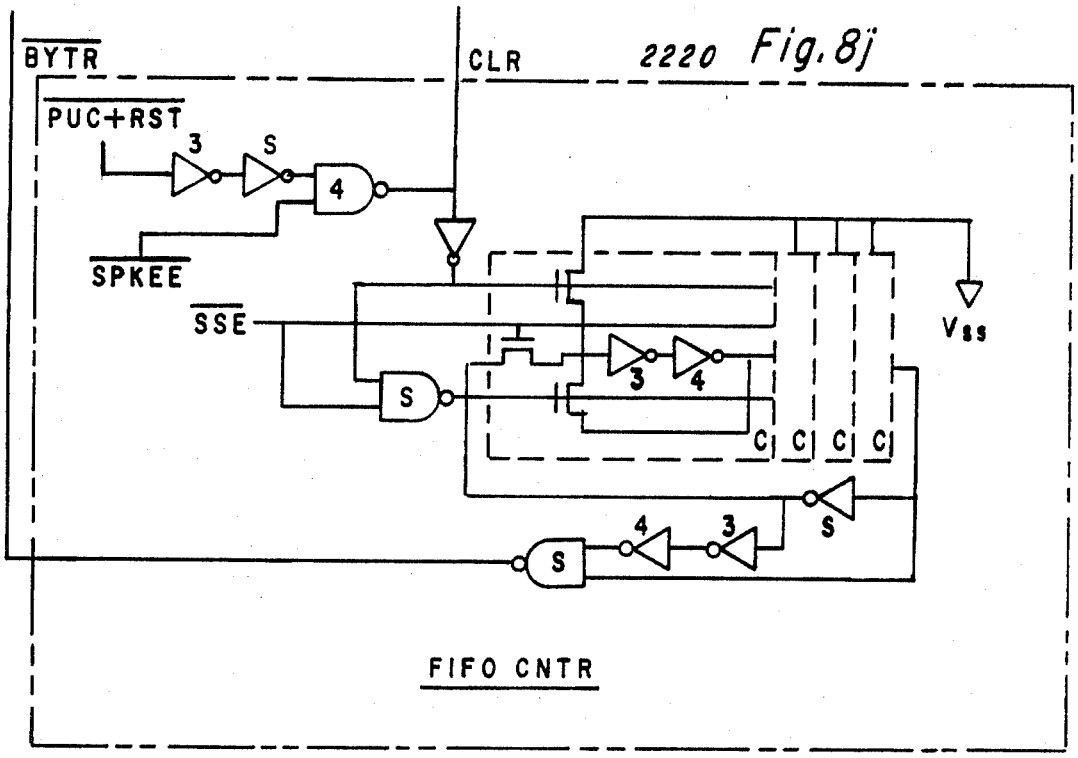
BYTR
CLR
2220
Fig. 8j
PUC+RST
3
S
4
SPKEE
SSE
S
3
4
Vss
C
C
C
C
S
4
3
S
S
FIFO CNTR
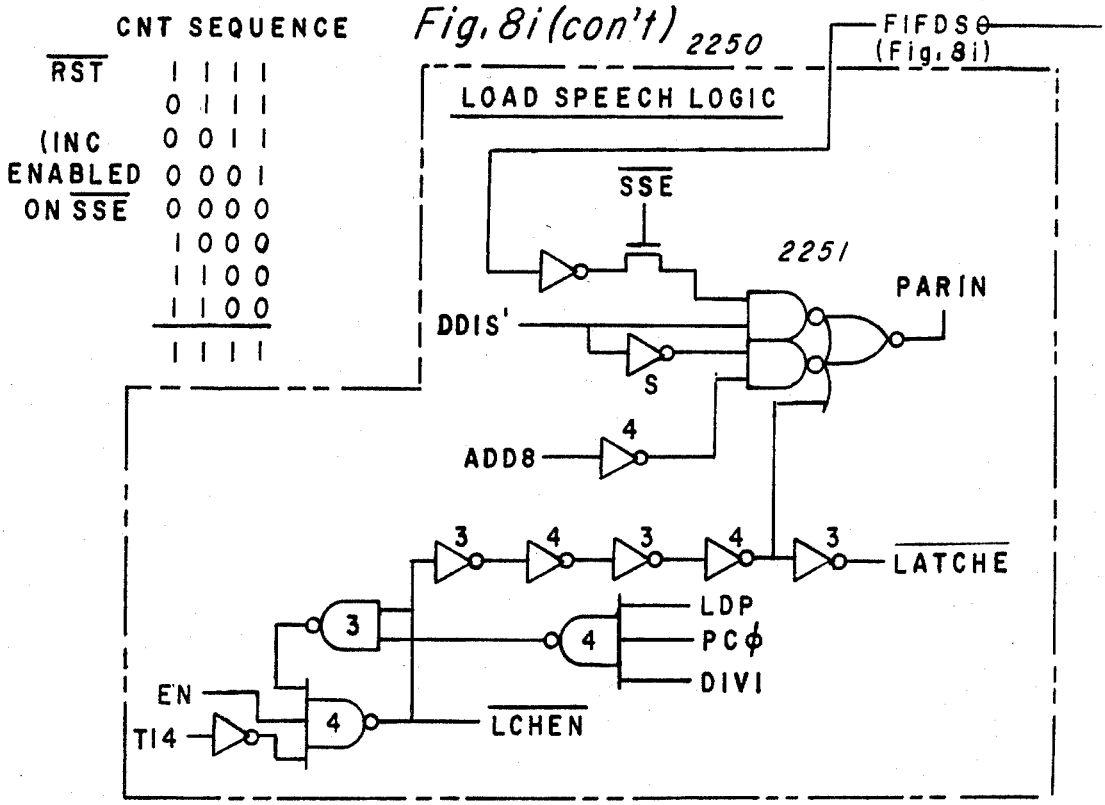
CNT SEQUENCE
RST
(INC ENABLED ON SSE
Fig. 8i (con't)
2250
FIFDS
(Fig. 8i)
LOAD SPEECH LOGIC
SSE
2251
PARIN
DDIS'
S
ADD8
4
3
4
3
4
3
LATCHE
LDP
PCϕ
DIVI
3
4
EN
TI4
4
LCHEN

A
B
II
C1
C2
O
φ4
S
IN
C
OUT
VREF
III
VDD
IV

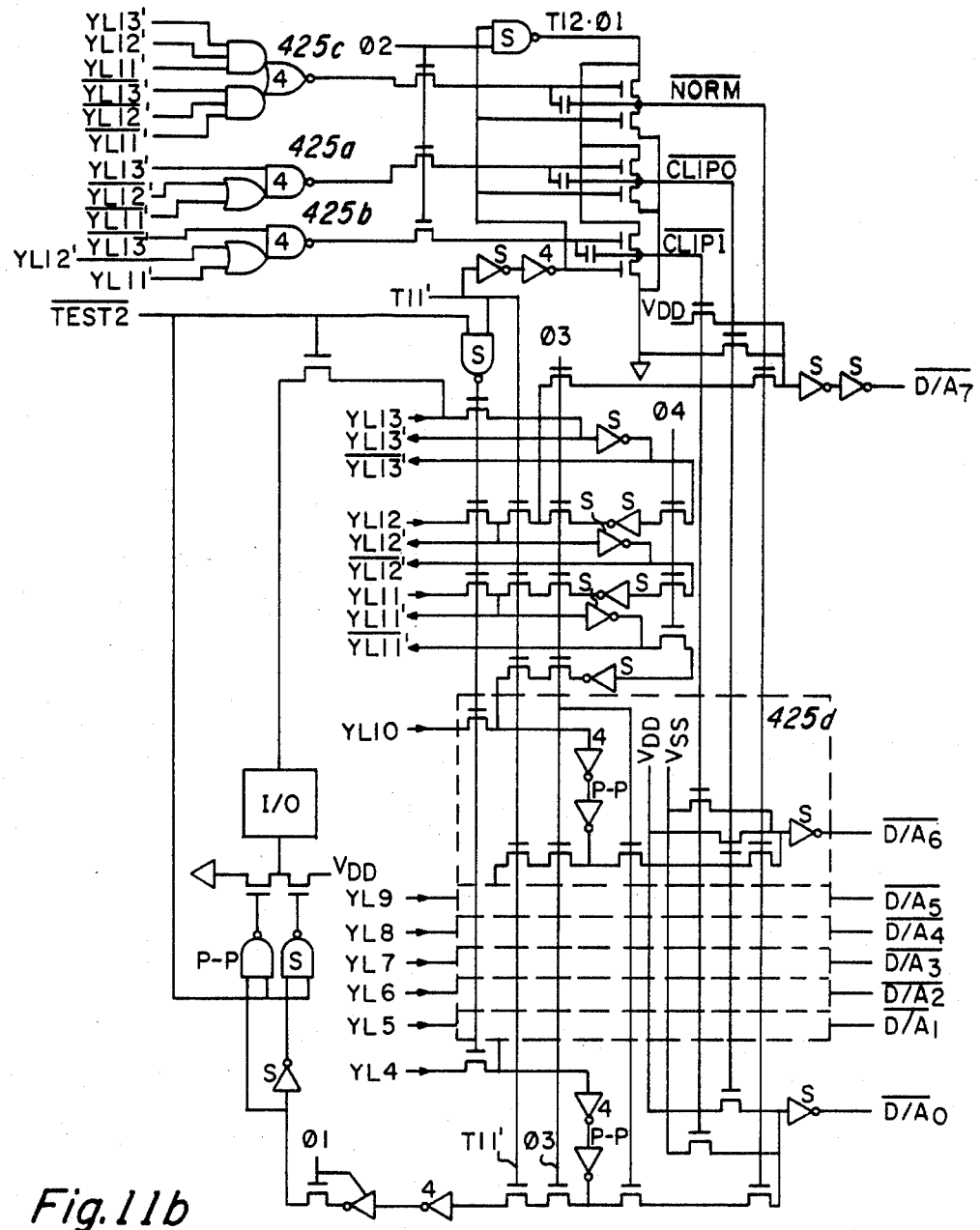
Fig. 11b
(CONTINUED)
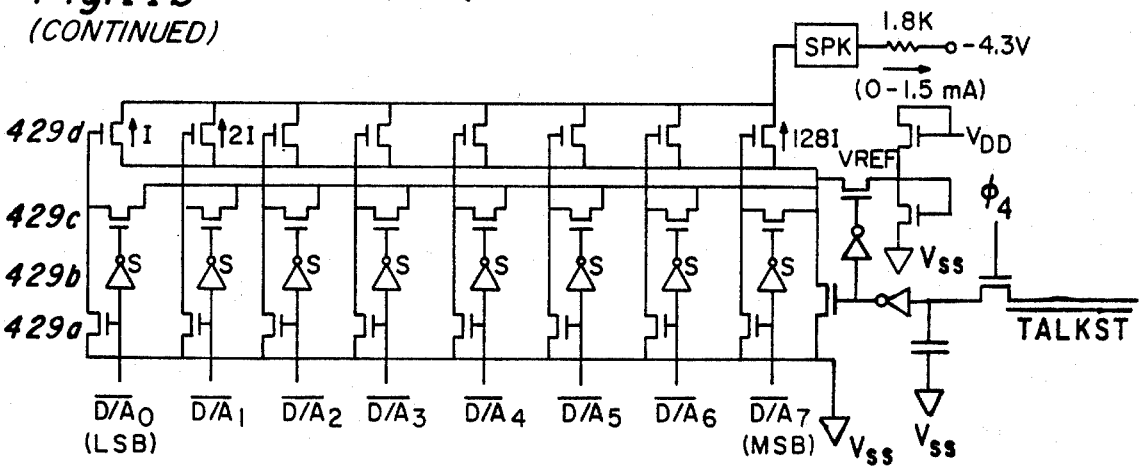

SPEECH SYNTHESIZER FOR USE WITH COMPUTER AND COMPUTER SYSTEM WITH SPEECH CAPABILITY FORMED THEREBY

This is a continuation of application Ser. No. 036,931, filed May 7, 1979, now abandoned.

BACKGROUND

This invention relates to a speech synthesizer capable of electronically synthesizing human speech from digital speech data, and more particularly to a speech synthesizer module implemented in integrated circuitry and operably coupled to a commercial or home-type computer to provide speech capability therefor.

Speech synthesizers are known in the prior art. Examples of previously known speech synthesizers are disclosed in U.S. Pat. Nos. 3,803,358 and 4,092,495 and U.S. patent application Ser. No. 901,393 filed Apr. 28, 1978, now U.S. Pat. No. 4,209,836 issued June 24, 1980.

Disclosed herein is a speech synthesizer which utilizes several integrated circuits in the construction thereof. The integrated circuits include a Speech Synthesizer Processor and two Read-Only-Memories, and are discussed in detail herein.

Preferably, the aforementioned speech synthesizer is implemented utilizing standard field effect transistor, large scale integration techniques, such as P-channel MOS. Additionally, it is preferable that the speech synthesizer be compatible with control circuitry as it exists in various electronic devices.

The speech synthesizer is intended to be operably coupled in module form to a home-type computer to provide speech capability therefor, wherein the speech synthesizer electronically synthesizes human speech from coded speech data including parameters which may be stored in a suitable memory. However, the speech synthesizer may be employed in any application in which an audible verbal informational or instructional response is desired.

It was, therefore, one object of this invention that a speech synthesizer be implemented utilizing low cost, large scale integrated circuit devices.

It was another object of this invention that the speech synthesizer be electrically compatible with existing TTL logic levels.

It was yet another object of this invention that the speech synthesizer utilize coded speech parameters stored in a solid state memory.

It was yet another object of this invention that the speech synthesizer also be able to utilize coded speech parameters inputted via a control device.

The foregoing objects are achieved as is now described. A speech synthesizer is controlled by an appropriately programmed microprocessor, preferably the central processing unit of a commercial or home-type computer. The speech synthesizer utilizes data coding and compression schemes to minimize required data rates. The coded speech parameters are utilized to control the reflection coefficients of a digital filter within the speech synthesizer. The output of the digital filter is applied to a digital-to-analog converter which transforms the digital output of the digital filter to an audio signal. The reconstructed audio signal may then be utilized as the input to a conventional amplifier and speaker system.

In a specific aspect of the invention, the speech synthesizer is in the form of a module operably coupled to a home-type computer, wherein the speech synthesizer provides analog signals representative of human speech from coded digital speech data including parameters as stored either in a solid state memory on a permanent basis or alternatively as temporarily stored in another memory. In the latter instance, the coded digital speech data is made available from an external source, such as the central processing unit of the home-type computer. Thus, the speech synthesizer possesses two alternative modes of operation: (1) a "speak mode" which uses coded speech parameters permanently contained in a read-only-memory of the speech module; and (2) a "speak external mode" in which the coded speech parameters are provided from the central processing unit of the home-type computer, wherein coded speech parameters are input via an input buffer to the speech module where they are decoded and used to produce synthesized human speech. The speech module includes a speech synthesizer processor for converting coded speech data into digital speech signals in combination with a mode selector means which selectively applies either the coded speech data from the read-only-memory within the speech module or the coded speech data obtained from the external source to the speech synthesizer processor in response to a control signal provided by the external source. Such an arrangement greatly expands the library of words available to the speech synthesizer because of the vastly greater memory storage capacity afforded by the external source.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrated embodiment when read in conjunction with the accompanying drawings, wherein:

FIG. 1*c* is a front elevation view of a computer showing the Speech Module of FIGS. 1*a* and 1*b* connected thereto;

FIGS. 7*a*–7*d* form a composite logic diagram of the timing circuits of the speech synthesizer;

FIGS. 8*a*–8*m* form a composite logic diagram of the speech synthesizer/computer/CPU interface logics;

FIGS. 9*a*–9*d* form a composite logic diagram of the interpolator logics;

FIGS. 10*a*–10*c* form a composite logic diagram of the array multiplier;

FIGS. 11*a*–11*d* form a composite logic diagram of the lattice filter and excitation generator of the speech synthesizer;

GENERAL DESCRIPTION

Figure 1A:
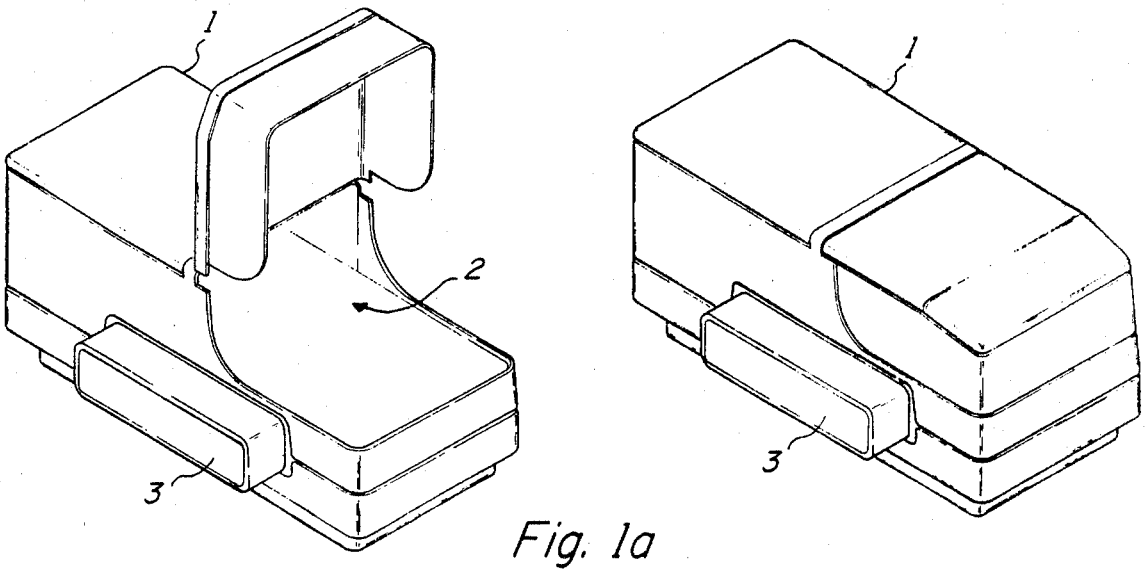
FIG. 1*a* is a perspective view of a Speech Module showing the case thereof in an open position for receiving an additional memory unit.
Figure 1B:
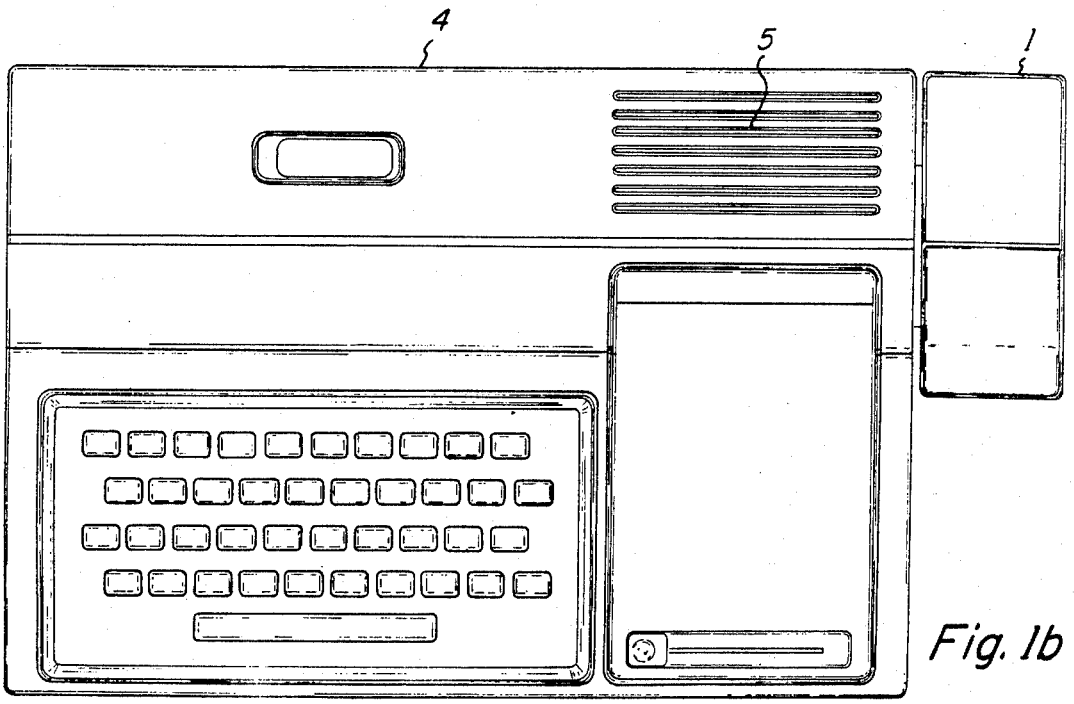
FIG. 1*b* is a perspective view of the Speech Module similar to FIG. 1*a*, but showing the case in closed position.
Figure 2:
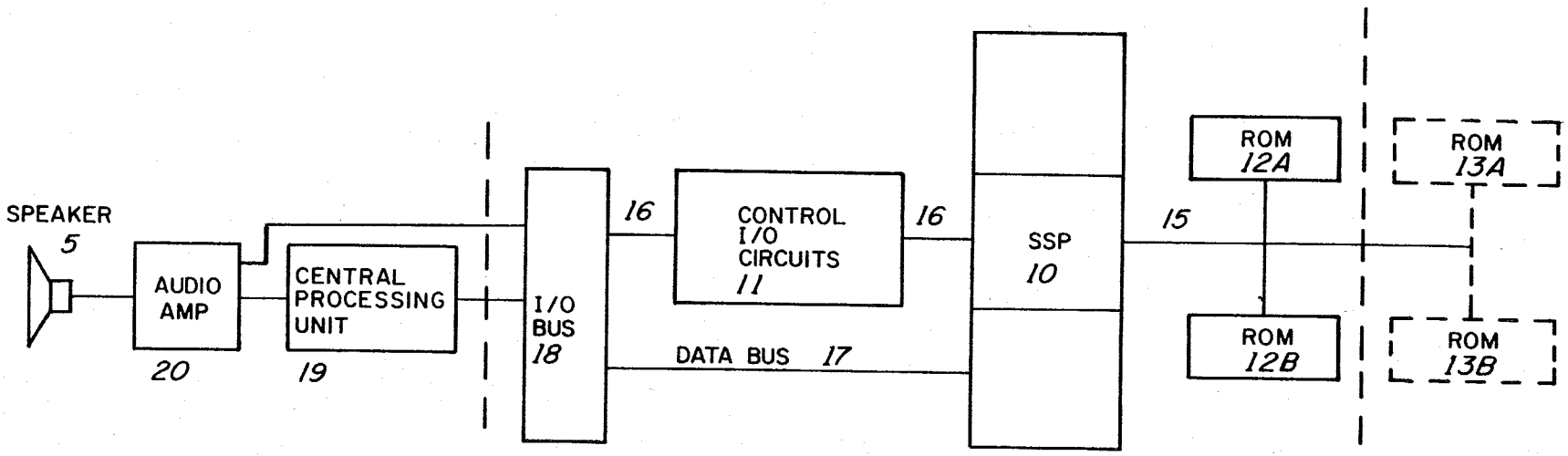
FIG. 2 is a block diagram of the major components preferably making up the interface system between a computer and the Speech Module.

FIGS. 1*a* and 1*b* are perspective views of a Speech Module of a type which may be operably coupled to a commercial or home-type computer in accordance with the present invention. The Speech Module includes a case 1 (shown in open position for receiving an additional memory unit in FIG. 1*a* and in closed position in FIG. 1*b*) which encloses electronic circuits, preferably implemented as integrated circuits (not shown in this figure). Also shown is access slot 2 in FIG. 1*a* into which additional memory units may be placed to supplement the installed memory circuits. These circuits are coupled through pin connector 3 to a commercial or home-type computer, electronic toys for children, or any product wherein a verbal instructional or informational response is desired. It will, of course, be appreciated by those skilled in the art, that alternative means of connection may be used if desired. FIG. 1*c* shows an embodiment wherein the Speech Module is connected via pin connector 3 to a control device in the form of a computer 4, which includes a speaker 5. The computer 4 may be a home-type computer having design characteristics specifically applicable to use in the home by operators having limited skills concerning computer use. FIG. 2 shows the major blocks of the speech synthesizer system, including some blocks within the computer, namely the Central Processing Unit 19, the audio amplifier 20 and the speaker system 5, which are required to operate the Speech Module.

Having described the outward appearance of the Speech Module, the modes in which the Speech Module may operate will first be described, followed by a description of the block diagrams and detailed logic diagrams of the various electronic circuits used to implement the Speech Module of FIGS. 1*a* and 1*b*.

MODES OF OPERATION

The Speech Module of this embodiment has two modes of operation.

The first mode, the Speak mode, utilizes coded speech parameters contained in a phrase Read-Only-Memory (ROM) within the Speech Module. The coded parameters are inputted to the Speech Synthesizer Processor (SSP) chip, where they are decoded and used to construct a time varying model of the vocal tract. This model is used to produce a synthetic speech wave form.

In the second mode of operation, the Speak External mode, the coded speech parameters are provided from an external source, preferably the Central Processing Unit (CPU) of a commercial or home-typ computer. The coded speech parameters are inputted through an input buffer to the Speech Synthesizer Processor (SSP) chip, where they are decoded and used to produce synthetic speech.

BLOCK DIAGRAM OF THE SPEECH MODULE

FIG. 2 is a block diagram of the major components making up the disclosed embodiment of a speech synthesizer system. The electronics of the disclosed Speech Module may be divided into three major functional groups, one being the Speech Synthesizer Processor 10, another being the Control Input/Output Circuits package 11 and another being Read-Only-Memories 12A and 12B. In the embodiment disclosed, these major functional groups are each integrated on a separate integrated circuit chip, except for the ROM functional group 12A and 12B which is integrated onto two integrated circuit chips. The coded speech parameters for the desired speech outputs are stored in the ROM functional group 12A and 12B. Additionally, other coded speech parameters may be stored in separate "dictionary modules" shown as read-only-memories 13A and 13B which may be connected to the Speech Module in a manner similar to that described in U.S. patent application Ser. No. 003,449, filed Jan. 15, 1979, now U.S. Pat. No. 4,295,181 issued Oct. 13, 1981. These additional read-only-memories 13A and 13B are depicted by dashed lines, since they will be plugged into the Speech Module by an operator, rather than normally packaged with the system.

The Speech Synthesizer Processor 10 is interconnected with the read-only-memories 12A and 12B via data path 15 and is connected to the input/output bus 18 via data path 16 and control input/output circuitry package 11. In a preferred embodiment, addresses of coded speech parameters are transmitted by a Central Processing Unit (CPU) 19 of a home or commercial type computer, to the Read-Only-Memories 12A and 12B by Speech Synthesizer Processor 10 because, as will be seen, Speech Synthesizer Processor 10 is preferably equipped with buffers capable of addressing a plurality of Read-Only-Memories. Of course, a Central Processing Unit with appropriately sized buffers could transmit addresses to a plurality of Read-Only-Memories and thus, in certain embodiments, it may be desirable to couple the input from a Central Processing Unit directly to the Read-Only-Memories.

As will be seen, the Speech Synthesizer processor 10 synthesizes human speech or other sounds according to frames of data stored in Read-Only-Memories 12A and 12B or 13A and 13B. The Speech Synthesizer Processor employs a parameter interpolator of the type described in U.S. patent application, Ser. No. 901,394, filed Apr. 28, 1978, now U.S. Pat. No. 4,189,779 issued Feb. 19, 1980, which is hereby incorporated herein by reference. The Speech Synthesizer Processor 10 also utilizes a digital filter of the type described in U.S. patent application Ser. No. 905,328, filed May 12, 1978, now U.S. Pat. No. 4,209,844 issued June 24, 1980. U.S. Pat. No. 4,209,844 is hereby incorporated herein by reference. As will be seen, the Speech Synthesizer Processor 10 includes a digital-to-analog "D to A" converter for converting the digital output of the digital filter to analog signals capable of driving a sound amplifier and speaker system. Speech Synthesizer Processor 10 also includes timing, control and data storage, and data compression systems which will be subsequently described in detail.

CONTROL INPUT OUTPUT LOGIC CIRCUITRY

Figure 3:
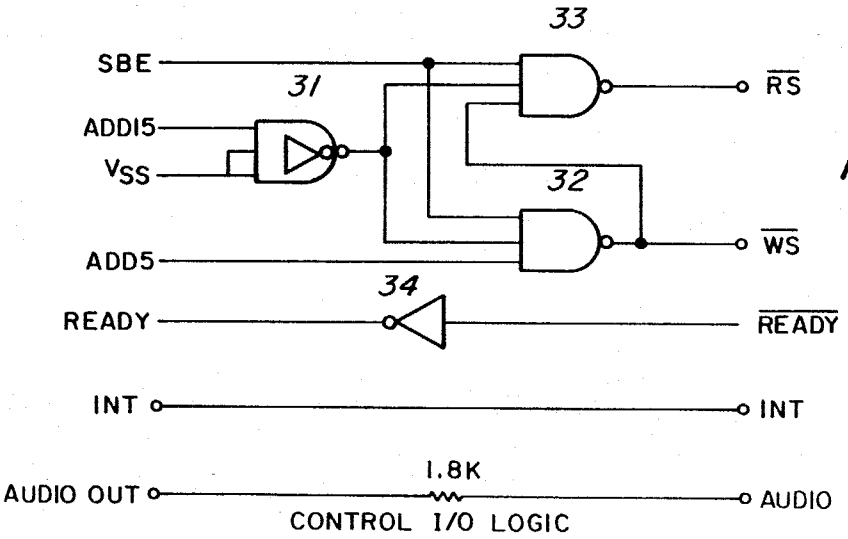
FIG. 3 is a logic diagram of the Input/Output Circuitry included in the interface system shown in FIG. 2.

FIG. 3 shows the control input/output circuitry package 11. The control input/output circuitry 11 comprises three, 3-input NAND gates 31, 32 and 33 with open collectors. These logic gates may be similar to the SN74LS10 chip manufactured by Texas Instruments Incorporated of Dallas, Tex. Two of the inputs to the NAND gate 31 are connected to Vss. The third input is address bit 15 (ADD15) from the Central Processing Unit 19. Since two of its inputs are always high, NAND gate 31 effectively acts as an inverter and its output is $\overline{\text{ADD15}}$. NAND gate 32 has as its inputs, the ADD15 from the output of NAND gate 31, the speech block enable signal SBE, and address bit 5 (ADD5). Therefore, the output of NAND gate 32 is a function of SBE, ADD5 and $\overline{\text{ADD15}}$. This output is designated WRITE SELECT, S)/ and is coupled to the Speech Synthesizer Processor 10. A WRITE SELECT command from the central processing unit 19 allows the Speech Module to accept 8 bits of data via the bi-directional data bus 17. NAND gate 33 has as its inputs $\overline{\text{ADD15}}$ from the output of NAND gate 31, the speech block enable signal (SBE) and $\overline{\text{ADD5}}$, coupled from the output of NAND gate 32. Therefore, the output of NAND gate 33 is a function of SBE, $\overline{\text{ADD5}}$ and $\overline{\text{ADD15}}$. This output is designated READ SELECT S)/ and is coupled to the Speech Synthesizer Processor 10. A READ SELECT command from the central processing unit 19 allows the Speech Module to output 8 units of data via the bi-directional data bus 17 or, causes the Speech Module to generate certain status signals at preselected points along data bus 17.

Additionally, the Speech Synthesizer Process 10 can generate an interrupt signal (INT) which indicates to the Central Processing Unit 19 some change in Speech Synthesizer Processor status which may require Central Processing Unit attention. The particular status changes which can cause an interrupt (INT) signal to be generated will be discussed at length herein. Inverter 34 inverts the $\overline{\text{READY}}$ signal at its input to provide the READY signal for the Central Processing Unit 19. When $\overline{\text{READY}}$ is high, the Central Processing Unit 19 is locked to the speech synthesizer 10.

SPEECH SYNTHESIZER BLOCK DIAGRAM

Figure 4A:
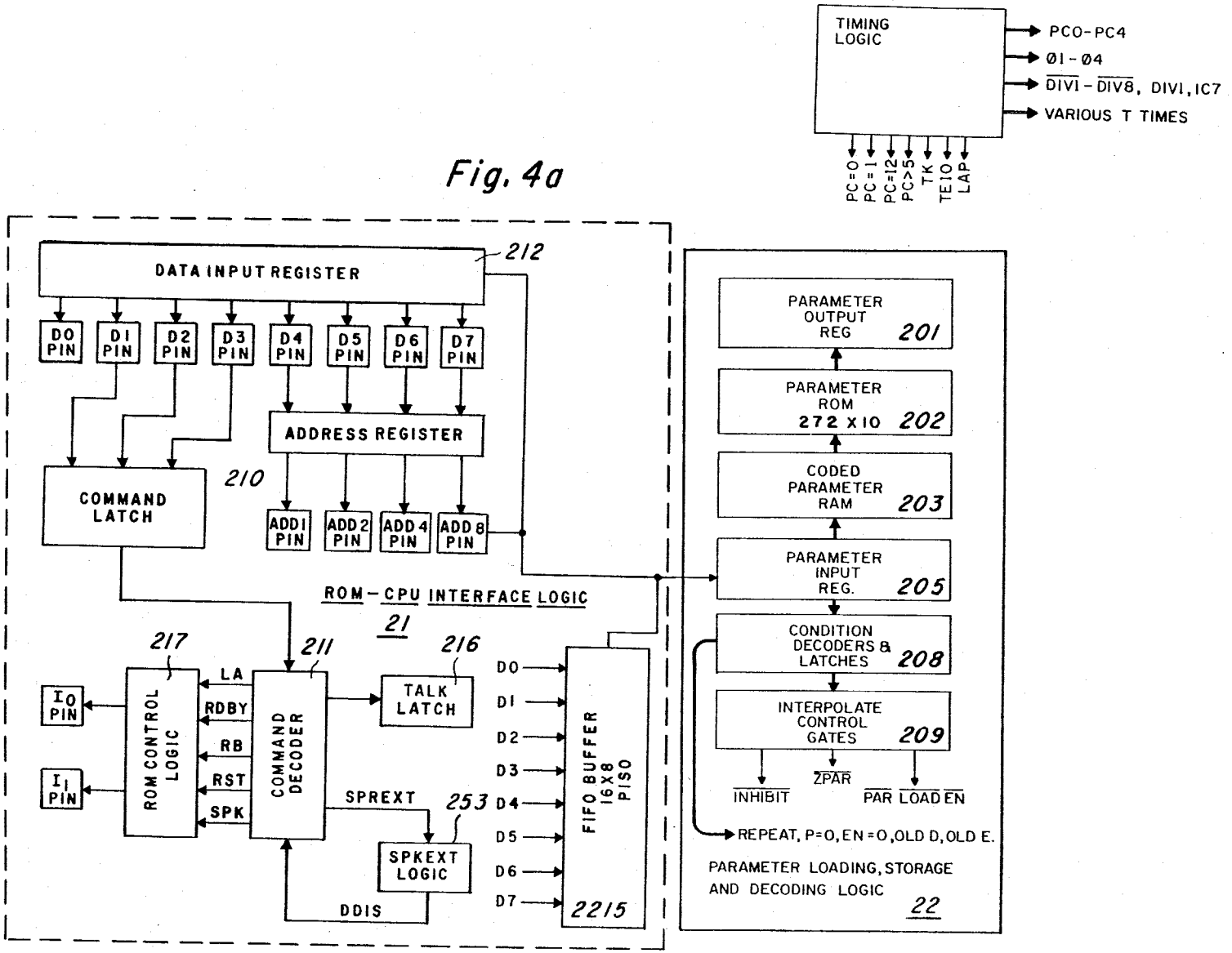
FIGS. 4*a* and 4*b* form a composite block diagram (when placed side by side) of the speech synthesizer processor.
Figure 4B:
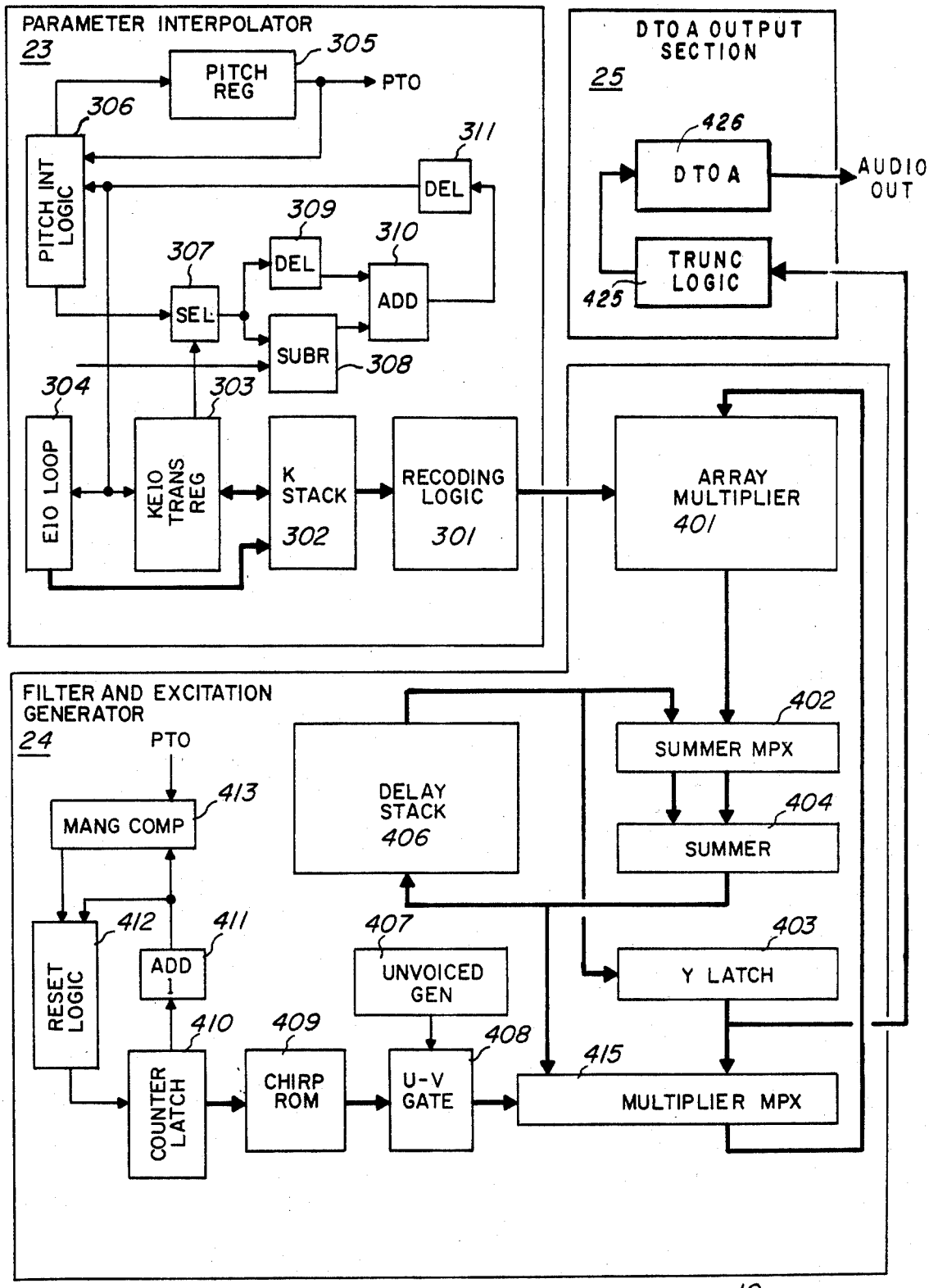

FIGS. 4*a* and 4*b* form a composite block diagram of the Speech Synthesizer Processor 10. Speech Synthesizer Processor 10 is shown as having 6 major functional blocks, all but one of which are shown in greater detail in block diagram form in FIGS. 4*a* and 4*b*. The 6 major functional blocks are timing logic 20; ROM-CPU interface logic 21; parameter loading, storage and decoding logic 22; parameter interpolator 23; filter and excitation generator 24 and digital-to-analog conversion and output section 25. Subsequently, these major functional blocks will be described in detail with respect to FIGS. 5–14*b*.

ROM/CPU Interface Logic

Referring again to FIGS. 4*a* and 4*b*, ROM/CPU interface logic 21 couples the speech synthesizer 10 to Read-Only-Memories 12A and 12B and to the Central Processing Unit 19 (not shown). The 8 bit bi-directional data bus 17 (D0–D7) is coupled, in this embodiment, to the Central Processing Unit 19 and to the inputs of FIFO buffer 2215, while the address 1–8 (ADD-1–ADD8) and instruction 0–1 ($I_0$–$I_1$) pins are connected to ROMS 12A and 12B (as well as ROMS 13A and 13B, if used). ROM/CPU interface logic 21 sends address information from the Central Processing Unit 19 to the Read-Only-Memories 12A and 12B through address register 213 to address pins ADD1–ADD8. Command register 210 stores a 3 bit command from the central processing unit 19, which is decoded by command decoder 211. Command decoder 211 is responsive to 6 commands: SPEAK (SPK), for causing the synthesizer 10 to access data from the Read-Only-Memory 12A or 12B and speak in response thereto; a RESET (RST) command for resetting the synthesizer to zero; a LOAD ADDRESS (LA) command, wherein 4 bits are received from the Central Processing Unit 19 at the D4–D7 pins and transferred to the Read-only-Memories 12A and 12B as address digits via address register 213 and the ADD1–ADD8 pins; a READ AND BRANCH (RB) command which causes the Read-Only-Memory 12A or 12B to take the contents of the present and subsequent addresses and use it for a branch address; a READ BYTE (RDBY) command which allows the Central Processing Unit 19 to access data stored in the Read-Only-Memory 12A or 12B via address pin (ADD8) and data input register 212; and a SPEAK EXTERNAL (SPKEXT) command which causes the speak external logic circuit 253 to generate a DECODER DISABLE (DDIS) signal, which disables command decoder 211, and allows the Central Processing Unit 19 to input 8 bits of data into FIFO buffer 2215 via inputs D0–D7. Once synthesizer 10 has commenced speaking in response to a SPK command, it continues speaking until ROM interface logic 21 encounters an RST command, or gate 207 (see FIG. 8*f*) detects an "energy equal to 15" code and resets talk latch 216 in response thereto. Once synthesizer 10 has commenced speaking in response to a SPKEXT command, it continues speaking until gate 207 detects an "energy equal to 15" code or a buffer empty (BE) command is generated by FIFO status logic 2230 (see FIG. 8*k*) and resets talk latch 216 in response thereto. As will be seen, an "energy equal to 15" code is used as the last frame of data in a plurality of frames of data for generating words, phrases or sentences. The LA, RB and RDBY commands are decoded by command decoder 211 and are re-encoded via ROM control logic 217 and transmitted to the Read-Only-Memories 12A and 12B via the instruction pins $I_0$ and $I_1$.

Talk latch 216 is set in response to a decoded SPK or SPKEXT command and is reset: (1) during a power up clear (PUC) which automatically occurs whenever the synthesizer is energized; (2) by a decoded RST command; (3) by an "energy equals 15" code in a frame of speech data or (4) by a BE command from FIFO status logic 2230. The TALKD output is a delayed output to permit all speech parameters to be inputted into the synthesizer before speech is attempted.

PARAMETER LOADING, STORAGE AND DECODING LOGIC

The parameter loading, storage and decoding logic 22 includes a 7 bit long parameter input register 205 which receives serial data from the Read-Only-Memories 12A and 12B via Load Speech logic 2250 (see FIG. 8*m*) from gate 2251, which has as its input the data from pin ADD8, in response to an RDBY command outputted to the selected Read-Only-Memory 12A or 12B via the instruction pins $I_0$ and $I_1$. A coded parameter random access memory (RAM) 203 and condition decoders and latches 208 are connected to receive the data inputted into the parameter input register 205. As will be seen, each frame of speech data is inputted in three to six bit portions, via parameter input register 205 to random access memory (RAM) 203, in a coded format, where the frame is temporarily stored. Each of the coded parameters stored in random access memory (RAM) 203 is converted to a 10 bit parameter by parameter read-only-memory 202 and temporarily stored in a parameter output register 201.

As will be discussed with respect to FIG. 6, the frames of data may be either wholly or partially inputted into parameter input register 205, depending upon the length of the particular frame being inputted. Condition decoders and latches 208 are responsive to particular portions of the frame of data for setting repeat, pitch equal zero, energy equal zero, old pitch and old energy latches. The function of these latches will be discussed subsequently with respect to FIGS. 8*a*–8*m*. The condition decoders and latches 208, as well as various timing signals are used to control the interpolation control gates 209. Gates 209 generate an inhibit signal when interpolation is to be inhibited, a zero parameter signal when the parameter is to be zeroed and a parameter load enable signal which, among other things, permits data in parameter input register 205 to be loaded into the coded parameter random access memory 203.

PARAMETER INTERPOLATOR

The parameters in parameter output register 201 are applied to the parameter interpolator functional block 23. The inputted K1–K10 speech parameters, including speech energy, are stored in a K-stack 302 and E10 loop 304, while the pitch parameter is stored in a pitch register 305. The speech parameters and energy factor are applied via recoding logic 301 to an array of multiplier 401 in the filter and excitation generator 24. As will be seen, however, when a new parameter is loaded into parameter output register 201, it is not immediately inserted into K-stack 302 or E10 loop 304 or pitch register 305, but rather the corresponding value in K-stack 302, E10 loop 304 or pitch register 305 goes through 8 interpolation cycles during which a portion of the difference between the present value in the K-stack 302, E10 loop 304 or pitch register 305 and the target value of that parameter in parameter output register 201 is added to the present value in K-stack 302, E10 loop 304 or pitch register 305.

Essentially the same logic circuits are used to perform the interpolation of pitch energy and the K1–K10 speech parameters. The target value from the parameter output register 201 is applied along with the present value of the corresponding parameter to a subtractor 308. A selector 307 selects either the present pitch from pitch logic 306 or present energy or K coefficient data from KE10 transfer register 303, according to which parameter is currently in parameter output register 201 and applies the same to subtractor 308 and delay circuit 309. As will be seen, delay circuit 309 may provide anywhere from zero delay to 3 bits of delay. The output of delay circuit 309 as well as the output of subtractor 308 is supplied to an adder 310 whose output is applied to a delay circuit 311. When the delay associated with delay circuit 309 is zero, the target value of the particular parameter in the parameter output register 201 is effectively inserted into K-stack 302, E10 loop 304 or pitch register 305, as is appropriate. The delay in delay circuit 311 is three to zero bits, being three bits when the delay in the delay circuit 309 is zero bits, whereby the total delay through the selector 307, delay circuits 309 and 311, adder 310 and subtractor 308 is constant. By controlling the delays in delay circuits 309 and 311, either all, one half, one fourth or one eighth of the difference outputted from subtractor 308 (that being the difference bewtween the target value and the present value) is added back into the present value of the parameter. By controlling the delays in the fashion set forth in Table I, a relatively smooth 8-step parameter interpolation is accomplished.

U.S. Pat. No. 4,209,844 discusses, with reference to FIG. 7 thereof, a speech synthesis filter wherein speech coefficients K1–K9 are stored in the K-stack continuously, until they are updated, while the K10 coefficient and the speech energy (referred to by the letter A in U.S. Pat. No. 4,209,844) are periodically exchanged. In parameter interpolator 23, speech coefficients K1–K9 are likewise stored in K-stack 302, until they are updated, whereas the energy parameter and the K10 coefficient effectively exchange places in the K-stack 302 during a twenty time period cycle of operations in the filter and excitation generator 24. To accomplish this function, E10 loop 304 stores both the energy parameter and the K10 coefficient and alternately inputs the same into the appropriate location in the K-stack 302. KE10 transfer register 303 is either loaded with the K10 coefficient or energy parameter from E10 loop 304 or the appropriate K1–K9 speech coefficient from K-stack 302 for interpolation by logics 307–311.

As will be seen, recording logic 301 preferably performs a Booth's algorithm on the data from K-stack 302, before such data is applied to array multiplier 401. Recoding logic 301 thereby permits the size of the array multiplier 401 to be reduced compared to the array multiplier described in U.S. Pat. No. 4,209,844.

FILTER AND EXCITATION GENERATOR

The filter and excitation generator 24 includes the array multiplier 401 whose output is connected to a summer multiplexer 402. The output of summer multiplexer 402 is coupled to the input of summer 404 whose output is coupled to a delay stack 406 and a multiplier multiplexer 415. The output of the delay stack 406 is applied as an input to the summer multiplexer 402 and to Y latch 403. The output of Y latch 403 is coupled to an input of multiplier multiplexer 415 along with truncation logic 425. The output of multiplier multiplexer 415 is applied as an input to array multiplier 401. As will be seen, filter and excitation generator 24 makes use of the digital filter described in U.S. Pat. No. 4,209,844. Various minor interconnections are not shown in FIG. 4*b* for the sake of clarity, but which will be described with reference to FIGS. 10*a*–10*c*, and 11*a*–11*d*. The arrangement of the foregoing elements generally agrees with the arrangement shown in FIG. 7 of U.S. Pat. No. 4,209,844; thus, array multiplier 401 corresponds to element 30', summer multiplexer 402 corresponds to elements 37B', 37C' and 37D', gates 414 (FIGS. 11*a*–11*d*) correspond to element 33', delay stack 406 correesponds to elements 34' and 35', Y latch 403 corresponds to element 36' and multiplier multiplexer 415 corresponds to elements 38A', 38B', 38C' and 38D'.

The voiced excitation data is supplied from unvoiced/voice gate 408. As will be subsequently described in greater detail, the parameters inserted into parameter input register 205 are supplied in a compressed data format. According to the data compression scheme used, when the coded pitch parameter is equal to zero, in input register 205, it is interpreted as an unvoiced condition by condition decoders and latches 208. Gate 408 responds by supplying randomized data from unvoiced generator 407 as the excitation input. When the coded pitch parameter is of some other value, however, it is decoded by parameter ROM 202, loaded into parameter output register 201 and eventually inserted into pitch register 305, either directly or by the interpolation scheme previously described. Based on the period indicated by the number in pitch register 305, voiced excitation is derived from chirp ROM 409. As discussed in U.S. Pat. No. 4,209,844, the voiced excitation signal may be an impulse function or some other repeating function, such as a repeating chirp function. In this embodiment, a chirp has been selected as this tends to reduce the "fuzziness" from the speech generated (because it apparently more closely models the action of the vocal cords than does an impulse function). The chirp is repetitively generated by chirp ROM 409. Chirp ROM 409 is addressed by counter latch 410, whose address is incremented in an add one circuit 411. The address in counter latch 410 continues to increment in add one circuit 411, recirculating via reset logic 412 until magnitude comparator 413, which compares the magnitude of the address being outputted from add one circuit 411 and the contents of the pitch register 305, indicates that the value in counter latch 410 then compares with or exceeds the value in pitch register 305, at which time reset logic 412 zeroes the address in counter latch 410. Beginning at address zero and extending through approximately fifty addresses is the chirp function in chirp ROM 409. Counter latch 410 and chirp ROM 409 are set up so that addresses larger than fifty do no cause any portion of the chirp function to be outputted from chirp ROM 409 to unvoiced gate 408. In this manner the chirp function is repetitively generated on a pitch related period during voiced speech.

SYSTEM TIMING

Figure 5:
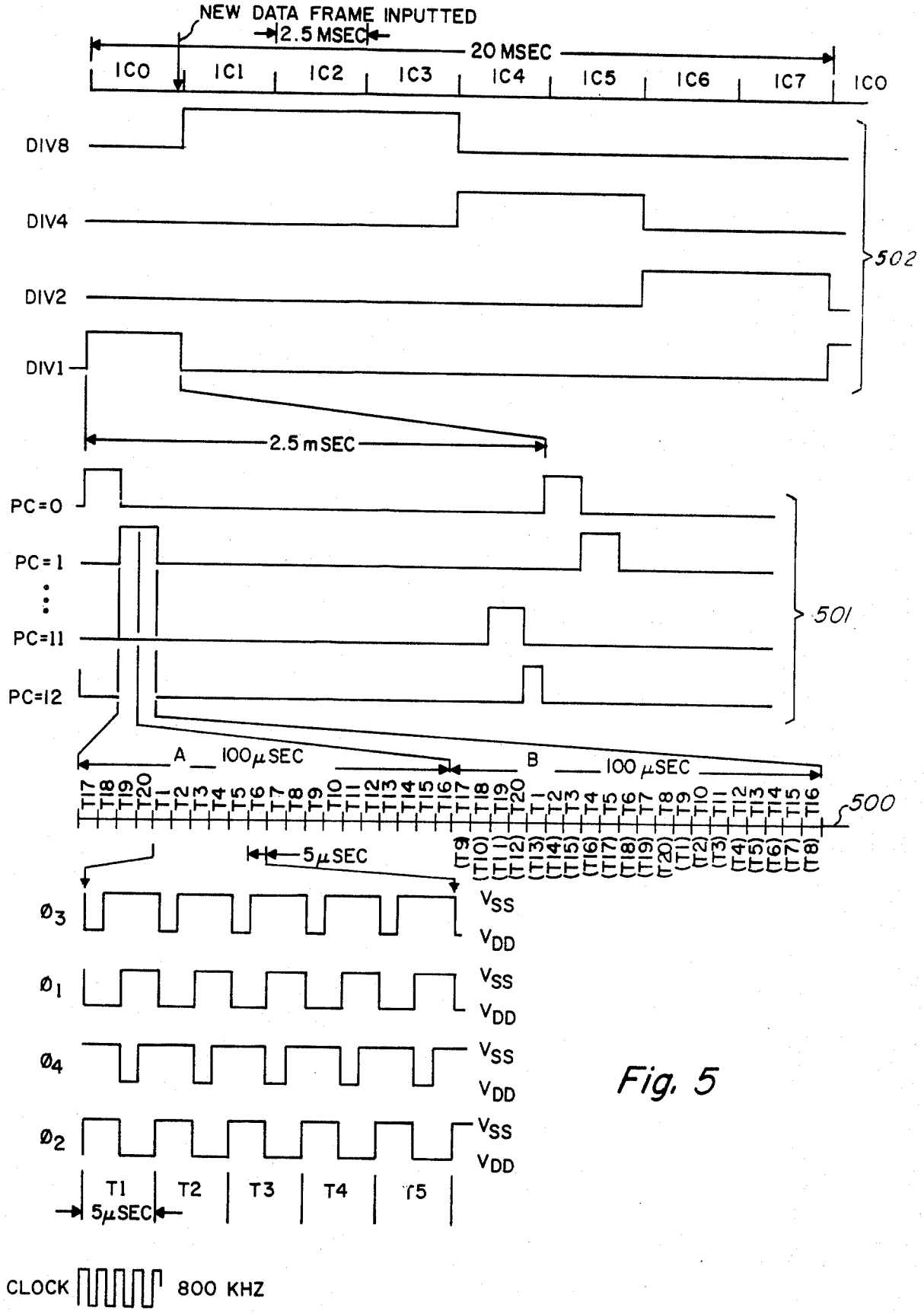
FIG. 5 is a timing diagram of various timing signals preferably used on the speech synthesizer.

FIG. 5 depicts the timing relationships between the occurrences of the various timing signals generated with respect to the speech synthesizer 10. Also depicted are the timing relationships with respect to the time new frames of data are inputted to the speech synthesizer 10, the timing relationship with respect to the interpolations performed on the inputted parameters, the timing relations with respect to the foregoing with the time periods of the lattice filter and the relationship of all the foregoing to the basic clock signals.

The synthesizer is preferably implemented using precharged, conditional discharge type logics and therefore FIG. 5 shows clocks $\phi$1–$\phi$4 which may be appropriately used with such precharge-conditional discharge logic. There are two main clock phases ($\phi$1 and $\phi$2) and two precharge clock phases ($\phi$3 and $\phi$4). Phase $\phi$3 goes low during the first half of phase $\phi$2 and serves as a precharge therefor. A set of clocks $\phi$1–$\phi$4 is required to clock one bit of data and thus corresponds to one time period.

The time periods are labeled T1–T20 and each preferably has a time period on the order of five microseconds. Selecting a time period on the order of five microseconds permits, as will be seen, data to be outputted from the digital filter at a ten kilohertz rate (i.e., at a 100 microsecond period) which provides for a frequency response of five kilohertz in the D to A output section 25 (FIG. 4*b*). It will be appreciated by those skilled in the art, however, that depending on the frequency response which is desired and depending upon the number of speech coefficients used, and also depending upon the type of logics used, that the periods or frequencies of the clocks and clock phases shown in FIG. 5 may be substantially altered, if desired.

As is explained in U.S. Pat. No. 4,209,844, one cycle time of the digital filter in filter excitation generator 24, preferably comprises twenty time periods, T1–T20. For reasons not important here, the numbering of these time periods differs between this application and U.S. Pat. No. 4,209,844. To facilitate an understanding of the differences in the numbering of the time periods, both numbering schemes are shown at the time period time line 500 in FIG. 5. At time line 500, the time periods, T1–T20 which are not enclosed in parentheses identify the time periods according to the convention used in this application. On the other hand, the time periods enclosed in parentheses identify the time periods according to the convention used in U.S. Pat. No. 4,209,844. Thus, time period T17 is equivalent to time period (T9).

At numeral 501 are/depicted the parameter count (PC) timing signals. In this embodiment, there are thirteen PC signals, PC=0 through PC=12. The first twelve of these, PC=0 through PC=11, correspond to times when the energy, pitch and K1–K10 parameters, respectively, are available in parameter output register 201. Each of the first twelve PC's comprises two cycles, which are labeled A and B. Each such cycle starts at time period T17 and continues to the following time period T17. During each PC, the target value from the parameter output register 201 is interpolated with the existing value in K-stack 302 in parameter interpolator 23. During the A cycle, the parameter being interpolated is withdrawn from the K-stack 302, E10 loop 304 or pitch register 305, as appropriate, during an appropriate time period. During the B cycle, the newly interpolated value is reinserted in the K-stack 302 (or E10 loop 304, or pitch register 305). The thirteenth PC, PC=12, is provided for timing purposes so that all twelve parameters are interpolated once each during a 2.5 millisecond interpolation period.

As was discussed with respect to the parameter interpolator 23 of FIG. 4*b* and Table I, eight interpolations are performed for each inputting of a new frame of data from Read-Only-Memories 12A and 12B into synthesizer 10. This is seen at numeral 502 of FIG. 5 where timing signals DIV1, DIV2, DIV4 and DIV8 are shown. These timing signals occur during specific interpolation counts (IC) as shown. There are eight such interpolation counts, IC0–IC7. New data is inputted from the Read-Only-Memories 12A and 12B into the synthesizer during IC0. These new target values of the parameters are then used during the next eight interpolation counts, IC1 through IC0; the existing parameters in the pitch register 305, K-stack 302 and E10 loop 304 are interpolated once during each interpolation count. At the last interpolation count, IC0, the present values of the parameters in the pitch register 305, K-stack 302 and E10 loop 304 finally attain the target values previously inputted toward the last IC0 and thus new target values may then again be inputted as a new frame of data. Inasmuch as each interpolation count has a period of 2.5 milliseconds, the period at which new data frames are inputted to the synthesizer is 20 milliseconds or equivalent to a frequency of 50 hertz. The DIV8 signal corresponds to those interpolation counts in which one-eighth of the difference produced by subtractor 308 is added to the present values in adder 310 whereas during DIV4 one-fourth of the difference is added in, and so on. Thus, during DIV2, one-half of the difference from subtractor 308 is added to the present value of the parameter in adder 310 and lastly during DIV1 the total difference is added in adder 310. As has been previously mentioned, the effect of this interpolation scheme can be seen in Table I.

PARAMETER DATA COMPRESSION

It has been previously mentioned that new parameters are inputted to the speech synthesizer at a 50 hertz rate. It will be subsequently seen that in parameter interpolator 23 and excitation generator 24 (FIG. 4*b*), the pitch data, energy data and K1–K10 parameters are stored and utilized as ten bit digital binary numbers. If each of these twelve parameters were updated with a ten bit binary number at a fifty hertz rate from an external source, such as Read-Only-Memories 12A and 12B, this could require a $12\times10\times50$ or 6,000 hertz bit rate. Using the data compression techniques which will be explained, the bit rate required for synthesizer 10 is reduced to on the order of 1,000 to 1,200 bits per second. And more importantly, it has been found that the speech compression schemes herein disclosed do not appreciably degrade the quality of speech generated thereby in comparison to using the data uncompressed.

Figure 6:
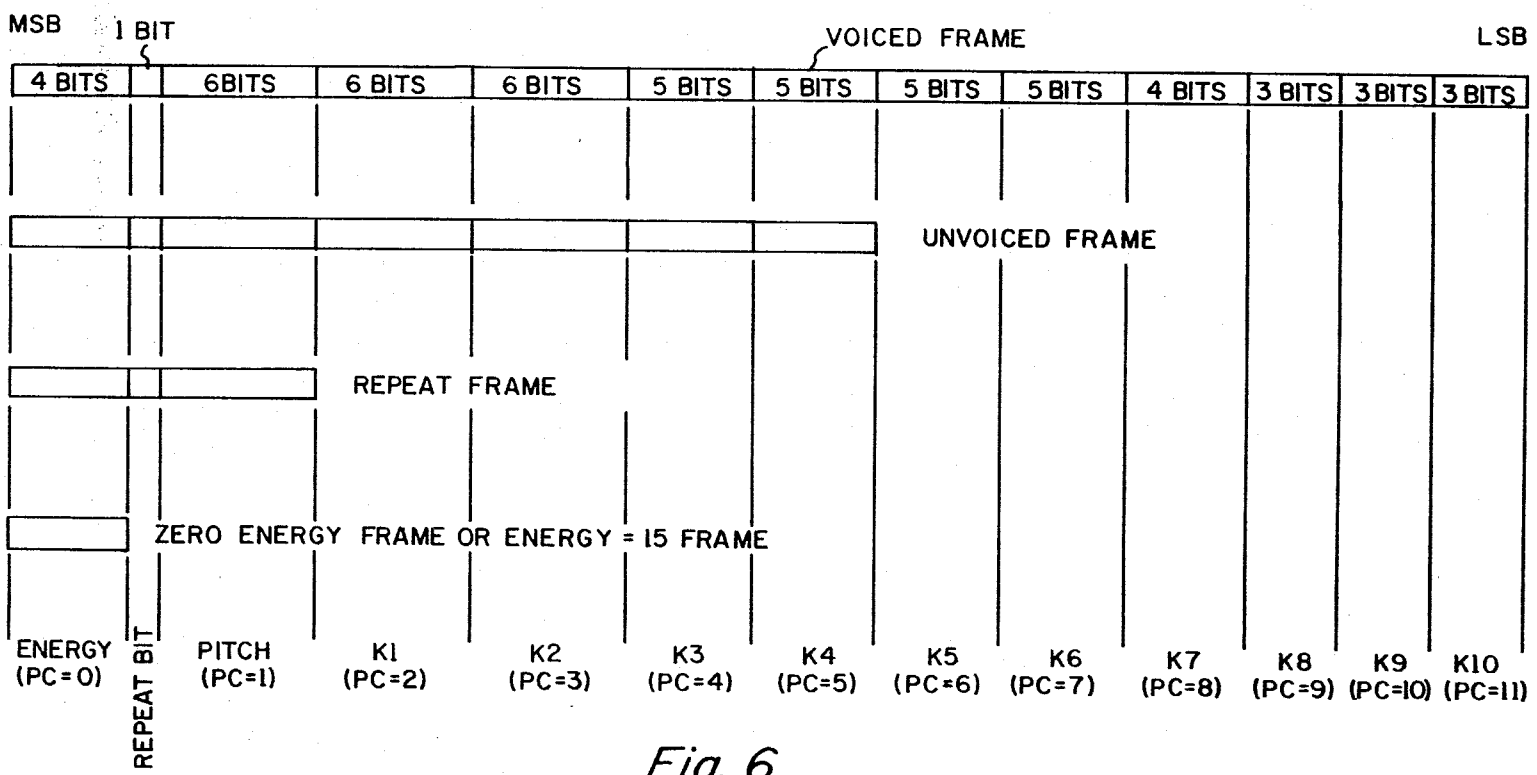
FIG. 6 pictorially shows the data compression scheme preferably used to reduce the data rate required by the speech synthesizer.

The data compression scheme used is pictorially shown in FIG. 6. Referring now to FIG. 6, it can be seen that there are pictorially shown four different lengths of frames of data. One, labeled voice frame, has a length of 56 bits while another entitled unvoiced frame, has a length of 33 bits while still another, called "repeat frame", has a length of eleven bits and still another which may be alternatively called zero energy frame or energy equals 15 frame has the length of but four bits. The "voiced frame" supplies four bits of data for a coded energy parameter, as well as coded four bits for parameter K7. Six bits of data are reserved for each of three coded parameters, pitch, K1 and K2. Five bits of data are reserved for parameters K3 through K6. Additionally, three bits of data are provided for each of three coded speech parameters K8–K10 and finally another bit is reserved for a repeat bit.

In lieu of inputting ten bits of binary data for each of the parameters, a coded parameter is inputted which is converted to a ten bit parameter by addressing parameter ROM 202 with the coded parameter. Thus, coefficient K1, for example, may have any one of thirty-six different values, according to the six bit code for K1, each one of the thirty-six values being a ten bit numerical coefficient stored in parameter ROM 202. Thus, the actual values of coefficients K1 and K2 may have one of thirty-six different values while the actual values of coefficients K3 through K6 may be one of twenty different values. Coefficient K7 may be one of sixteen different values and the values of coefficients K8 through K10 may be one of eight different values. The coded pitch parameter is six bits long and therefore may have up to sixty-four different values. However, only sixty-three of these reflect actual pitch values, a pitch code of 000000 being used to signify an unvoiced frame of data. The coded energy parameter is four bits long and therefore would normally have sixteen available ten bit values; however, a coded energy parameter equal to 0000 indicates a silent frame such as occurs during pauses in and between words, sentences and the like. A coded energy parameter equal to 1111 (energy equals fifteen), on the other hand, is used to signify the end of a segment of spoken speech, thereby indicating that the synthesizer is to stop speaking. Thus, of the sixteen codes available for the coded energy parameter, fourteen are used to signify different ten bit speech energy levels.

Coded coefficients K1 and K2 have more bits than coded coefficients K3–K6 which in turn have more bits than coded coefficients K7 through K10 because coefficient K1 has a greater effect on speech than K2 which has a greater effect on speech than K3 and so forth through the lower order coefficients. Thus, given the greater significance of coefficients K1 and K2 than coefficients K8 through K10, for example, more bits are used in coded format to define coefficients K1 and K2 than K3–K6 or K7–K10.

Also it has been found that voiced speech data needs more coefficients to correctly model speech than does unvoiced speech and therefore when unvoiced frames are encountered, coefficients K5 through K10 are not updated, but rather are merely zeroed. The synthesizer realizes when an unvoiced frame is being outputted because the encoded pitch parameter is equal to 000000.

It has also been found that during speech there often occur instances wherein the parameters do not significantly change during a twenty millisecond period; particularly, the K1–K10 coefficients will often remain nearly unchanged. Thus, a repeat frame is used wherein new energy and new pitch are inputted to the synthesizer, however, the K1–K10 coefficients previously inputted remain unchanged. The synthesizer recognizes the ten bit repeat frame because the repeat bit between energy and pitch then comes up whereas it is normally off. As previously mentioned, there occur pauses between speech or at the end of speech which are preferably indicated to the synthesizer; such pauses are indicated by a coded energy frame equal to zero, at which time the synthesizer recognizes that only four bits are to be sampled for that frame. Similarly, only four bits are sampled when an "energy equals fifteen" frame is encountered. Using coded values for the speech in lieu of actual values, alone would reduce the data rate to $55\times50$ or 2750 bits per second. By additionally using variable frame lengths, as shown in FIG. 6, the data rate may be further reduced to on the order of one thousand to twelve hundred bits per second, depending on the speaker and on the material spoken.

SYNTHESIZER LOGIC DIAGRAMS

The various portions of the speech synthesizer of FIGS. 4*a* and 4*b* will now be described with reference to FIGS. 7*a* through 14*b* which depict, in detail, the logic circuits implemented on a semiconductor chip, for example, to form the synthesizer 10. The following discussion, with reference to the aforementioned drawings, refers to logic signals available at many points in the ciruits. It is to be remembered that in P channel MOS devices a logical zero corresponds to a negative voltage, that is, Vdd, while a logical one refers to a zero voltage, that is, Vss. It should be further remembered that the P channel MOS transistors depicted in the aforementioned figures are conductive when a logical zero, that is, a negative voltage, is applied at their respective gates. When a logic signal is referred to which is unbarred, that is, has no bar across the top of it, the logic signal is to be interpreted as "TRUE" logic; that is, a binary one indicates the presence of the signal (Vss) whereas a binary zero indicates the lack of the signal (Vdd). Logic signal names including a bar across the top thereof are "FALSE" logic; that is, a binary zero (Vdd voltag) indicates the presence of the signal whereas a binary one (Vss voltage) indicates that the signal is not present. It should also be understood that a numeral three in clocked gates indicates that phase $\phi$3 is used as a precharge whereas a four in a clocked gate indicates that phrase $\phi 4$ is used as precharge clock. An "S" in the gate indicates that the gate is statically operated.

Timing Logic Diagram

Referring now to FIGS. *7a–7d*, they form a composite, detailed logic diagram of the timing logic for synthesizer 10. Counter 510 is a pseudorandom shift counter including a shift register 510*a* and feed back logic 510*b*. The counter 510 counts in pseudorandom fashion and the TRUE and FALSE outputs from shift register 510*a* are supplied to the input section 511 of a timing PLA. The various T time periods decoded by the timing PLA are indicated adjacent to the output lines thereof. Section 511*c* of the timing PLA is applied to an output timing PLA 512 generating various combinations and sequences of time period signals, such as T odd, $\overline{T10}$–$\overline{T18}$, and so forth. Sections 511*a* and 511*b* of timing PLA 511 will be described subsequently.

The parameter count in which the synthesizer is operating is maintained by a parameter counter 513. Parameter counter 513 includes an add one circuit and circuits which may be responsive to SLOW and SLOW D in an alternative embodiment. In SLOW, the parameter counter repeats the A cycle of the parameter count twice (for a total of three A cycles) before entering the B cycle. That is, the period of the parameter count doubles so that the parameters applied to the lattice filter are updated and interpolated at half the normal rate. To assure that the inputted parameters are interpolated only once during each parameter count during SLOW speaking operations each parameter count comprises three A cycles followed by one B cycle. It should be recalled that during the A cycle the interpolation is begun and during the B cycle the interpolated results are reinserted back into either K-stack 302, E10 loop 304 or pitch register 305, as appropriate. Thus, merely repeating the A cycle has no effect other than to recalculate the same value of a speech parameter but since it is only reinserted once back into either K-stack 302, E10 loop 304 or pitch register 305 only the results of the interpolation immediately before the B cycle are retained. Therefore, in an alternative embodiment, the speech module may be instructed to speak at a slower than normal rate. In the present embodiment, however, this capability is not desired and thus the SLOW and SLOW D inputs are tied to Vss.

Inasmuch as parameter counter 513 includes an add one circuit, the results outputted therefrom, PC1–PC4, represent in binary form, the particular parameter count in which the synthesizer is operating. Output PC0 indicates in which cycle, A or B, the parameter count is. The parameter decimal value of the parameter count is decoded by timing PLA 514 which is shown adjacent to the timing PLA 514 with nomenclature such as PC=0, PC=1, PC=7 and so forth. The relationship between the particular parameters and the value of PC is set forth in FIG. 6. Output portions 511*a* and 511*b* of timing PLA 511 are also interconnected with outputs from timing PLA 514 whereby the TRANSFER K (TK) signal goes high during T9 of PC=2 or T8 of PC=3 or T7 of PC=4 and so forth through T1 of PC=10. Similarly, a LOAD PARAMETER (LDP) timing signal goes high during T5 of PC=0 or T1 of PC=1 or T3 of PC=2 and so forth through T7 of PC=11. As will be seen, signal TK is used in controlling the transfer of data from parameter output register 201 to subtractor 308, which transfer occurs at different T times according to the particular parameter count the parameter counter is in, to assure that the appropriate parameter is being outputted from KE10 transfer register 303. Signal LDP is, as will be seen, used in combination with the parameter input register 205 to control the number of bits which are inputted therein according to the number of bits associated with the parameter then being loaded according to the number of bits in each coded parameter as defined in FIG. 6.

Interpolation counter 515 includes a shift register and an add one circuit for binary counting the particular interpolation cycle in which the synthesizer is operating. The relationship between the particular interpolation count in which the synthesizer is operating and the DIV1, DIV2, DIV4 and DIV8 timing signals derived therefrom is explained in detail with reference to FIG. 5 and therefore additional discussion here would be superfluous. It will be noted, however, that interpolation counter 515 includes a three bit latch 516 which is loaded at T1. The output of three bit latch 516 is decoded by gates 517 for producing the aforementioned DIV1 through DIV8 timing signals. Interpolation counter 515 is responsive to a signal RESETF from parameter counter 513 for permitting interpolation counter 515 to increment only after PC=12 has occurred.

ROM/CPU Interface Logic Diagram

Turning now to FIGS. 8*a*–8*m*, which form a composite diagram, there is shown a detailed logic diagram of ROM/CPU interface logic 21. Parameter input register 205 is a seven bit shift register, most of the stages of which are two bits long. The stages are two bits long in this embodiment, inasmuch as Read-Only-Memories 12A and 12B output, as will be seen, data at half the rate at which data is normally clocked in synthesizer 10.

The coded data in parameter input register 205 is applied on lines IN0–IN5 to coded parameter RAM 203, which is addressed by PC1–PC4 to indicate which coded parameter is then being stored. The contents of register 205 are tested by "all one's" gate 207, "all zeroes" gate 206 and repeat latch 208*a*. As can be seen, gate 206 tests for all zeroes in the 4 least significant bits of register 205 whereas gate 207 tests for all one's in those bits. Gate 207 is also responsive to PC0, DIV1, T16 and PC=0 so that the zero condition is only tested during the time that the coded energy parameter is being loaded into parameter register 205. The repeat bit occurs in this embodiment immediately in front of the coded pitch parameter; therefore, it is tested during the A cycle of PC=1. Pitch latch 208*b* is set in response to all zeroes in the coded pitch parameter and is therefore responsive not only to gate 206 but also to the two most significant bits of the pitch data on line 222 as well as PC=1. Pitch latch 208*b* is set whenever the coded pitch parameter is a 000000 indicating that the speech is to be unvoiced.

Energy equals zero latch 208*c* is responsive to the output of gate 206 and PC=0 for testing whether all zeroes have been inputted as the coded energy parameter and is set in response thereto. Old pitch latch 208*d* stores the output of the pitch equals zero latch 208*b* from the prior frame of speech data while old energy latch 208*e* stores the output of the energy equals zero latch 208*c* from the prior frame of speech data. The contents of old pitch latch 208*d* and pitch equals zero latch 208*b* are compared in comparison gates 209*c* for the purpose of generating an INHIBIT signal. As will be seen, the INHIBIT signal inhibits interpolations and this is desirable during changes from voiced to unvoiced or unvoiced to voiced speech so that the new speech parameters are automatically inserted into K-stack 302, E10 loop 304 and pitch register 305 as opposed to being more slowly interpolated into those memory elements. Also, the contents of old energy latch 208*e* and energy equals zero latch 208*c* are tested by NAND gate 209*d* for inhibiting interpolation for a transition from a non-speaking frame to a speaking frame of data. The outputs of NAND gate 209*d* and gates 209*c* are coupled to a NAND gate 209*e* whose output is inverted to INHIBIT by an inverter 236. Latches 208*a*–208*c* are reset by gate 225 and latches 208*d* and 208*e* are reset by gate 226. When the excitation signal is unvoiced, the K5–K10 coefficients are set to zero, as aforementioned. This is accomplished, in part, by the action of gate 209*b* which generates a ZPAR signal when pitch is equal to zero and when the parameter counter is greater than 5, as indicated by PC5 from PLA 514.

Also shown in FIGS. 8*a*–8*m* is a command register 210 which comprises 3 latches 210*a, b* and *c*, which latch in the data at D1, D2 and D3 in response to a LOAD COMMAND ENABLE (LDCE) signal. The contents of command register 210 are decoded by command decoder 211.

When command decoder 211 decodes an LA command, the 4 bits of data on pins D7, D6, D5 and D4 of data bus 17 are latched into address register 213. The nybble of address contained in address register 213 is then coupled through buffers 214 to the ADD1–ADD8 pins to Read-Only-Memories 12A and 12B. Additionally, the LA command is coupled to RB/LA logic 250 where it is used to generate the I1 instruction pin signal to control Read-Only Memories 12A and 12B. RB/LA logic 250 also generates the LAFIN signal to indicate the end of an LA command.

When command decoder 211 decodes a READ-BYTE (RDBY) command, the data stored in the Read-Only-Memories 12A and 12B is accessible to an external Central Processing Unit 19. The READ BYTE command causes the next 8 bits of data to be read from Read-Only-Memories 12A and 12B into data input register 212. The RDBY command is inputted into gate 291 of data register control circuit 290. The output of gate 291 is used to control buffers 212*a* and to output the data contained in data input register 212 to pins D0–D7 on data bus 17. If the RDBY command is immediately preceded by an LA command at gates 271 and 272 of State Machine 270, the resulting signal which passes through gate 274, generates an I03 instruction pin signal at gate 273. This output, I03, is used to initialize the counter in Read-Only-Memories 12A and 12B. The RDBY command is then delayed after passing through gates 275*a* and 275*b* by delay timer latch 276*a, b* and *c*. Delay timer latch is set at time T2 and reset at time T17. This delay allows sufficient time for the counter in Read-Only Memories 12A and 12B to initialize. The RDBY signal is also applied to gate 278 of State Machine 270. The output of gate 278 is applied to gates 277 and used to generate the READ BYTE ENABLE (RDBYEN) signal at the output of gate 279. The RDBYEN signal is applied to gate 292 in data register control logic 290 together with the odd T times and used to generate the I02 instruction pin signals which clock data out of ROMS 12A and 12B and into data input register 212. If the RDBY command is not immediately preceded by an LA command (when the counter in Read-Only-Memories 12A and 12B is already initialized) then the RDBY command is inputted to gate 281 of State Machine 270 and the I03 instruction pin signal and the corresponding delay generated by delay timer latch 276 are not utilized.

If the command decoder 211 decodes a READ and BRANCH (RB) command, the synthesizer 10 may indirectly address areas of Read-Only-Memories 12A and 12B. This is accomplished by having the RB command applied to RB/LA logic 250 which generates the I1 and IO4 instruction pin signals which are transmitted to Read-Only-Memories 12A and 12B. Additionally, the RB command is applied to RB timer 252 which delays 240 microseconds and then generates READ AND BRANCH FINISH (RBFIN) signal. The RBFIN signal indicates that the READ AND BRANCH instruction has been executed by Read-Only-Memories 12A and 12B. The RB command is also applied to State Machine 270 at gates 272 and 282; however, since the Read-Only-Memories 12A and 12B generate an internal I0 instruction pin signal during READ AND BRANCH operation, gate 282 acts through gate 274 to disable the I0 instruction pin signal normally generated by State Machine 270.

When command decoder 211 decodes a RESET (RST) command, the RST command is used extensively either alone or in combination with the power-up-clear (PUC) signal to initialize or reset various functions throughout synthesizer 10.

When command decoder 211 decodes a SPEAK (SPK) command, the synthesizer 10 generates synthetic speech utilizing coded speech parameters stored in Read-Only-Memories 12A and 12B. This is accomplished by talk enable logic 251 which generates a SPEAK ENABLE (SPEN) signal which is used to set talk latches 216*a, b* and *c*. Talk latch 216*a* generates a TALK STATUS (TALKST) signal which is used extensively throughout synthesizer 10 to indicate that speech is being generated. Talk latches 216*a, b* and *c* remain set unless reset by latch 232*a* or *b* in the event of: 1. a power-up-clear (PUC) and/or a reset (RST); 2. an "energy equals 15" detected by gate 207; or 3. during the speak external mode (which will be subsequently discussed) a signal is generated indicating that the buffer is empty and that command decoder 211 is disabled. The SPK command is also applied to gate 281 of State Machine 270 wherein it is utilized to generate a SPEAK FINISHED (SPKFIN) signal.

When command decoder 211 detects a SPEAK EXTERNAL (SPKEXT) command, the synthesizer shifts to the speak external mode of operation. In the speak external mode of operation, coded speech parameters from an external source, preferably the Central Processing Unit 19 of a commercial or home-type computer, are inputted on D0–D7 pins of data bus 17. The coded speech parameters at pins D0–D7 are inputted into a first-in-first-out (FIFO) buffer memory 2215, which is organized as a 16×8 parallel-in, serial-out (PISO) memory. The coded speech parameters are inputted into FIFO 2215 through FIFO buffer memory control 2210. FIFO control 2210 inputs one byte of data each time a WRITE BYTE (WBYT) signal is generated by Input-/Output logic 260. The speech data in FIFO buffer memory 2215 is serially inputted to parameter input register 205 during the speak external mode of operation and speech synthesis takes place. The speak external mode of operation is accomplished in the following manner. Speak external logic 253, which has SPKEXT as its input, generates a DECODE DISABLE (DDIS) signal which disables command decoder 211, thereby ensuring that the data on pins D0–D7 will be treated as speech data, rather than instruction data. Speak external logic 253 also generates a SPEAK EXTERNAL EDGE (SPKEE) signal which purges FIFO buffer memory 2215 by causing FIFO counter 2220 to initialize and to generate a clear (CLR) signal to FIFO control 2210. FIFO buffer memory 2215 also has associated with it FIFO status logic 2230, which generates two signals. The BUFFER LOW (BL) signal is generated whenever the FIFO buffer memory 2215 is half full. This signal is utilized to notify the Central Processing Unit 19 that the synthesizer may require servicing. FIFO status logic 2230 also generates a BUFFER EMPTY (BE) signal which indicates that the FIFO buffer memory 2215 is empty. The BE signal is used to reset talk latch 216, through gate 232*b*. The DDIS signal is also utilized by I0 logic 2240 to generate a serial shift enable (SSE) signal which allows (FIFO) control 2210 to serially shift speech data out of FIFO buffer memory 2215 and through load speech logic 2250 and into parameter input register 205. Also associated with ROM/CPU interface logic 21 are Input/Output logic 260 and Interrupt logic 2260. Input/Output logic 260 generates the LOAD COMMAND ENABLE (LDCE) command which allows command register 210 to latch commands in. This is accomplished by latch 261 which is set by the power up clear (PUC) or the "Finish" signals for the various commands, and latch 262 which is set by the output of latch 261, and the Decoder Disable (DDIS), WRITE SELECT (WS) and $\overline{\text{READY}}$ signals. Therefore, the Load Command Enable signal is generated at the output of latch 263 when: 1. No command is currently being executed; 2. The command decoder 211 is not disabled; 3. A WRITE SELECT signal is present; and 4. the synthesizer 10 has just detected the WRITE SELECT signal ($\overline{\text{READY}}$ is high). Input/Output logic 260 also generates the WRITE BYTE (WBYT) signal which enables FIFO control 2210 to loan an 8 bit byte of coded speech parameters into the top level of FIFO buffer memory 2215. This is accomplished utilizing latch 264 which is set by a WRITE SELECT (WS) command when the following conditions exist: 1. command decoder 211 is disabled by a DECODE DISABLE signal (DDIS), indicating a SPEAK EXTERNAL command has been executed; 2. the C0 level of FIFO buffer memory 2215 is empty; and 3. synthesizer 10 is not still executing a previous command (the $\overline{\text{READY}}$ signal is high). The WRITE BYTE (WBYT) signal is then generated at the output of gate 265. Input/Output logic circuit 260 also generates the $\overline{\text{READY}}$ signal at the output of gate 267 in response to a READ SELECT or WRITE SELECT input signal from the Central Processing Unit 19. When the $\overline{\text{READY}}$ signal is high, the Central Processing Unit 19 is tied to the Speech Module until such time as the $\overline{\text{READY}}$ signal is reset by gate 266. Gate 266 resets the $\overline{\text{READY}}$ signal to zero whenever any of the following signals occur: 1. a WBYT signal is generated at the output of gate 265 indicating that the byte of data on data bus 17 has been read into FIFO buffer memory 2215; 2. the SR2 signal is generated by buffers 212*f–g* of data input register 212 through data register control 290, indicating that the status signals generated by a READ SELECT command have been generated; 3. the SR1 signal is generated by buffers 212*a–h* of data input register 212 through data register control 291 indicating that the 8 bit byte called for by a Read Select signal preceded by a Read Byte signal has been generated; or 4. the LDCE command generated by gate 263 is inputted to gate 266 indicating that a command has been latched into command register 210. Interrupt logic 2260 generates the Interrupt (INT) signal to advise the Central Processing Unit 19 of a change in the status of the synthesizer 10. The three status signals monitored by the Central Processing Unit 19 are BUFFER EMPTY (BE), BUFFER LOW (BL), and TALK STATUS (TALKST). The BE and BL signals are generated by FIFO status circuit 2230 and outputted via buffers 212*f* and 212*g*, respectively, of data input register 212. TALKST is generated by Talk Latch 216*a* and is outputted via buffer 212*h*. A change in the status of the synthesizer 10 which results in a BE, BL or TALKST change will be detected by gates 2261, 2262 and 2263 of Interrupt Logic 2260 and will result in an INTERRUPT SIGNAL (INT) being generated through gates 2264 and 2265. Gate 2265 is utilized to reset the INT after receipt of a SR2 signal indicating that the status contained in buffers 212*f–h* has been read by the Central Processing Unit 19 or that a RESET signal has been received.

Parameter Interpolator Logic Diagram

Figure 9A:
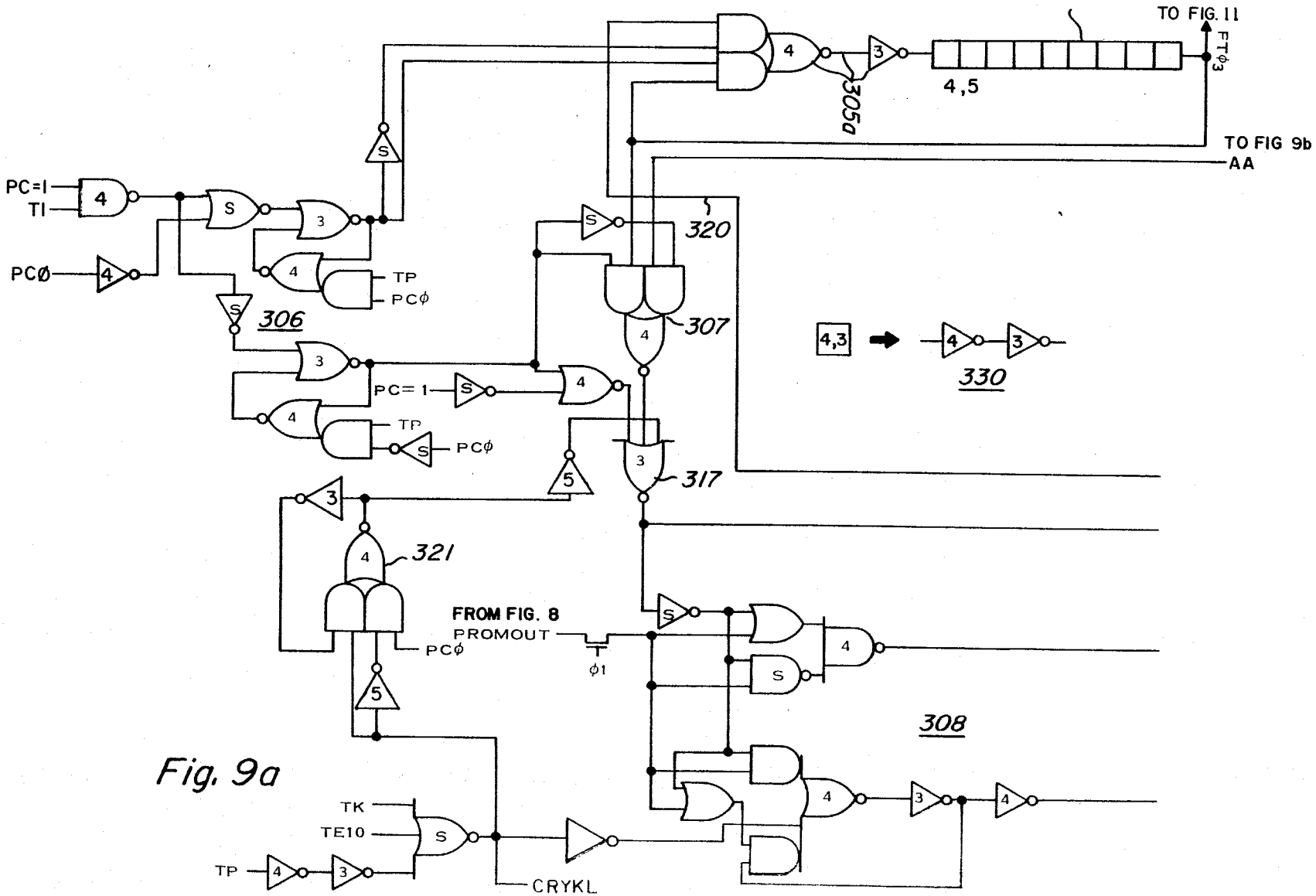
Figure 9A:
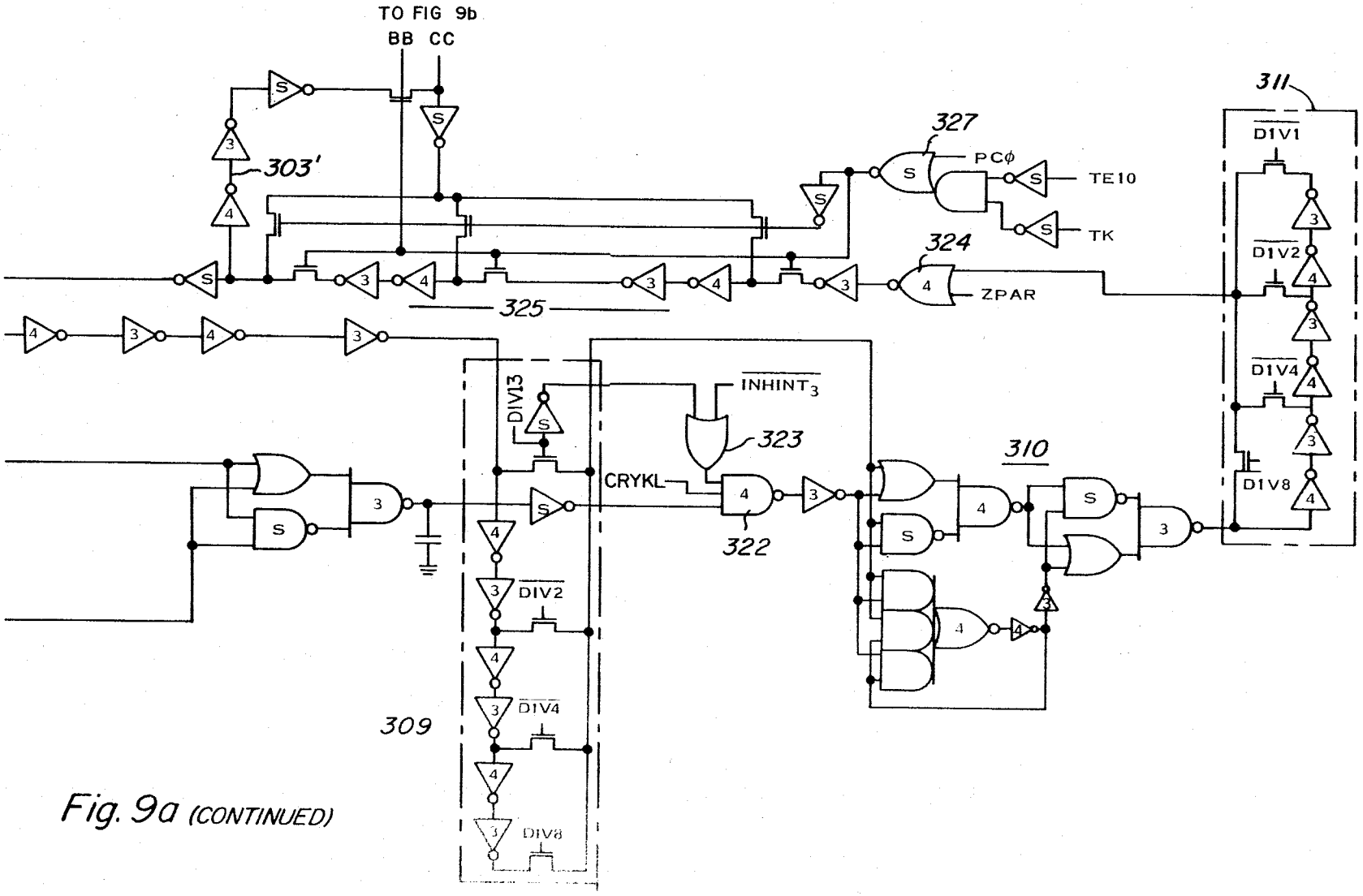
Figure 9B:
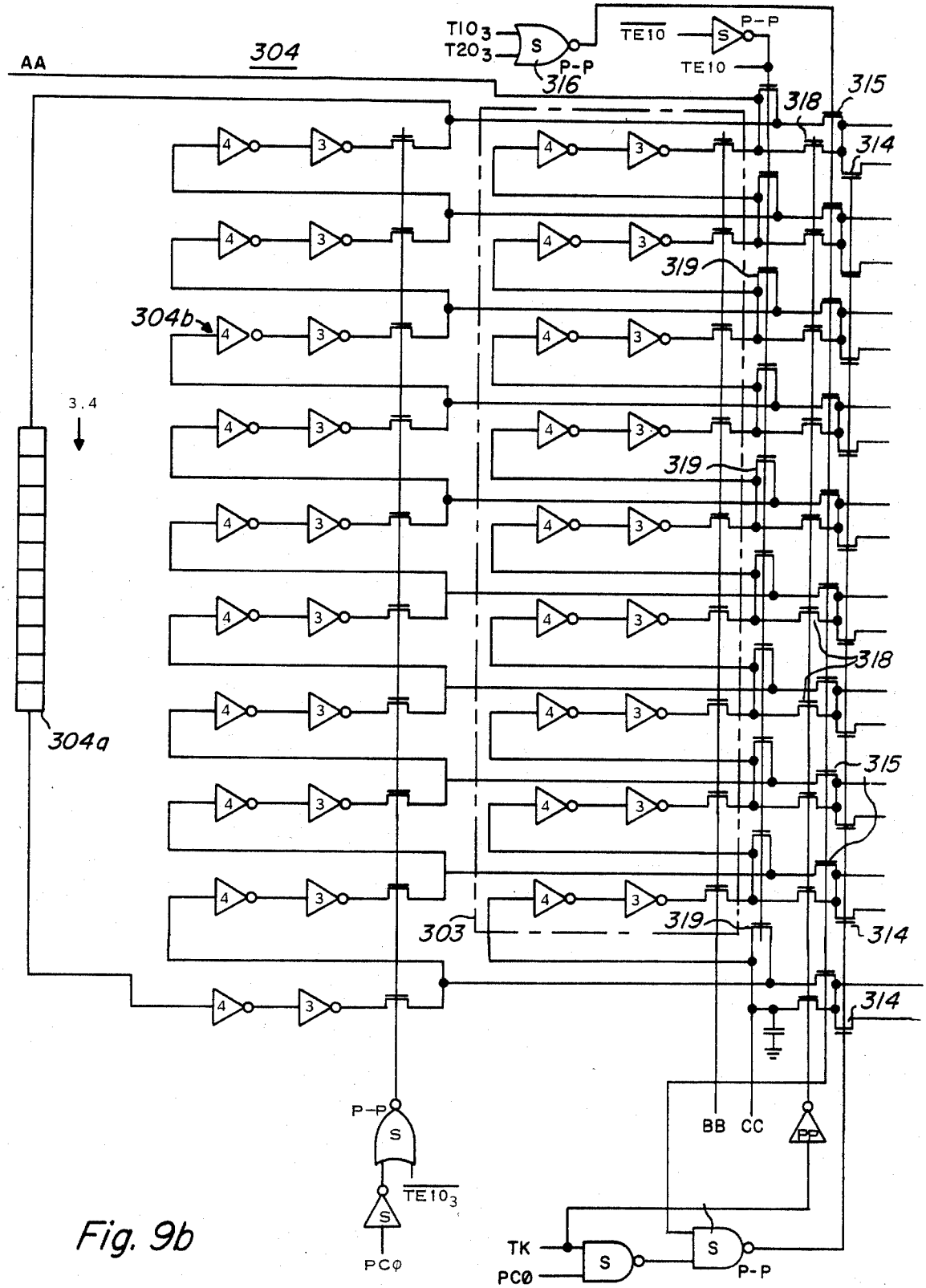
Figure 9B:
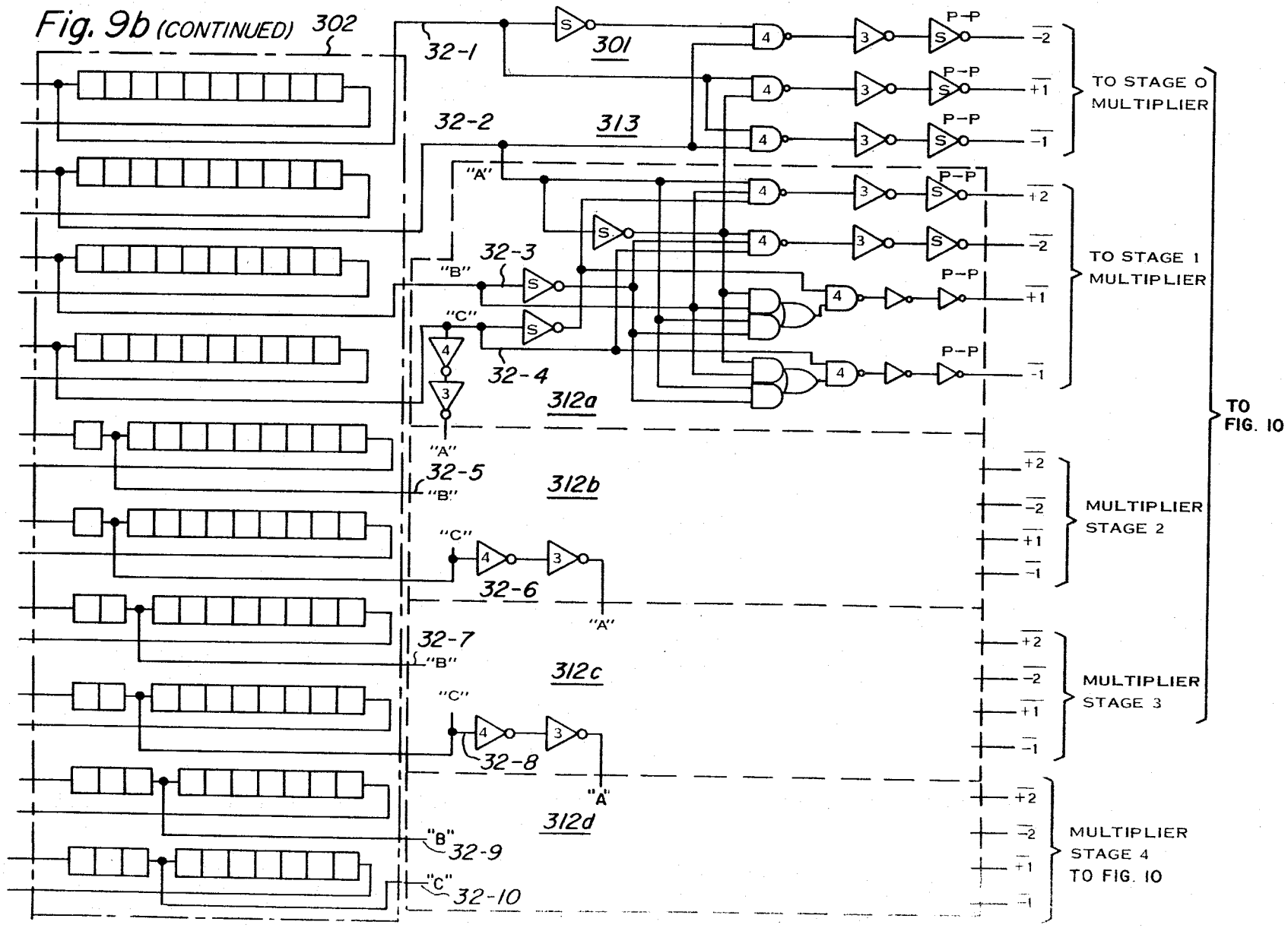

Referring now to FIGS. 9*a–*9*d*, which form a composite diagram the parameter interpolator logic 23 is shown in detail. K-stack 302 comprises ten registers each of which store ten bits of information. Each small square represents one bit of storage, according to the convention depicted at numeral 330. The contents of each shift register are arranged to recirculate via recirculation gates 314 under control of a recirculation control gate 315. K-stack 302 stores speech coefficients K1–K9 and temporarily stores coefficient K10 or the energy parameter generally in accordance with the speech synthesis apparatus of FIG. 7 of U.S. Pat. No. 4,209,844. The data outputted from K-stack 302 to recoding logic 301 at various time periods is shown in Table II. In Table III of U.S. Pat. No. 4,209,844 is shown the data outputted from the K-stack of FIG. 7 thereof. Table II of this patent application differs from Table III of the aforementioned U.S. patent because: (1) recoding logic 301 receives the same coefficient on lines 32-1 through 32-4, on lines 32-5 and 32-6, on lines 32-7 and 32-8 and on lines 32-9 and 32-10 because, as will be seen, recoding logic 301 responds to two bits of information for each bit which was responded to by the array multiplier of the aforementioned U.S. Pat. No. 4,209,844; (2) because of the difference in time period nomenclature as was previously explained with reference to FIG. 5; and (3) because of the time delay associated with the recoding logic 301.

Figure 10A:
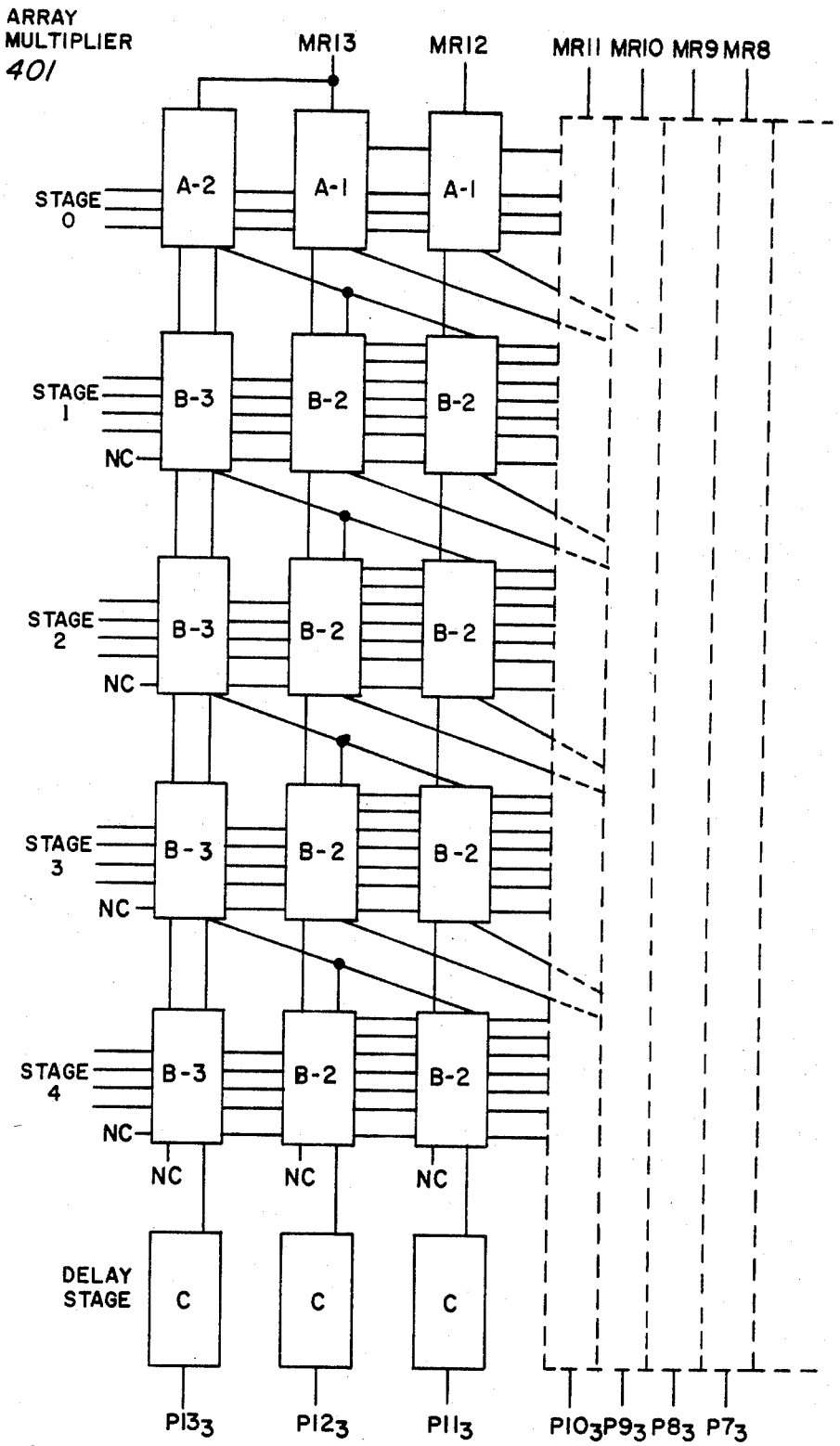
Figure 10A:
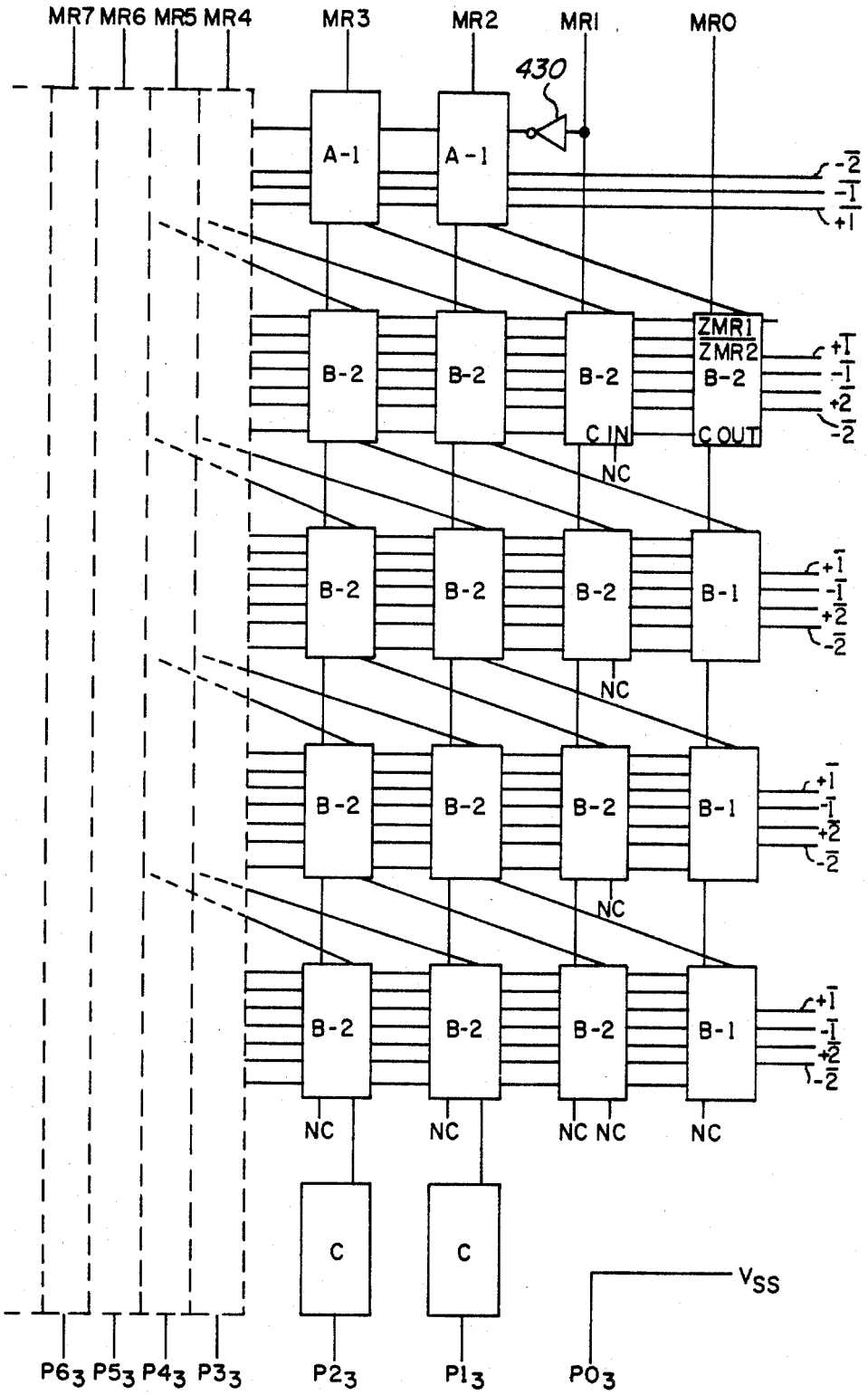

Recoding logic 301 couples K-stack 302 to array multiplier 401 (FIGS. 10*a–*10*c*). Recoding logic 301 includes four identical recoding stages 312*a–*312*d*, only one of which, 312*a*, is shown in detail. The first stages of the recoding logic 313 differ from stages 312*a–*312*d*basically because there is, of course , no carry, such as occurs on input A in stages 312*a–*312*d*, from a lower order stage. Recoding logic outputs +2, −2, +1 and −1 to each stage of a five stage array multiplier 401, except for stage zero which receives only −2, +1 and −1 outputs. Effectively recoding logic 301 permits array multiplier to process, in each stage thereof, two bits in lieu of one bit of information, using Booth's algorithm. Booth's algorithm is explained in "Theory and Application of Digital Signal Processing", published by Prentice-Hall 1975, at pp. 517–18.

The K10 coefficient and energy are stored in E10 loop 304. E10 loop 304 preferably comprises a twenty stage serial shift register; ten stages 304*a* of E10 loop 304 are preferably coupled in series and another ten stages 304*b* are also coupled in series but also have parallel outputs and inputs to K-stack 302. The appropriate parameter, either energy or the K10 coefficient, is transferred from E10 loop 304 to K-stack 302 via gates 315 which are responsive to a NOR gate 316 for transferring the energy parameter from E10 loop 304 to K-stack 302 at time period T10 and transferring coefficient K10 from E10 loop 304 to K-stack 302 at time period T20. NOR gate 316 also controls recirculation control gate 315 for inhibiting recirculation in K-stack 302 when data is being transferred.

KE10 transfer register 303 facilitates the transferring of energy or the K1–K10 speech coefficients which are stored in E10 loop 304 or K-stack 302 to subtractor 308 and delay circuit 309 via selector 307. Register 303 has nine stages provided by paired inverters and a tenth stage being effectively provided by selector 307 and gate 317 for facilitating the transfer of ten bits of information either from E10 loop 304 or K-stack 302. Data is transferred from K-stack 302 to register 303 via transfer gates 318 which are controlled by a TRANSFER K (TK) signal generated by decoder portion 511*b* of timing PLA 511 (FIGS. 7*a*–7*d*). Since the particular parameter to be interpolated and thus shifted into register 303 depends upon the particular parameter count in which the synthesizer is operating and since the particular parameter available to be outputted from K-stack 302 is a function of the particular time period the synthesizer is operating in, the TK signal comes up at T9 for the pitch parameter, T8 for the K1 parameter, T7 for the K2 parameter and so forth, as is shown in FIGS. 7*a*–7*d*. The energy parameter or the K10 coefficient is clocked out of E10 loop 304 into register 303 via gates 319 in response to a TE10 signal generated by a timing PLA 511. After each interpolation, that is during the B cycle, data is transferred from register 303 into (1) K-stack 302 via gates 318 under control of signal TK, at which time recirculation gates 314 are turned off by gate 315, or (2) E10 loop 304 via gates 319.

A ten bit pitch parameter is stored in a pitch register 305 which includes a nine stage shift register as well as recirculation elements 305*a* which provide another bit of storage. The pitch parameter normally recirculates in register 305 via gate 305*a* except when a newly interpolated pitch parameter is being provided on line 320, as controlled by pitch interpolation control logics 306. The output of pitch register 305 (PTO) or the output from register 303 is applied by selector 307 to gate 317. Selector 307 is also controlled by logics 306 for normally coupling the output of register 303 to gate 317 except when the pitch is to be interpolated. Logics 306 are responsive for outputting pitch to subtractor 308 and delay circuit 309 during the A cycle of PC=1 and for returning the interpolated pitch value on line 320 on the B cycle of PC=1to pitch register 305. Gate 317 is responsive to a latch 321 only for providing pitch, energy or coefficient information to subtractor 308 and delay circuit 309 during the interpolation. Since the data is serially clocked, the information may be started to be clocked during an A portion and PCO may switch to a logical one sometime during the transferring of the information from register 303 or 305 to subtractor 308 or delay circuit 309, and therefore, gate 317 is controlled by an A cycle latch 321, which latch is set with PCO at the time a TRANSFER (TK) transfer E10 (TE10) or transfer pitch (TP) signal is generated by timing PLA 511.

Figure 7A:
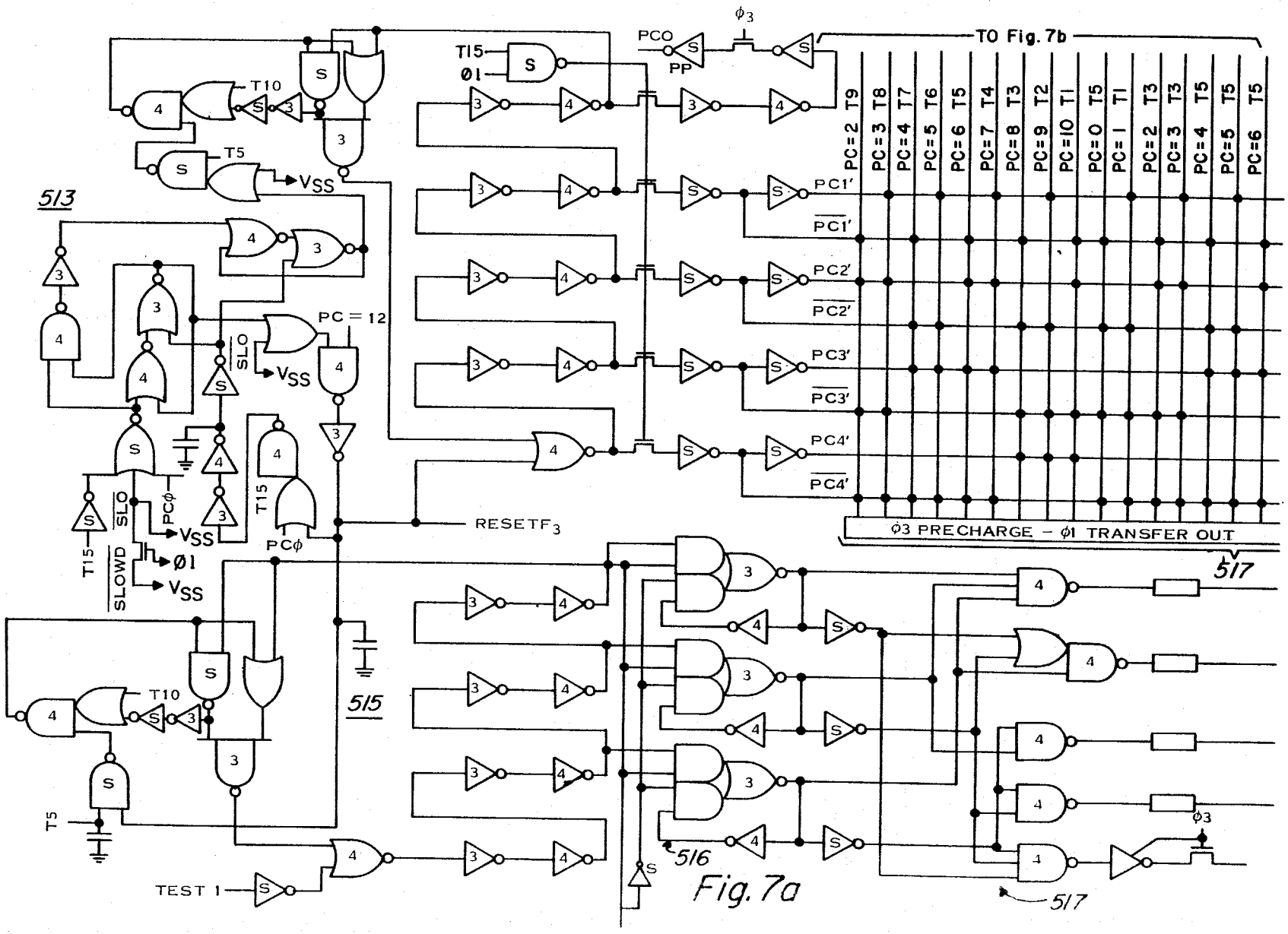
Figure 7A:
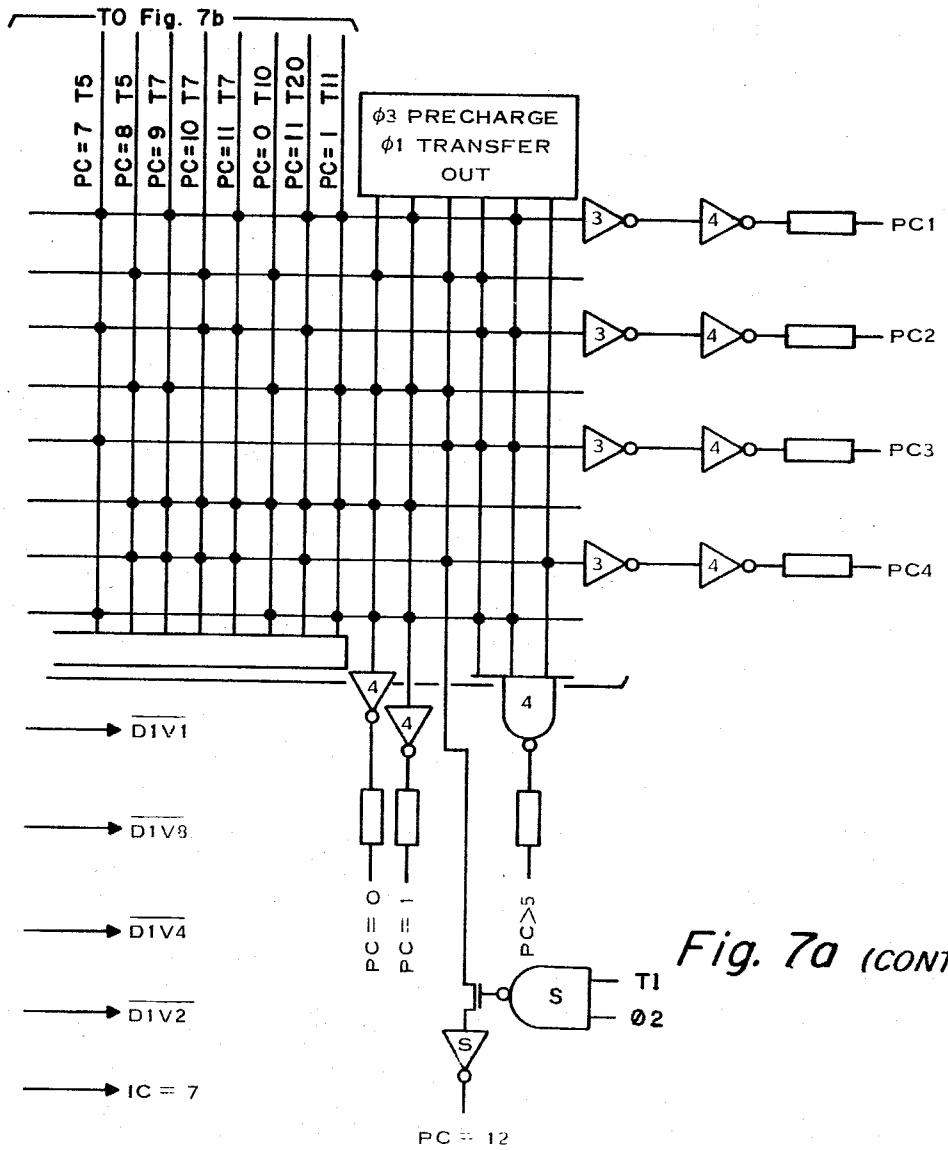
Figure 7B:
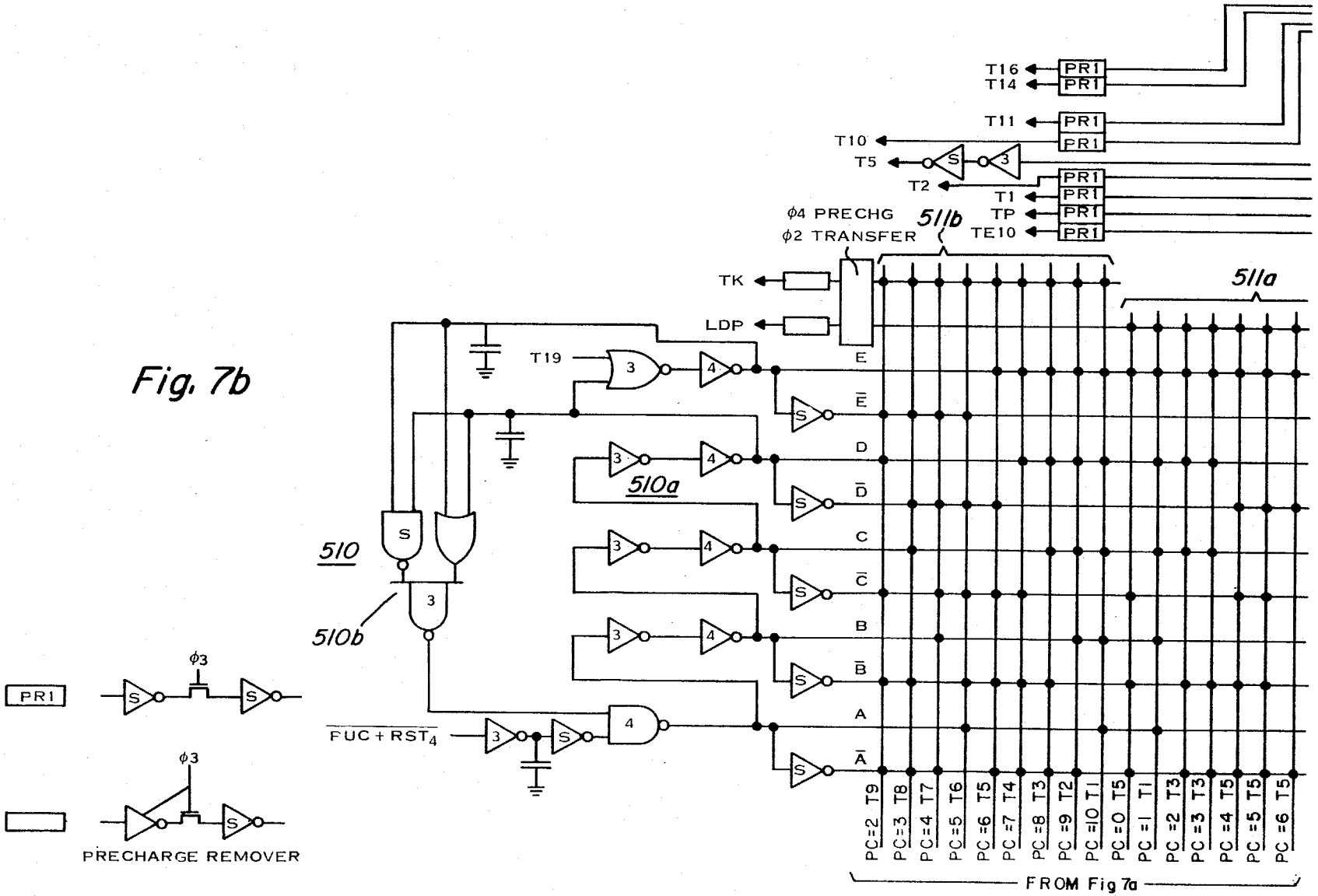
Figure 7B:
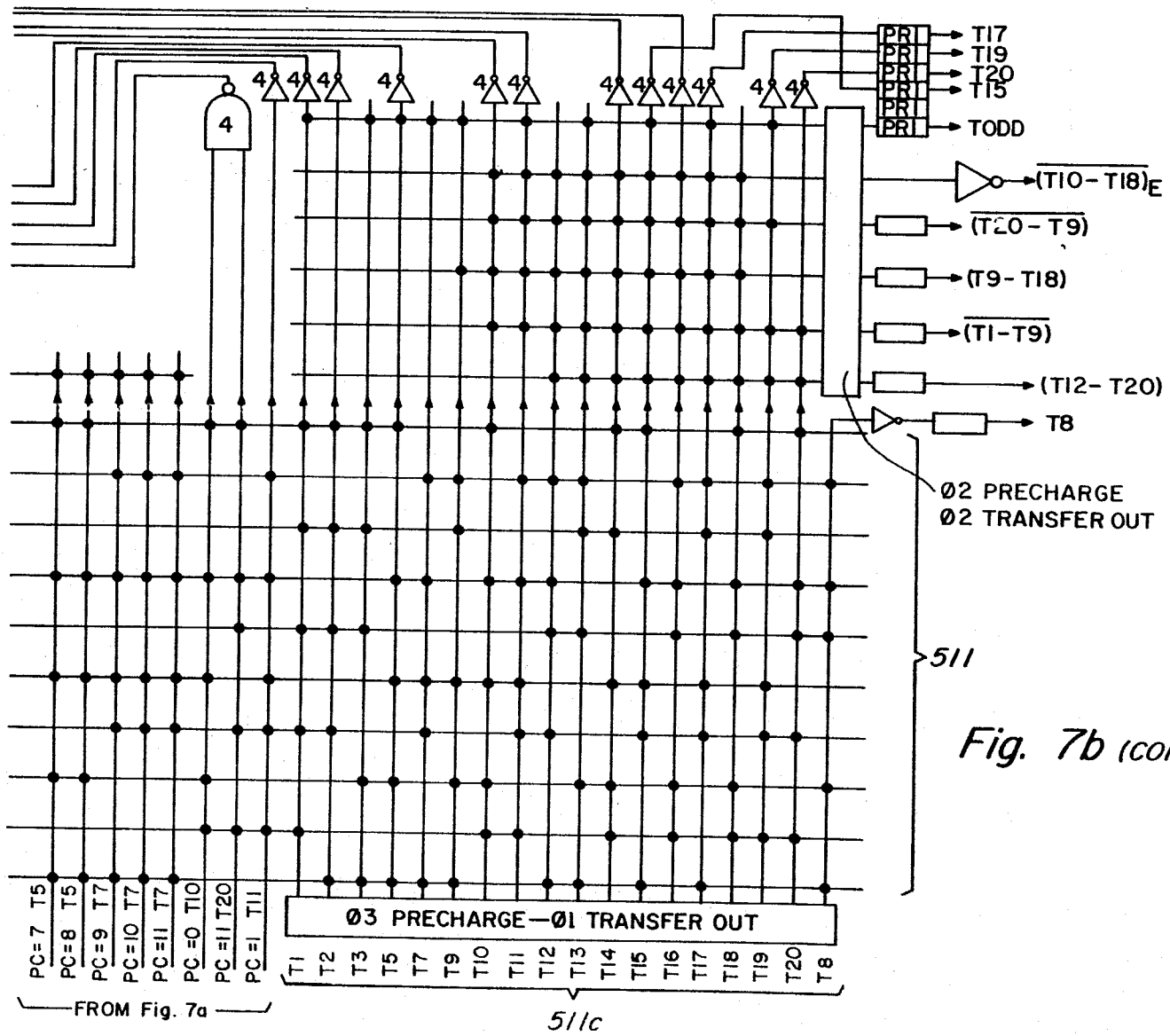
Figure 8A:
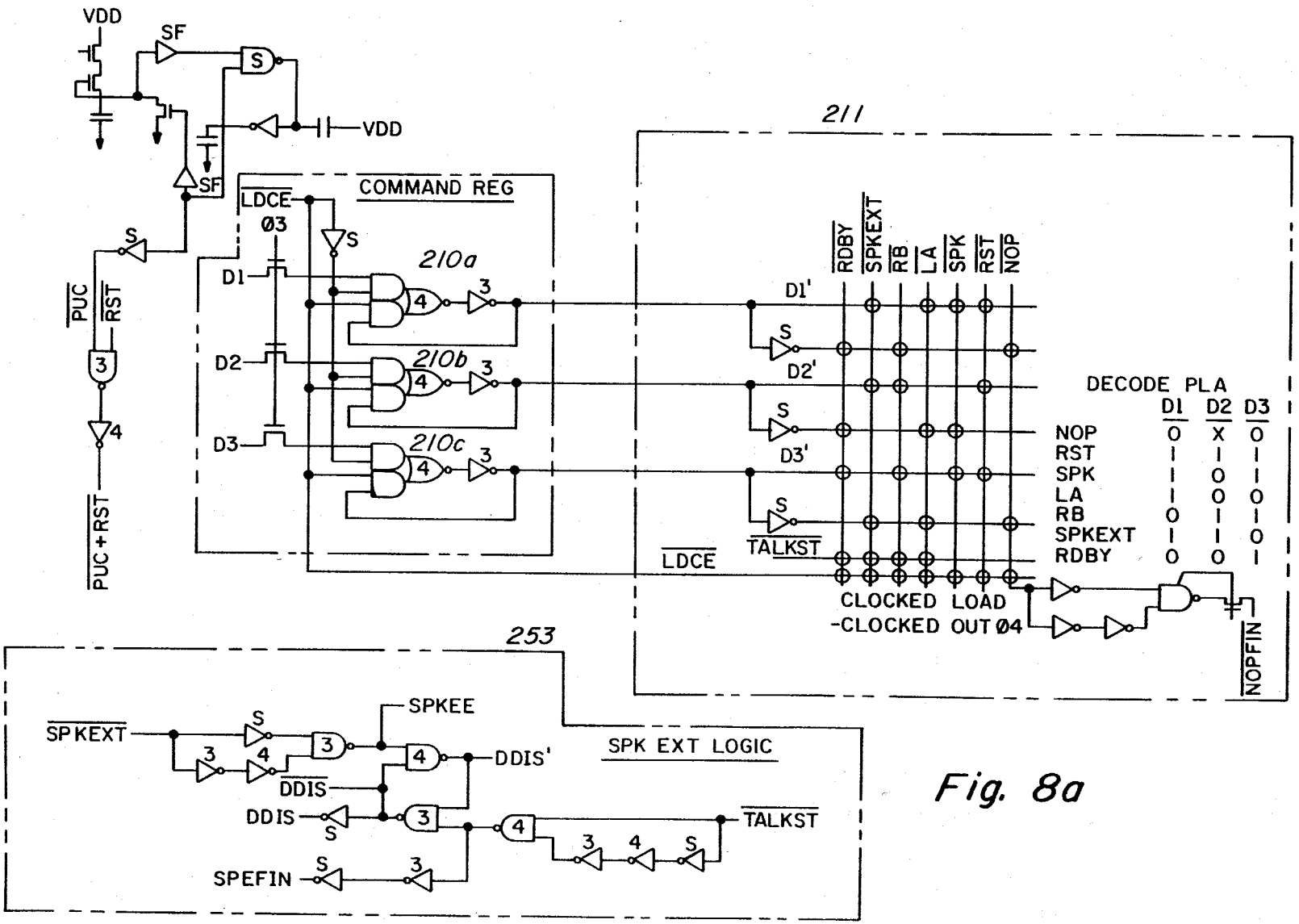
Figure 8B:
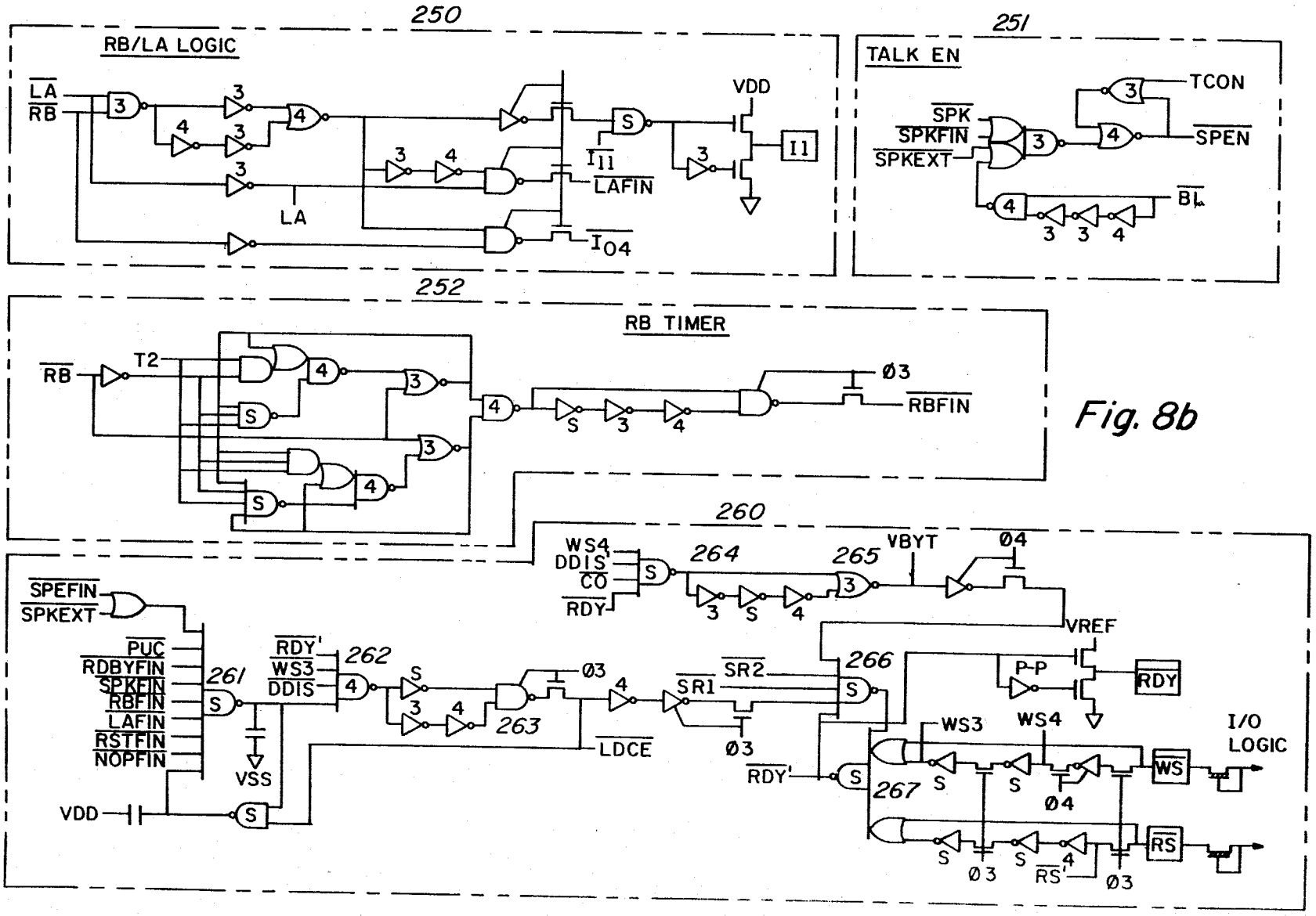
Figure 8C:
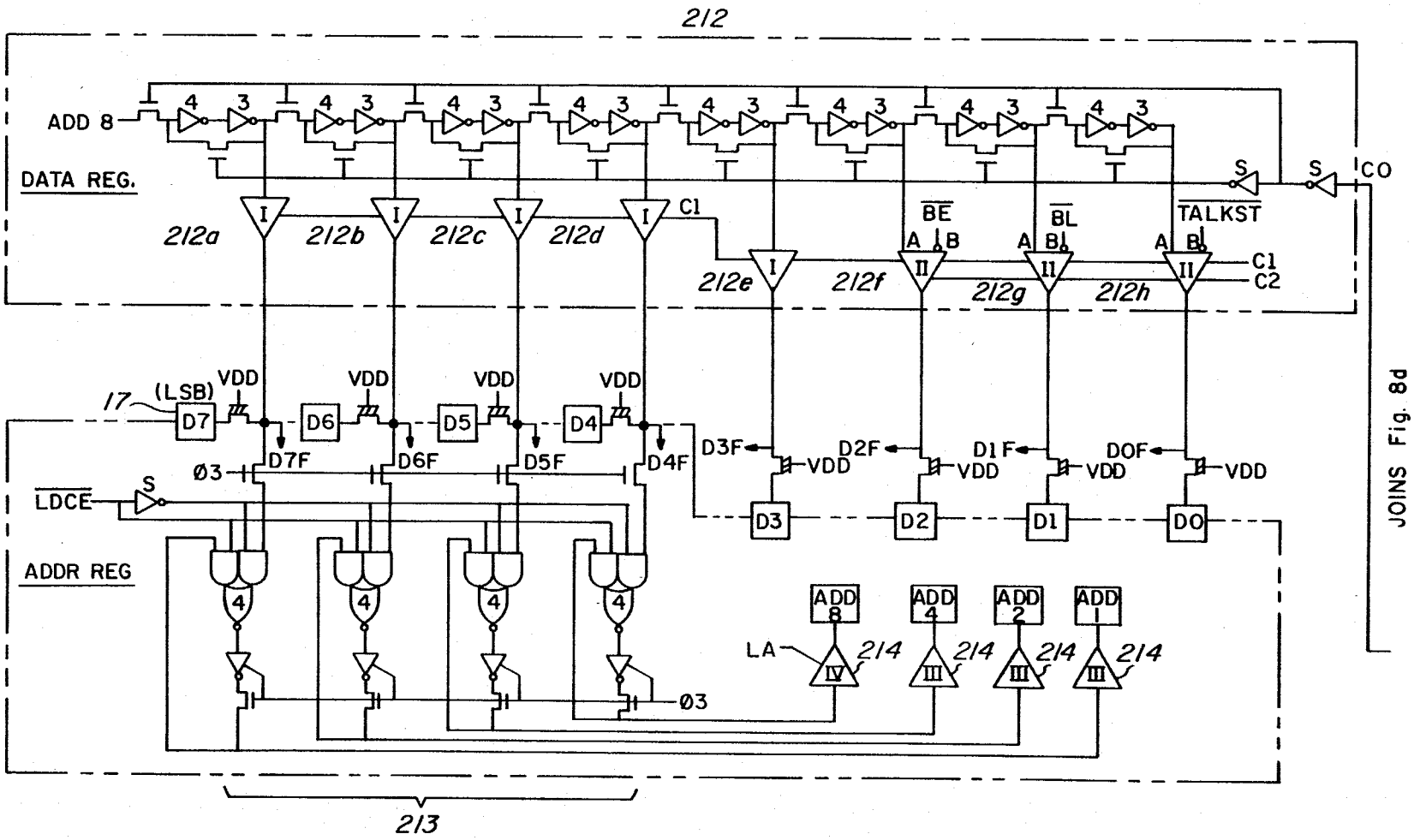
Figure 8D:
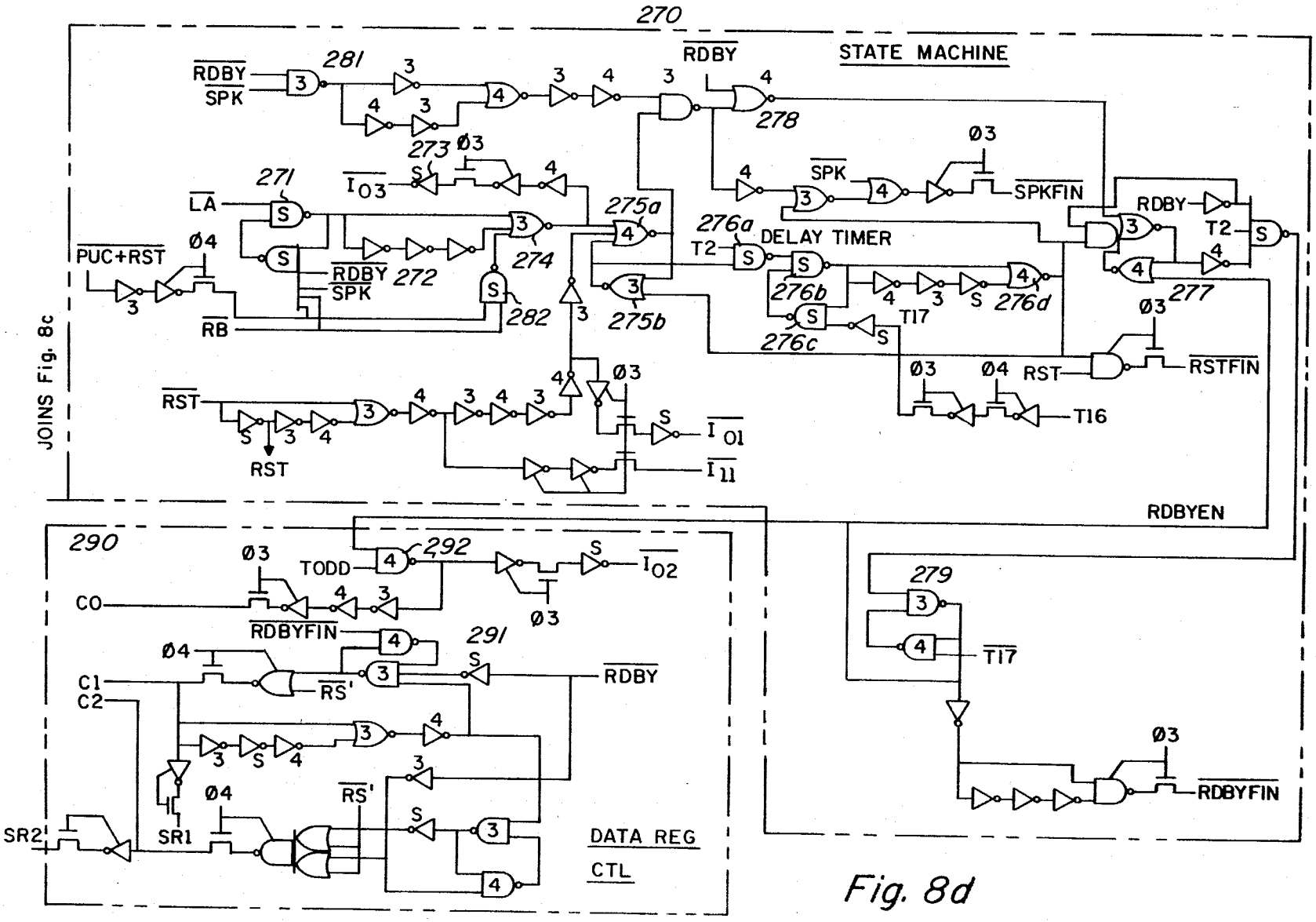
Figure 8E:
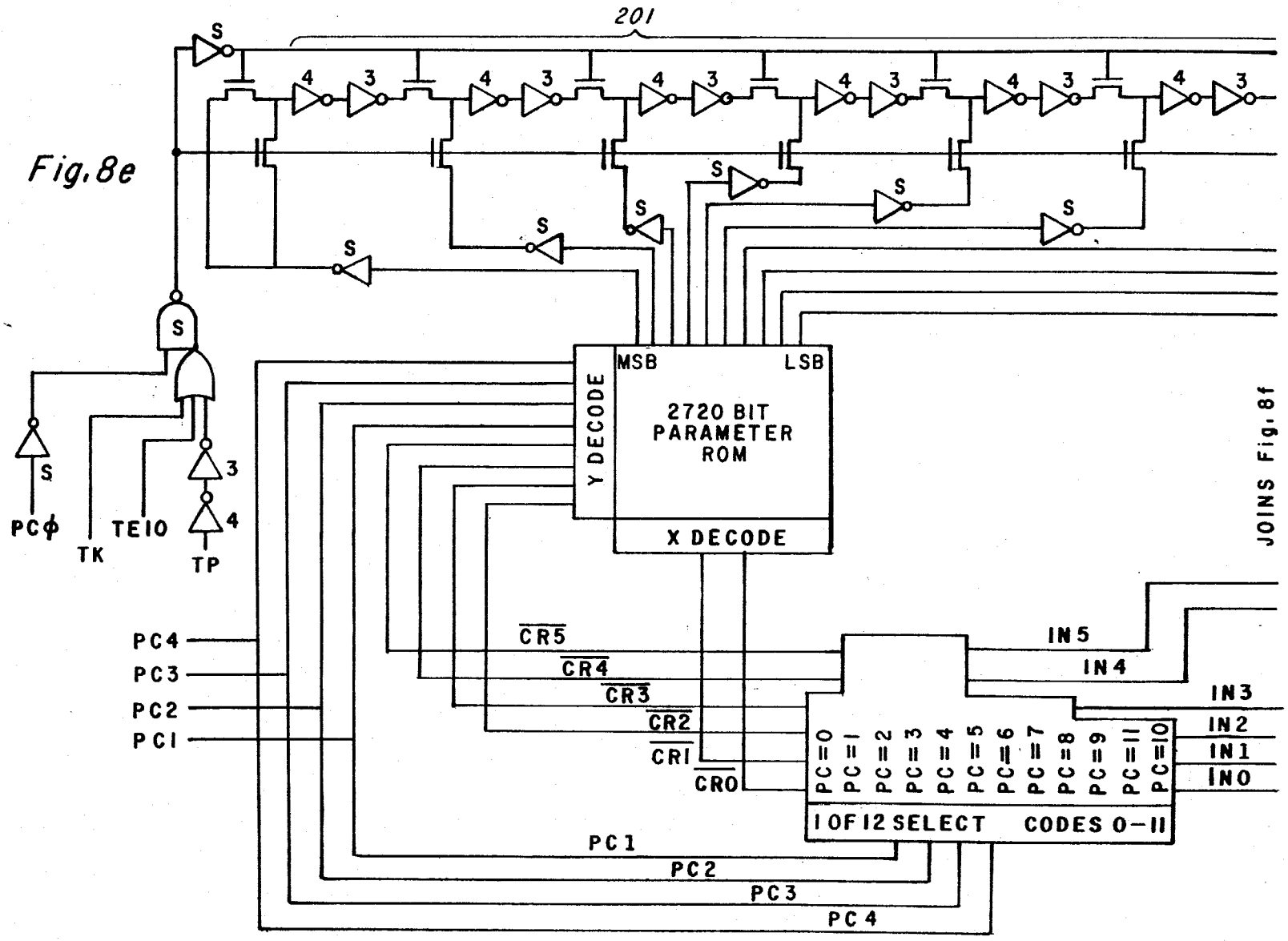
Figure 8F:
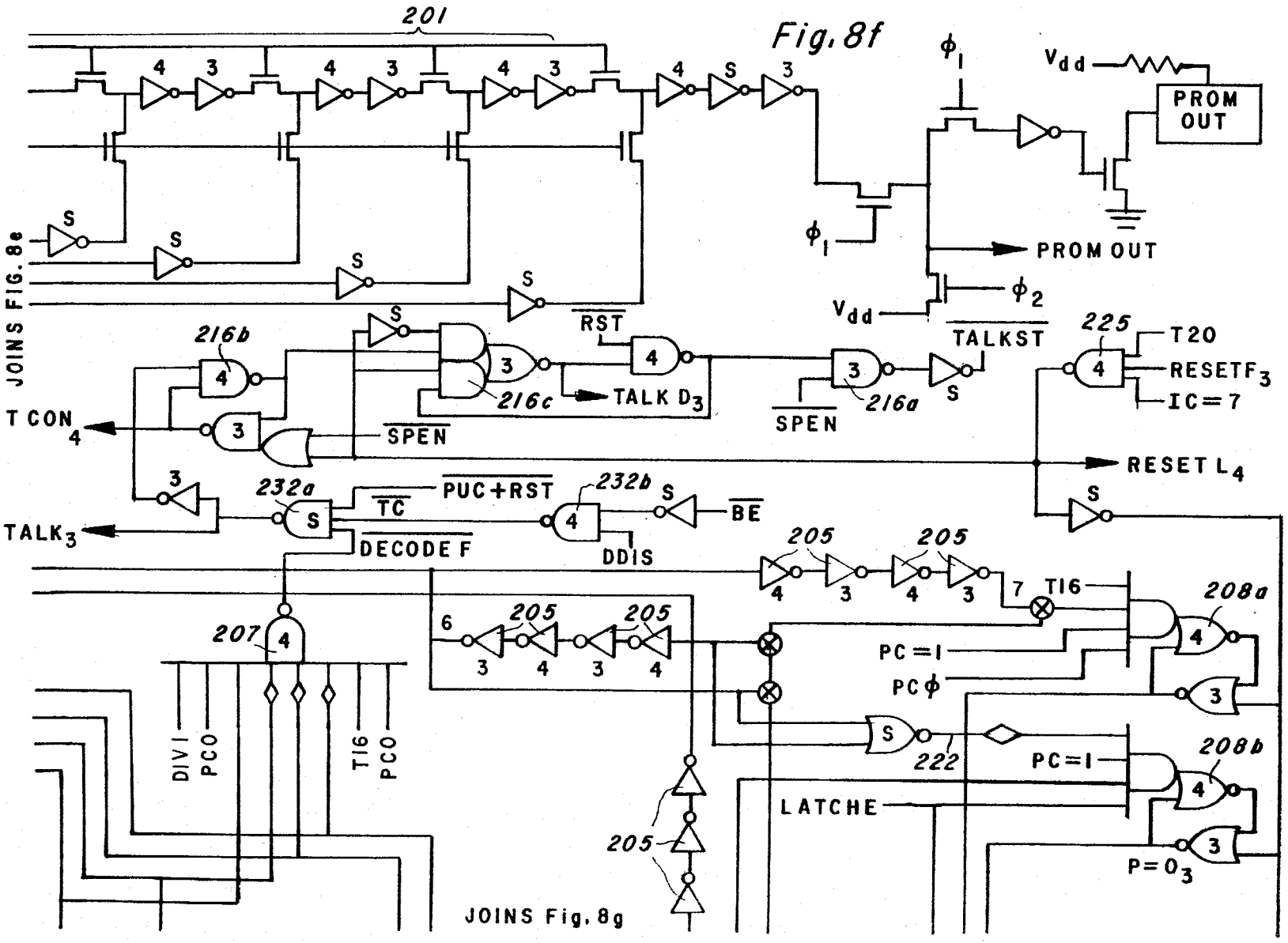
Figure 8G:
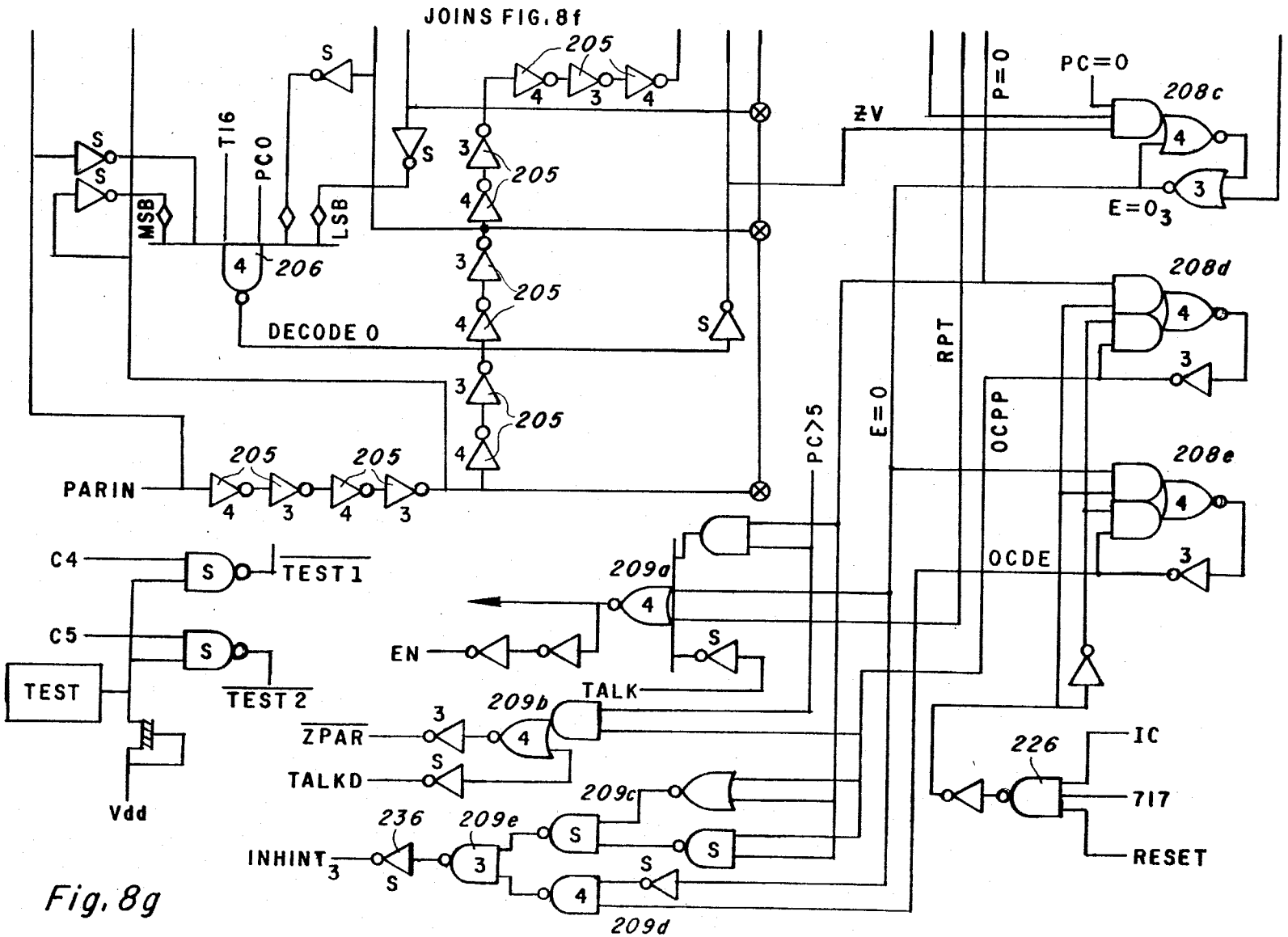
Figure 8H:
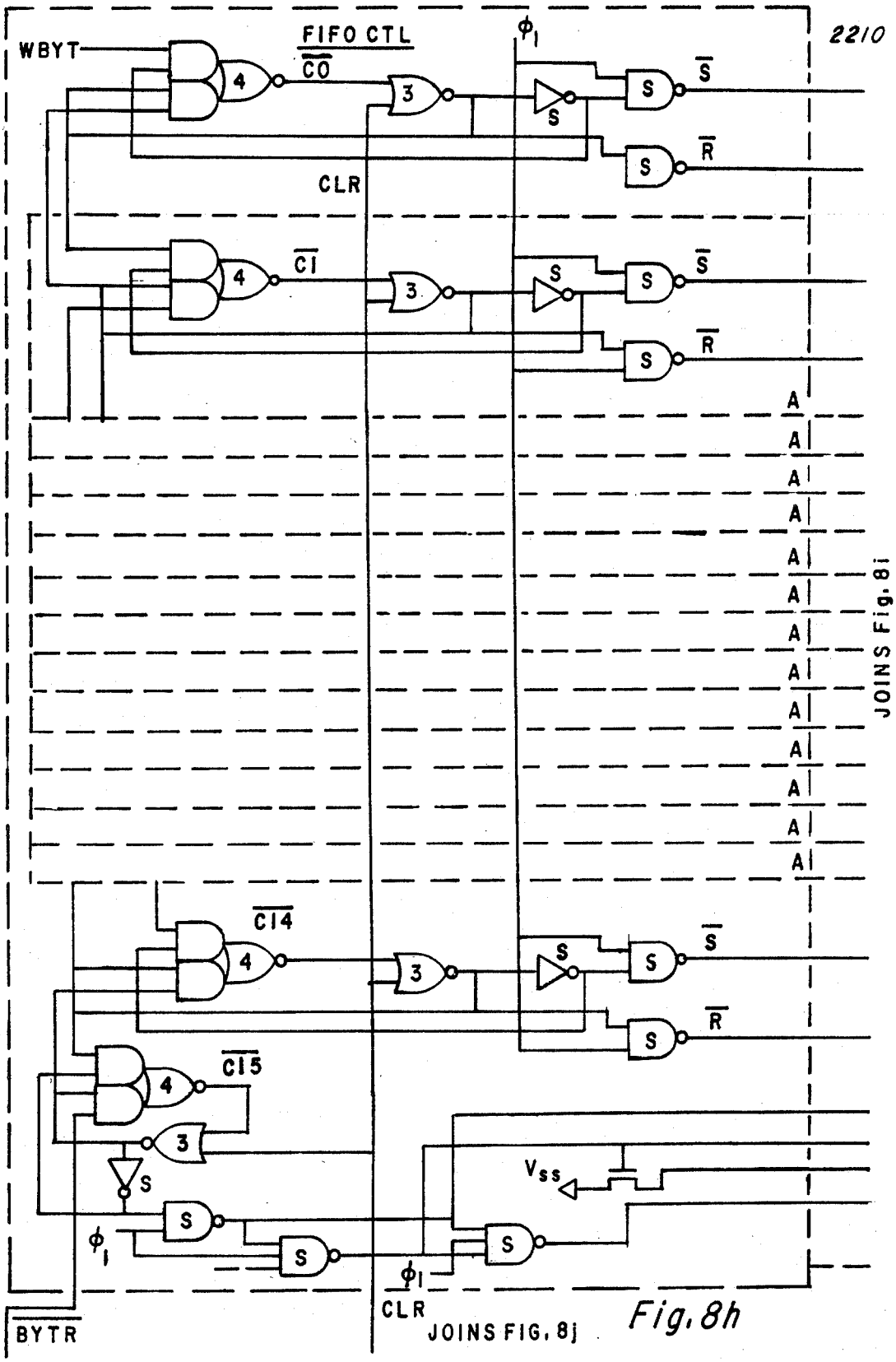
Figure 8I:
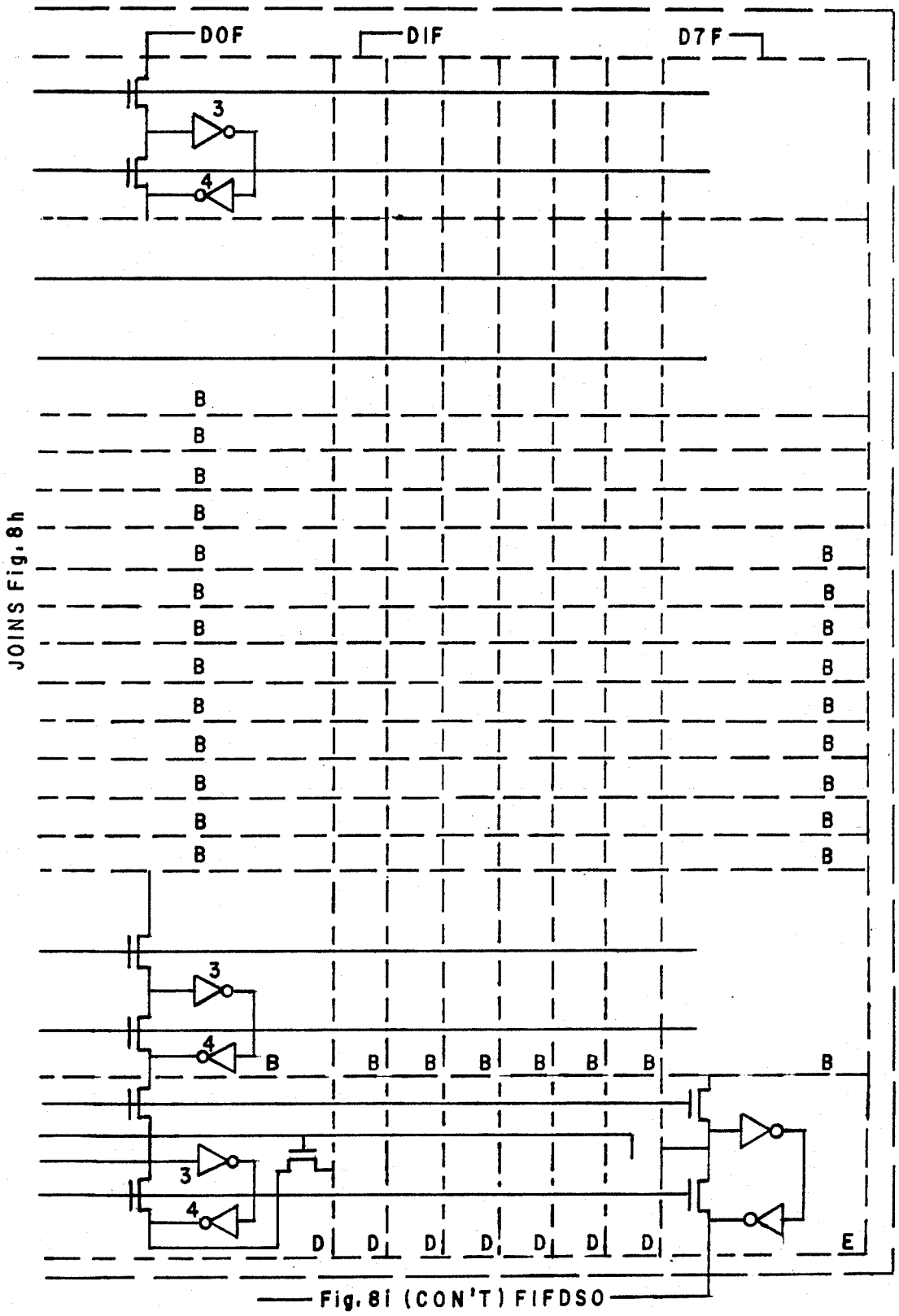
Figure 8K:
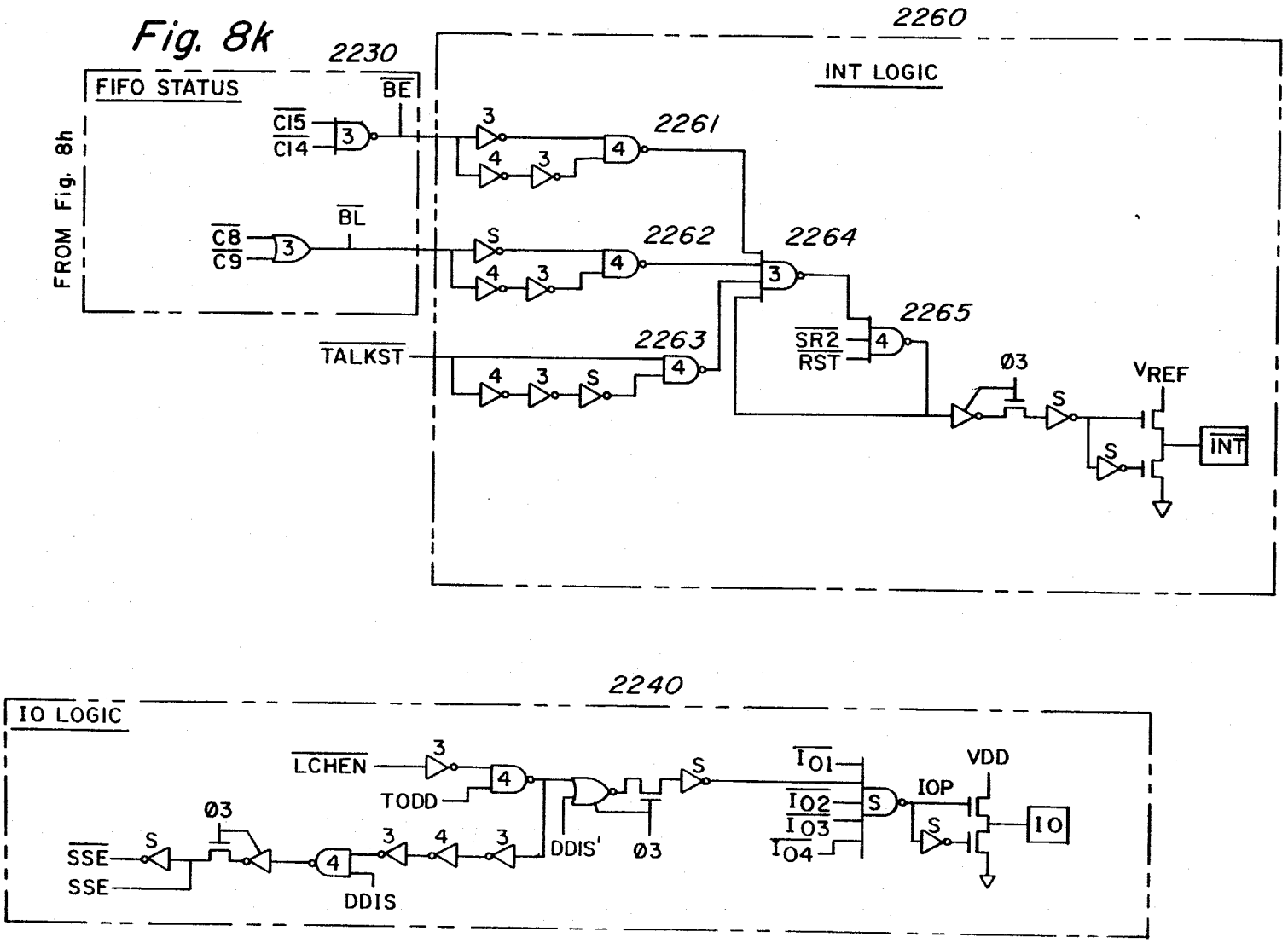
Figure 8L:
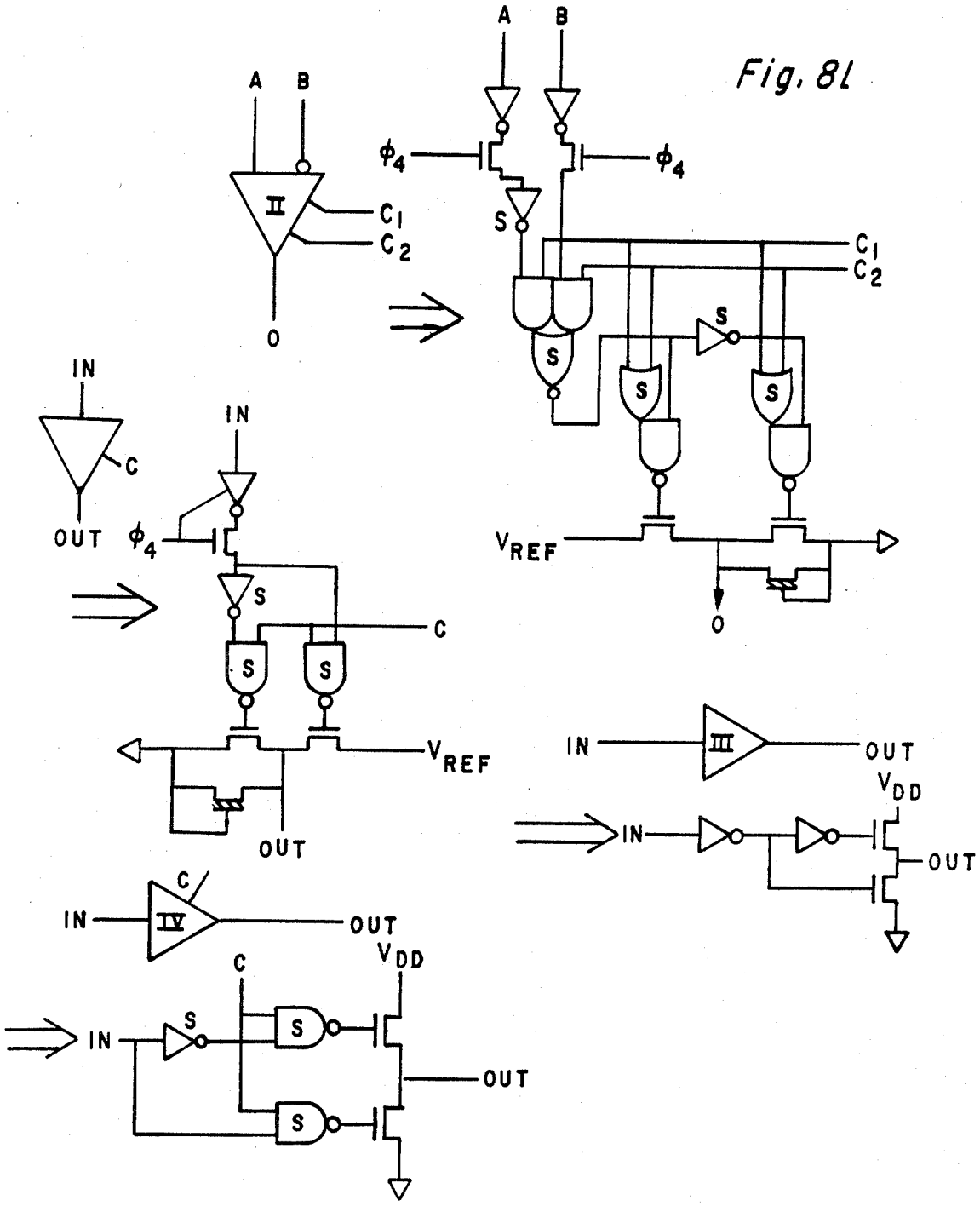

The output of gate 317 is applied to subtractor 308 and delay circuit 309. The delay in delay circuit 309 depends on the state of DIV1–DIV8 signals generated by interpolation counter 515 (FIG. 7*a*). Since the data exits gate 317 with the least significant bit first, by delaying the data in delay circuit 309 a selective amount, and applying the output to adder 310 along with the output of subtractor 308, the more delay there is in delay circuit 309. the smaller the effective magnitude of the difference from subtractor 308 which is subsequently added back in by adder 310. Delay circuit 311 couples adder 310 back into registers 303 and 305. Both delay circuits 309 and 311 can insert up to three bits of delay and when delay circuit 309 is at its maximum, delay circuit 311 is at its minimum delay and vice-versa. A NAND gate 322 couples the output of subtractor 308 to the input of adder 310. Gate 322 is responsive to the output of an OR gate 323 which is in turn responsive to $\overline{\text{INHIBIT}}$ from inverter 236 (FIGS. 8*g* and 9*b*. Gates 322 and 323 act to zero the output from subtractor 308 when the INHIBIT signal comes up unless the interpolation counter is at ICO in which case the present values in K-stack 302, E10 loop 304 and pitch register 305 ar fully interpolated to their new target values in a one step interpolation. When a unvoiced frame (FIG. 6) is supplied to the speech synthesis chip, coefficients K5–10 are set to zero by the action of gate 324 which couples delay circuit 311 to shift register 325 whose output is then coupled to gates 305*a* and 303'. Gate 324 is responsive to the zero parameter (ZPAR) signal generated by gate 209*b*(FIG. 8*g*).

Gate 326 disables shifting in the 304*b* portion of E10 loop 304 when an newly interpolated value of energy or K10 is being inputted into portion 304*b* from register 303. Gate 327 controls the transfer gates coupling the stages of register 303, which stages are inhibited from serially shifting data therebetween when TK or TE10 goes high during the A cycle, that is, when register 303 is to be receiving data from either K-stack 302 or E10 loop 304 as controlled by transfer gate 318 or 319, respectively. The output of gates 327 is also connected to various stages of shift register 325 and to a gate coupling 303' with register 303, whereby up to the three bits which may trail the ten most significant bits after an interpolation operation may be zeroed.

Array Multiplier Logic Diagram

Figure 10B:
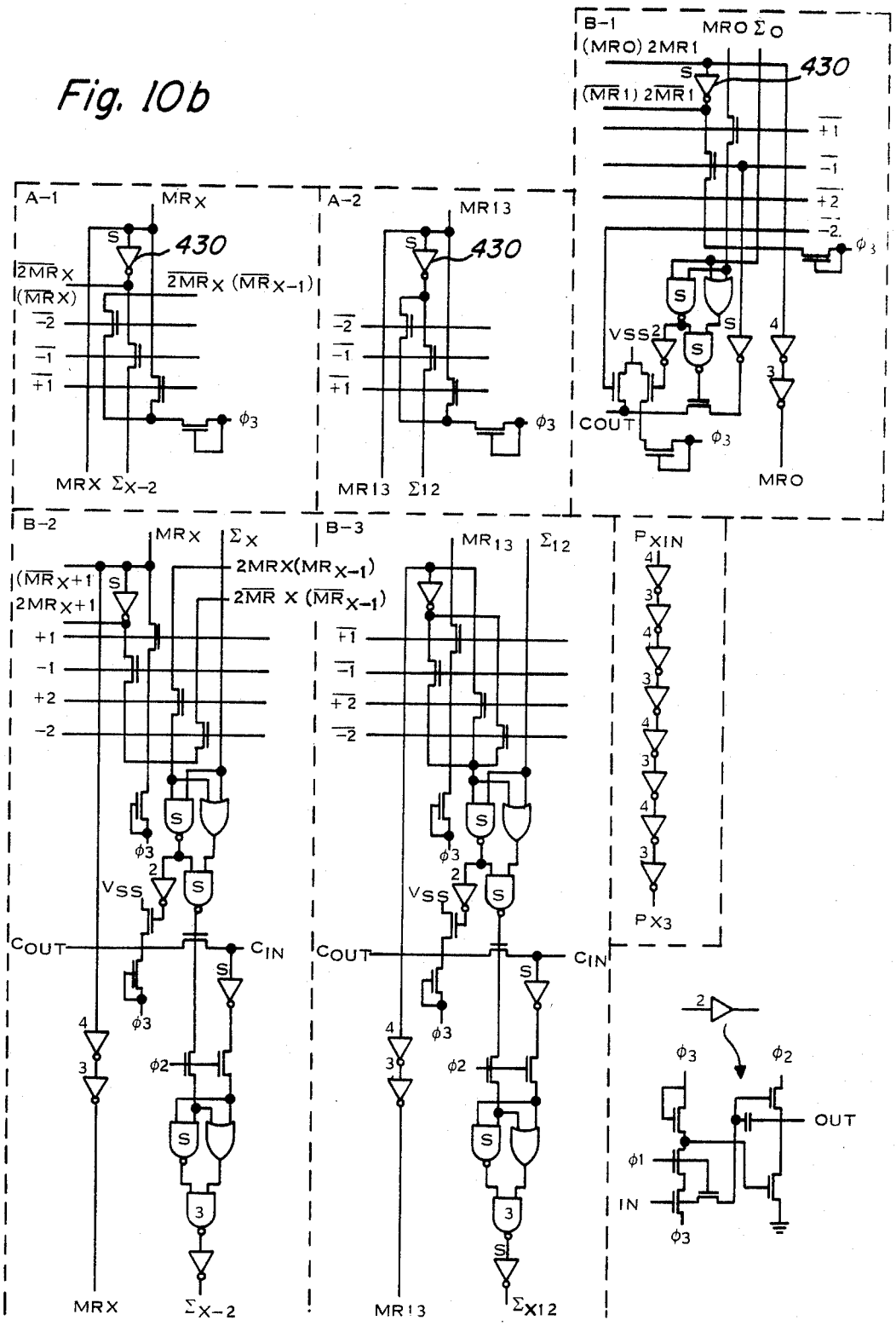

FIGS. 10*a*–10*c* form a composite logic diagram of array multiplier 401. Array multipliers are sometimes referred to as Pipeline Multipliers. For example, see "Pipeline Multiplier" by Granville E. Ott, published by the University of Missouri.

Array multiplier 401 has five stages, stage 0 through stage 4, and a delay stage. The input to array multiplier 401 is provided by signals $MR_0$–$MR_{13}$, from multiplier multiplexer 415. $MR_{13}$ is the most significant bit while $MR_0$ is the least significant bit. Another input to array multiplier are the aforementioned +2, −2, +1 and −1 outputs from recording logic 301 (FIG. 9*d*). The output from array multiplier 401, $P_{13}$–$P_0$, is applied to summer multiplexer 402. The least significant bit thereof, $P_0$, is in this embodiment always made a logical one because doing so establishes the mean of the truncation error as zero instead of $\pm\frac{1}{2}$LSB which value would result from a simple truncation of a two's complement number.

Array multiplier 401 is shown by a plurality of box elements labeled A-a, A-2, B-1, B-2, B-3 or B-C. The specific logic elements making up these box elements are shown in FIG. 10*c* in lieu of repetitively showing these elements and making up a logic diagram of array multiplier 401, for simplicity's sake. The A-1 and A-2 block elements make up stage zero of the array multiplier and thus are each responsive to the −2, +1 and −1 signals outputted from decoder 313 and are further responsive to MR2–MR13. When multiplies occur in array multiplier 401, the most significant bit is always maintained in the leftmost column elements while the partial sums are continuously shifted toward the right. Inasmuch as each stage of array multiplier 401 operates on two binary bits, the partial sums are shifted to the right two places. Thus no A type blocks are provided for the MR0 and MR 1 data inputs to the first stage. Also, since each block in array multiplier 401 is responsive to two bits of information from K-stack 302 received via recoding logic 301, each block is also responsive to two bits from multiplier multiplexer 415, which bits are inverted by inverters 430, which bits are also supplied in true logic to the B type blocks.

Filter and Excitation Generator Logic Diagram

FIGS. 11*a* –11*d* form a composite, detailed logic diagram of filter and excitation generator 24 (other than array multiplier 401) and output section 25. In filter and excitation generator 24 is a summer 404 which is connected to receive at one input thereof, either the true or inverted output of array multiplier 401 (see FIGS. 10*a*–10*c*) on lines P0–P13 via summer multiplexer 402. The other input of adder 404 is connected via summer multiplexer 402 to receive either the output of added 404 (at T10–T18), the output of delay stack 406 on lines 440–453 (at T20–T7 and T9), the output of Y-latch 403 (at T8) or a logical zero from 03 precharge gate 420 (at T19 when no conditional discharge is applied to this input). The reason these signals are applied at these times can be seen from FIG. 8 of the aforementioned U.S. Pat. No. 4,209,844; it is to be remembered, of course, that the time period designations differ as discussed with reference to FIG. 5 hereof.

The output of adder 404 is applied to delay stack 406, multiplier multiplexer 415, one period delay gates 414 and summer multiplexer 402. Multiplier multiplexer 415 includes one period delay gates 414 which are generally equivalent to one period delay 34' of FIG. 7 in U.S. Pat. No. 4,209,844. Y-latch 403 is connected to receive the output of delay stack 406. Multiplier multiplexer 415 selectively applies the output from Y-latch 403, one period delay gates 414, or the excitation signal on bus 405 to the input MR0–MR13 of array multiplier 401. The inputs D0–D13 to delay stack 406 are derived from the outputs of adder 404. The logics for summer multiplexer 402, adder 404, Y-latch 403, multiplier multiplexer 415 and one bit period delay circuit 414 are only shown in detail for the least significant bit as enclosed by dotted line reference A. The thirteen most significant bits in the filter also are provided by logics such as those enclosed by the reference line A, which logics are denoted by long rectangular phantom line boxes labeled "A". The logics for each parallel bit being processed in the filter are not shown in detail for sake of clarity. The portions of the filter handling bits more significant than the least significant bit differ from the logic shown for elements 402, 403, 404, 415 and 414 only with respect to the interconnections made with truncation logics 425 and bus 405 which connects to UV gate 408 and chirp ROM 409. In this respect, the output from UV gate 408 and chirp ROM 409 is only applied to inputs I13–I6 and therefore the input labeled Ix within the reference A phantom line is not needed for the six least significant bits in the filter. Similarly, the output from the Y-latch 403 is only applied for the ten most signficiant bits, $YL_{13}$ through $YL_4$, and therefore the connection labeled YLx within the reference line A is not required for the four least significant bits in the filter.

Delay stack 406 comprises 14 nine bit long shift registers, each stage of which comprises inverters clocked on $\phi$4 and $\phi$3 clocks. As is discussed in U.S. Pat. No. 4,209,844, the delay stack 406 which generally corresponds to shift register 35' of FIG. 7 of the aforementioned patent, is only shifted on certain time periods. This is accomplished by logics 416 whereby $\phi$1B–$\phi$4B clocks are generated from T10–T18 timing signal from PLA 512 (FIGS. 7*a*–7*d*). The clock buffers 417 in circuit 416 are also shown in detail in FIG. 11*c*.

Delay stack 406 is nine bits long whereas shift register 35' in FIG. 7 of U.S. Pat. No. 4,209,844 was eight bits long; this difference occurs because the input to delay stack 406 is shown as being connected from the output of adder 404 as opposed to the output of one period delay circuit 414. Of course the input to delay stack 406 could be connected from the outputs of one period delay circuit 414 and the timing associated therewith modified to correspond with that shown in U.S. Pat. No. 4,209,844.

The data handled in delay stack 406, array multiplier 401, adder 404, summer multiplexer 402, Y-latch 403, and multiplier multiplexer 415 preferably handled in two's complement notation.

Unvoiced generator 407 is a random noise generator comprising a shift register 418 with a feedback term supplied by feedback logics 419 for generating pseudorandom terms in shift register 418. An output is taken therefrom and is applied to UV gate 408 which is also responsive to OLDP from latch 208*d* (FIG. 8*g*). Old pitch latch 208*d* controls gate 408 because pitch=0 latch 208*b* changes state immediately when the new speech parameters are inputted to register 205. However, since this occurs during interpolation count IC0 and since, during an unvoiced condition the new values are not interpolated into K-stack 302, E10 loop 304 and pitch register 305 until the following IC0, the speech excitation value cannot change from a periodic excitation from chirp ROM 409 to a random excitation from unvoiced generator 407 until eight interpolation cycles have occurred. Gate 420 NORS the output of gate 408 into the most significant bit of the excitation signal, $I_{13}$, thereby effectively causing the sign bit to randomly change during unvoiced speech. Gate 421 effectively forces the most significant bit of the excitation signal, $I_{12}$, to a logical one during unvoiced speech conditions. Thus the combined effect of gates 408, 420 and 421 is to cause a randomly changing sign to be associated with a steady decimal equivalent value of 0.5 to be applied to the filter in Filter and Excitation Generator 24.

During voiced speech, chirp ROM 409 provides an eight bit output on lines $I_6$–$I_{13}$ to the filter. This output comprises forty-one successively changing values which, when graphed, represent a chirp function. The contents of ROM 409 are listed in Table III; ROM 409 is set up to invert its outputs and thus the data is stored therein in complemented format. The chirp function value and the complemented value stored in the chirp ROM are expressed in two's complement hexadecimal notation. ROM 409 is addressed by an eight bit register 410 whose contents are normally updated during each cycle through the filter by add one circuit 411. The output of register 410 is compared with the contents of pitch register 305 in a magnitude comparator 413 for zeroing the contents of 410 when the contents of register 410 become equal to or greater than the contents of register 305. ROM 409, which is shown in greater detail in FIGS. 14*a*–14 *b*, is arranged so that addresses greater than 110010 cause all zeroes to be outputted on lines $I_{13}$–$I_6$ to multiplier multiplexer 415. Zeroes are also stored in address locations 41–51. Thus, the chirp may be expanded to occupy up to address location fifty, if desired.

Random Access Memory Logic Diagram

Figures 12A, 12B:
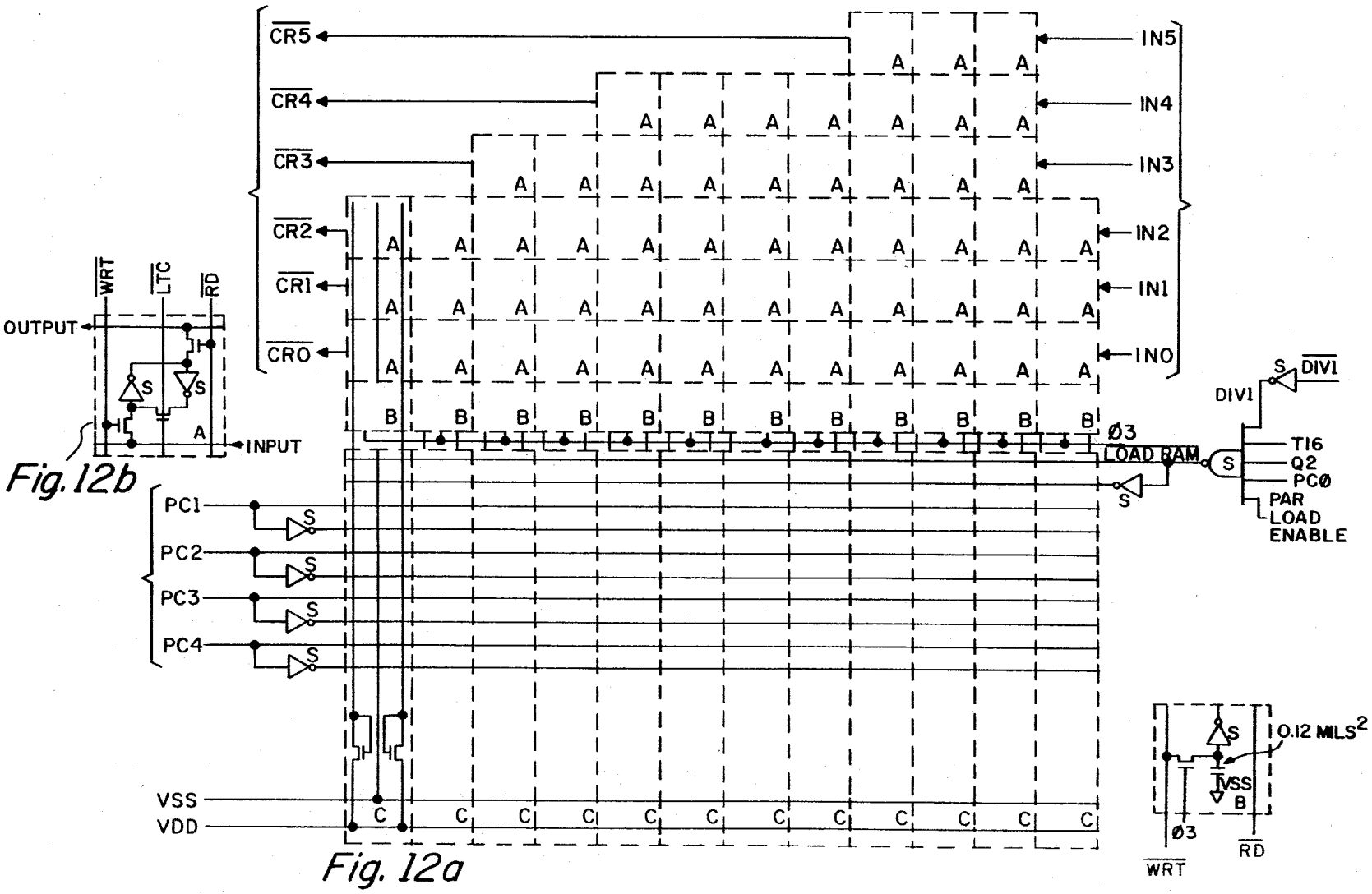
FIGS. 12*a* and 12*b* are schematic diagrams of the parameter RAM.

Referring now to FIGS. 12*a*–12*b*, there is shown a composite detailed logic diagram of RAM 203. RAM 203 is addressed by address on PC1–PC4, which address is decoded in a PLA 203*a* and defines which coded parameter is to be inputted into RAM 203. RAM 203 stores the twelve decoded parameters, the parameters having bit lengths varying between three bits and six bits according to the decoding scheme described with reference to FIG. 6. Each cell, reference B, of Ram 203 is shown in greater detail in FIG. 12*b*. Read/-Write control logic 203*b* is responsive to T1, DIV1, PC0 and Parameter Load Enable for writing into the RAM 203 during the A cycle of each parameter count during interpolation count zero when enabled by Parameter Load Enable from logics 209*a* (FIG. 8*g*). Data is inputted to RAM 203 on lines IN0–IN5 from register 205 as shown in FIGS. 8*a* and 8*b* and data is outputted on lines CR0–CR5 to ROM 202 as is shown in the aforementioned figures.

Parameter Read-Only-Memory Logic Diagram

Figure 13A:
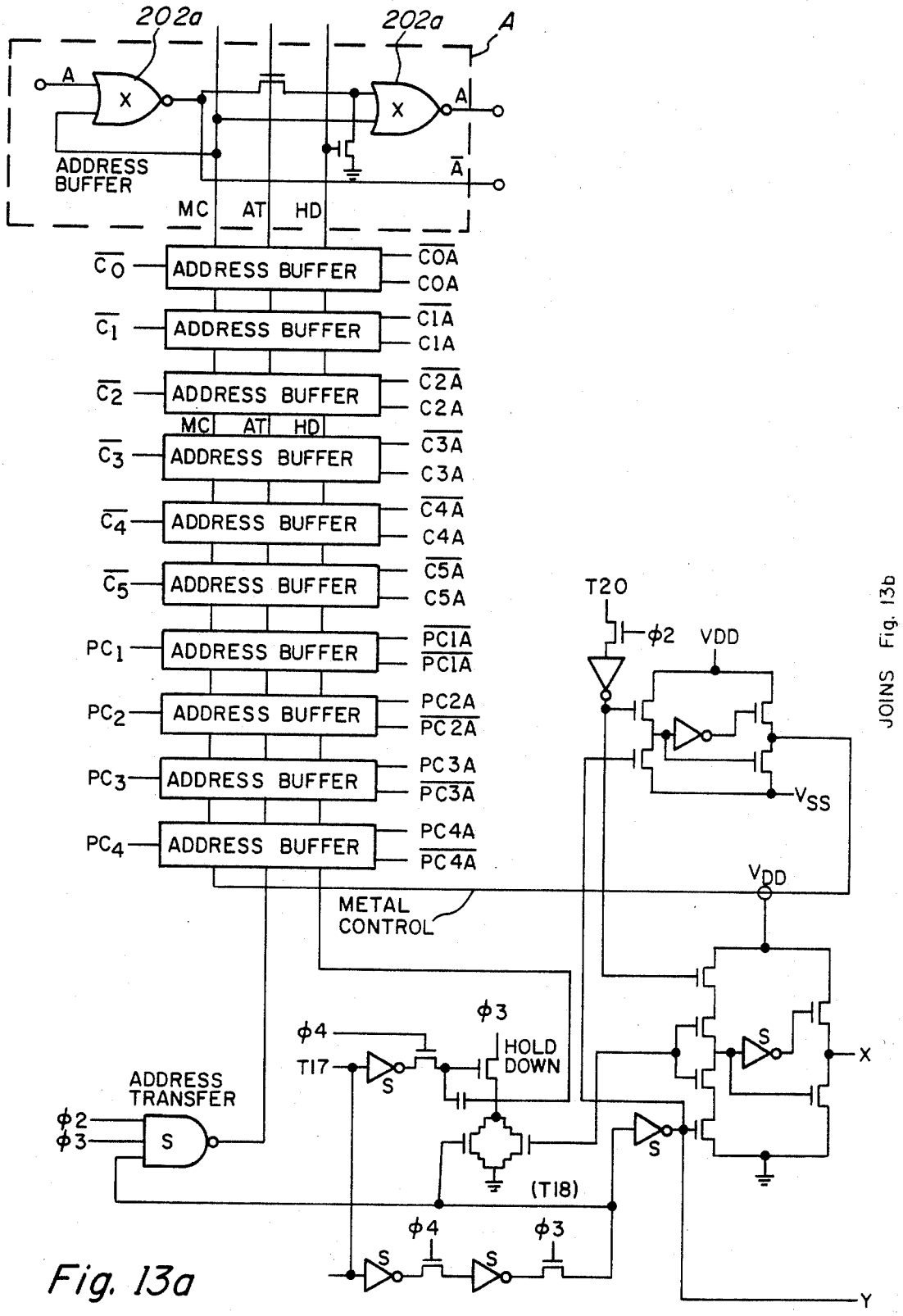
FIGS. 13*a*–13*c* are schematic diagrams of the parameter ROM.
Figure 13B:
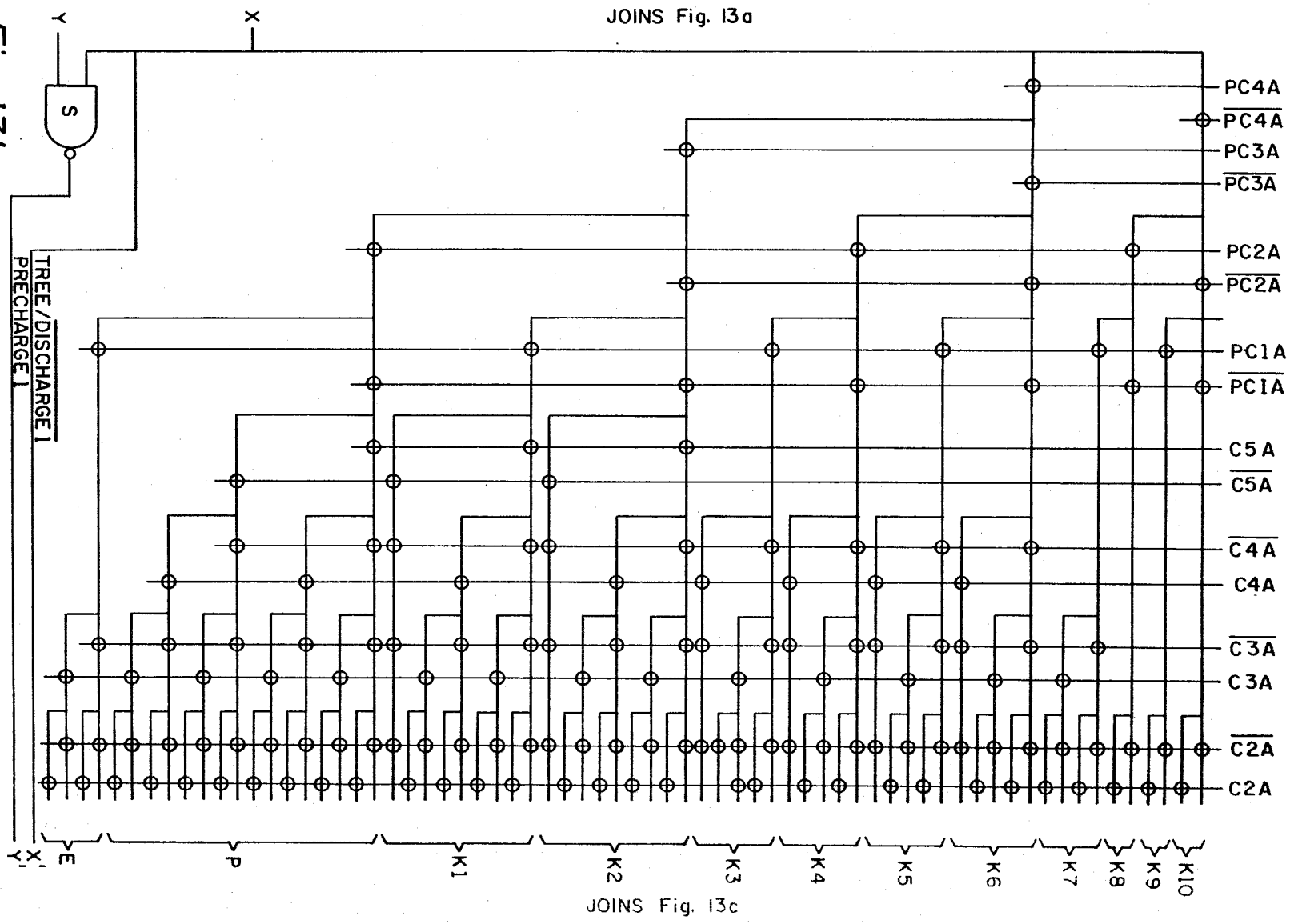
Figure 13C:
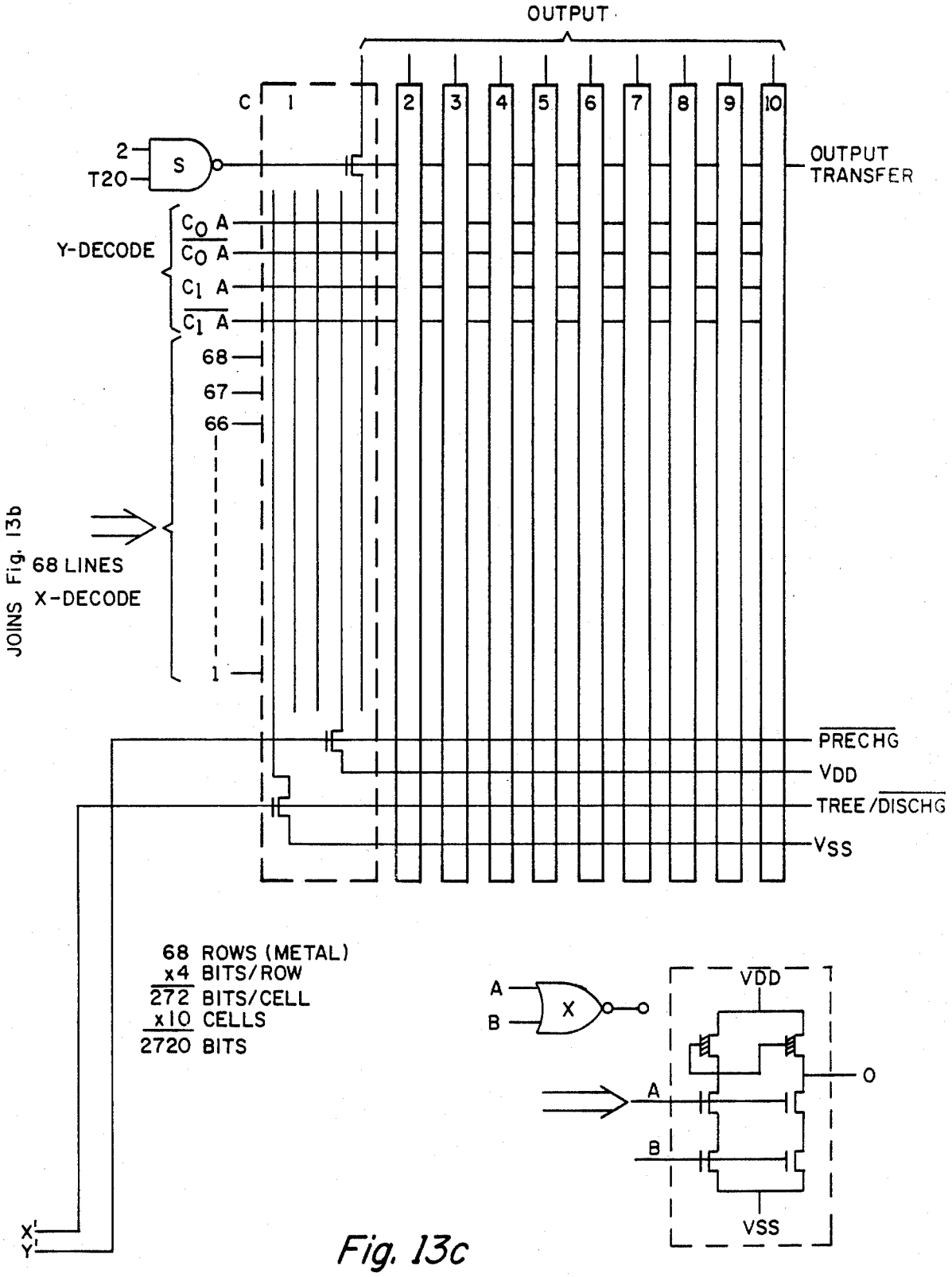

In FIGS. 13*a*–13*c*, there is shown a logic diagram of ROM 202. ROM 202 is preferably a virtual ground ROM of the type disclosed in U.S. Pat. No. 3,934,233. Address information from ROM 202 and from parameter counter 513 is applied to address buffers 202*b* which are shown in detail at reference A. The NOR gates 202*a* used in address buffers 202*b* are shown in detail at reference B. The outputs of the address buffers 202*b* are applied to an X-decoder 202*c* or to a Y-decoder 202*d*. The ROM is divided into ten sections labeled reference C, one of which is shown in greater detail. The outline for output line from each of the sections is applied to register 201 via inverters as shown in FIGS. 8*e* and 8*f*. X-decoder selects one of sixty-eight X-decode lines while Y-decoder 202*d* tests for the presence or nonpresence of a transistor cell between an adjacent pair of diffusion lines, as is explained in greater detail in the aforementioned U.S. Pat. No. 3,934,233. The data preferably stored in ROM 202 of this embodiment is listed in Table IV.

Chirp Read-Only-Memory Logic Diagram

Figure 11A:
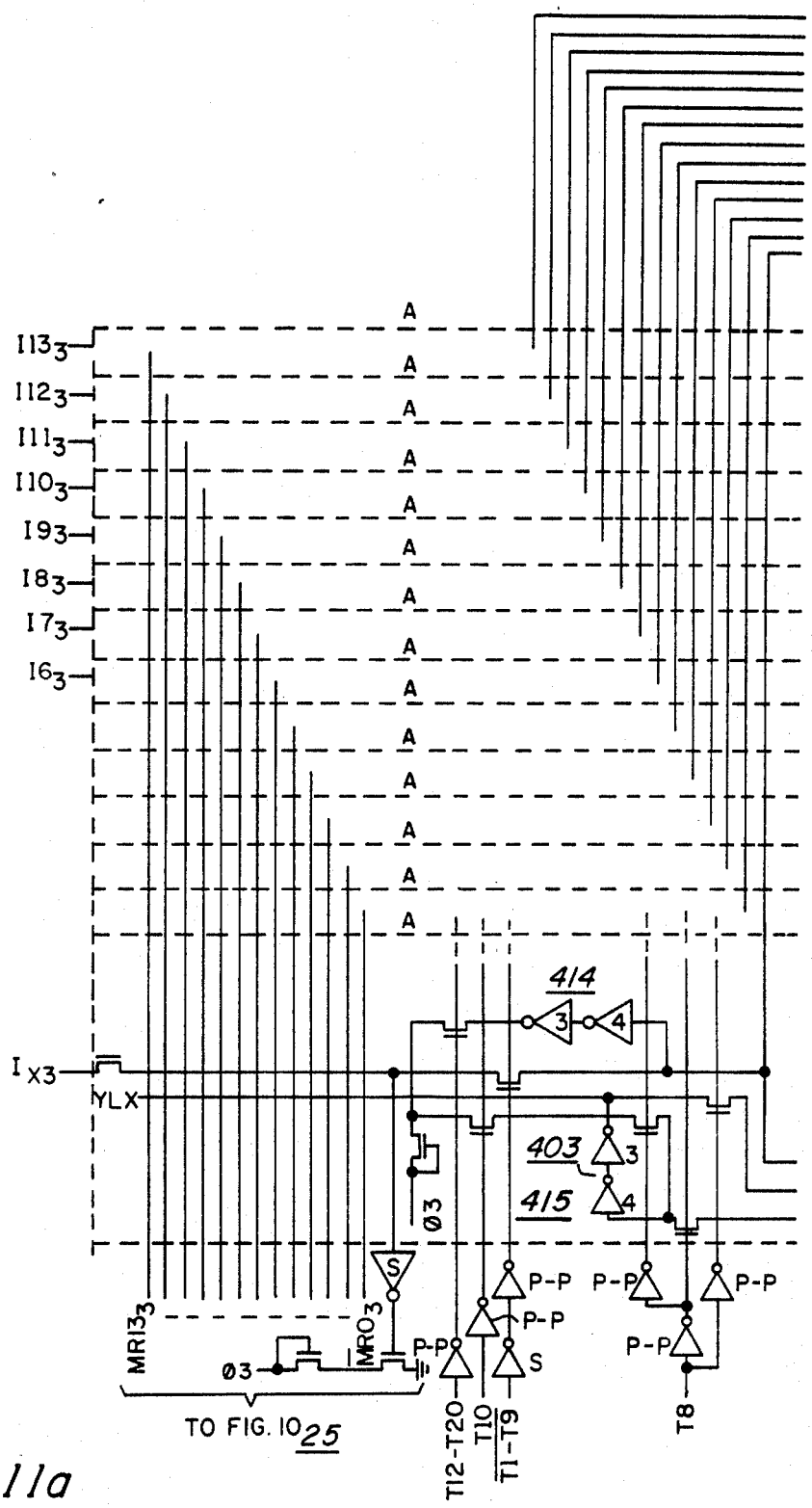
Figure 11A:
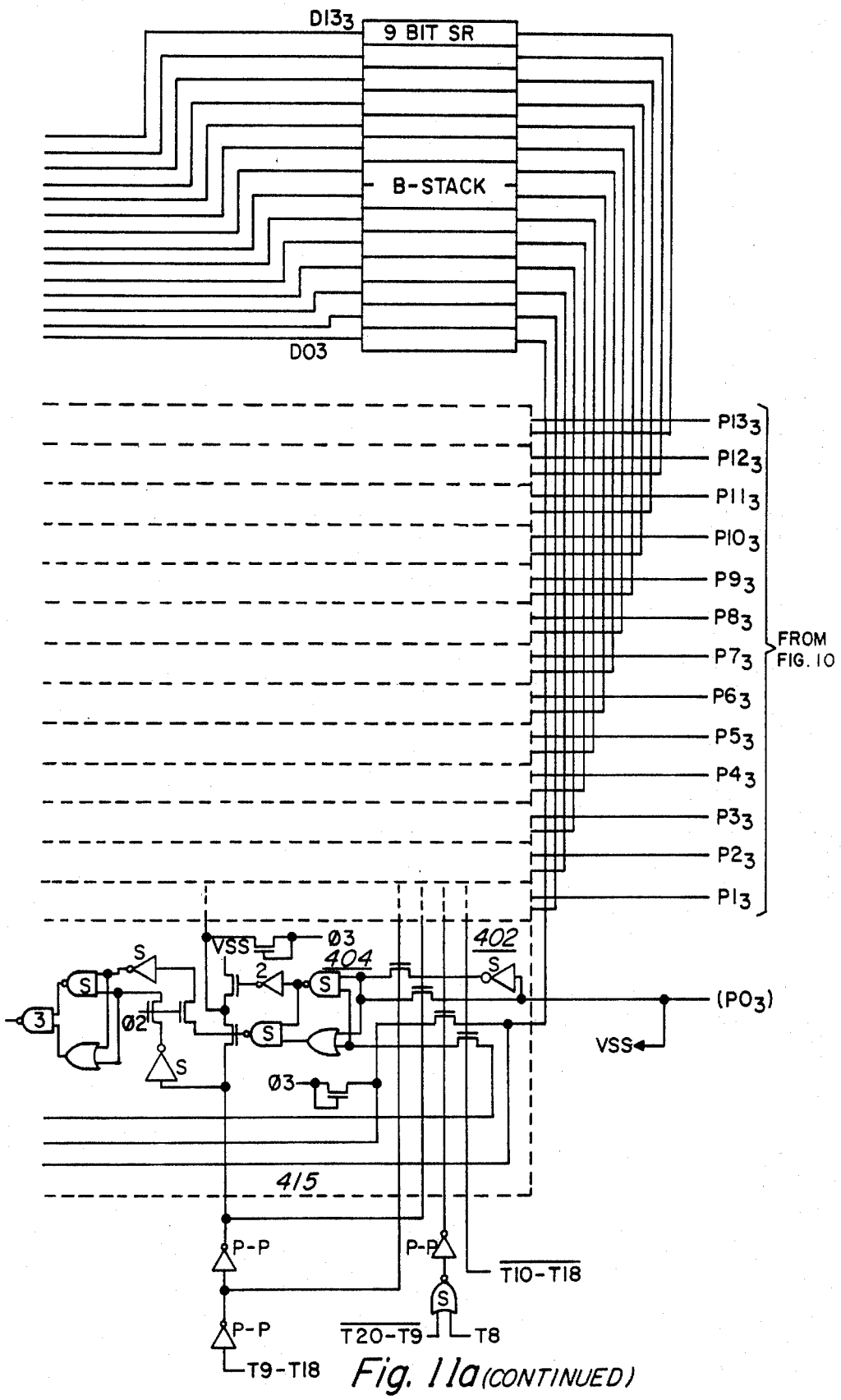
Figure 11B:
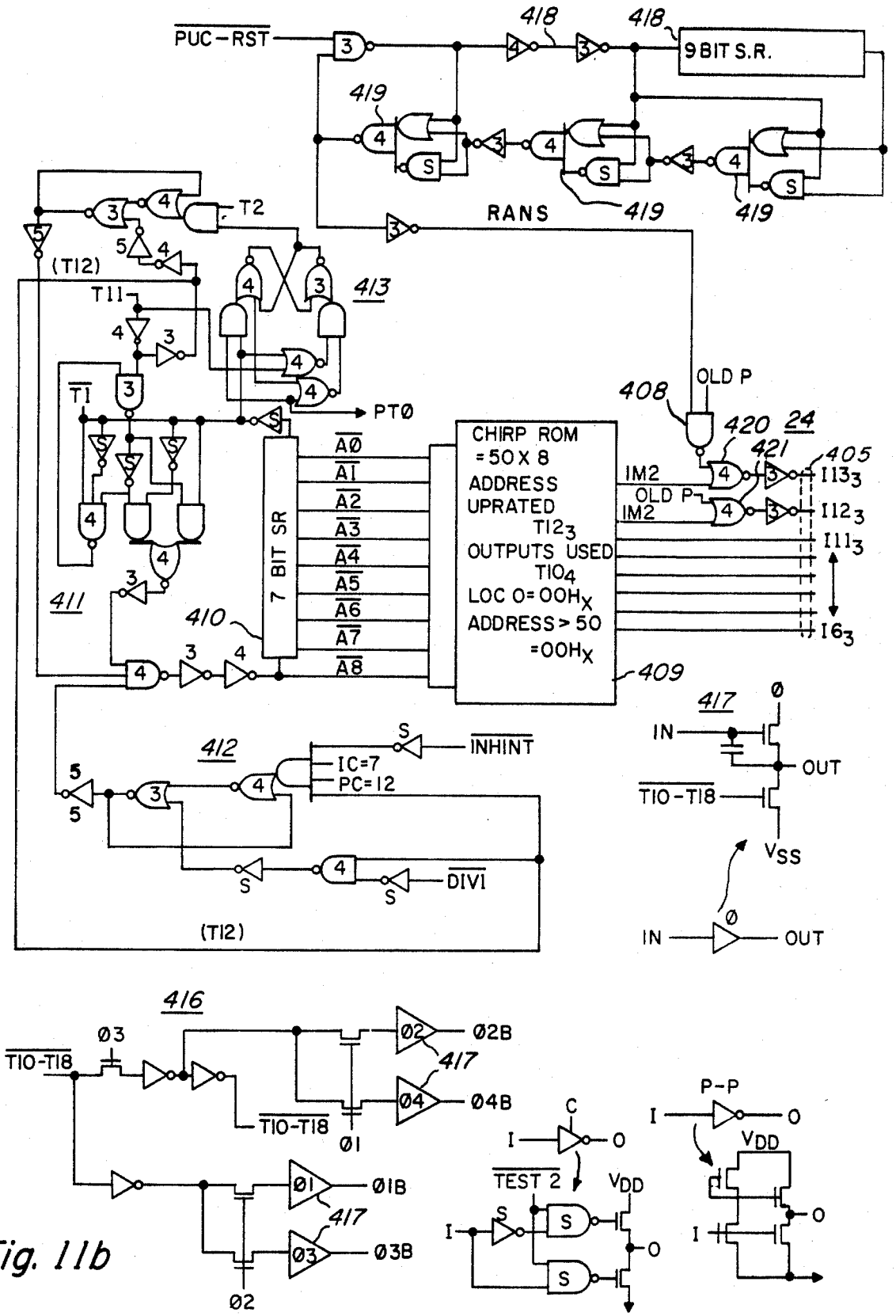
Figure 14A:
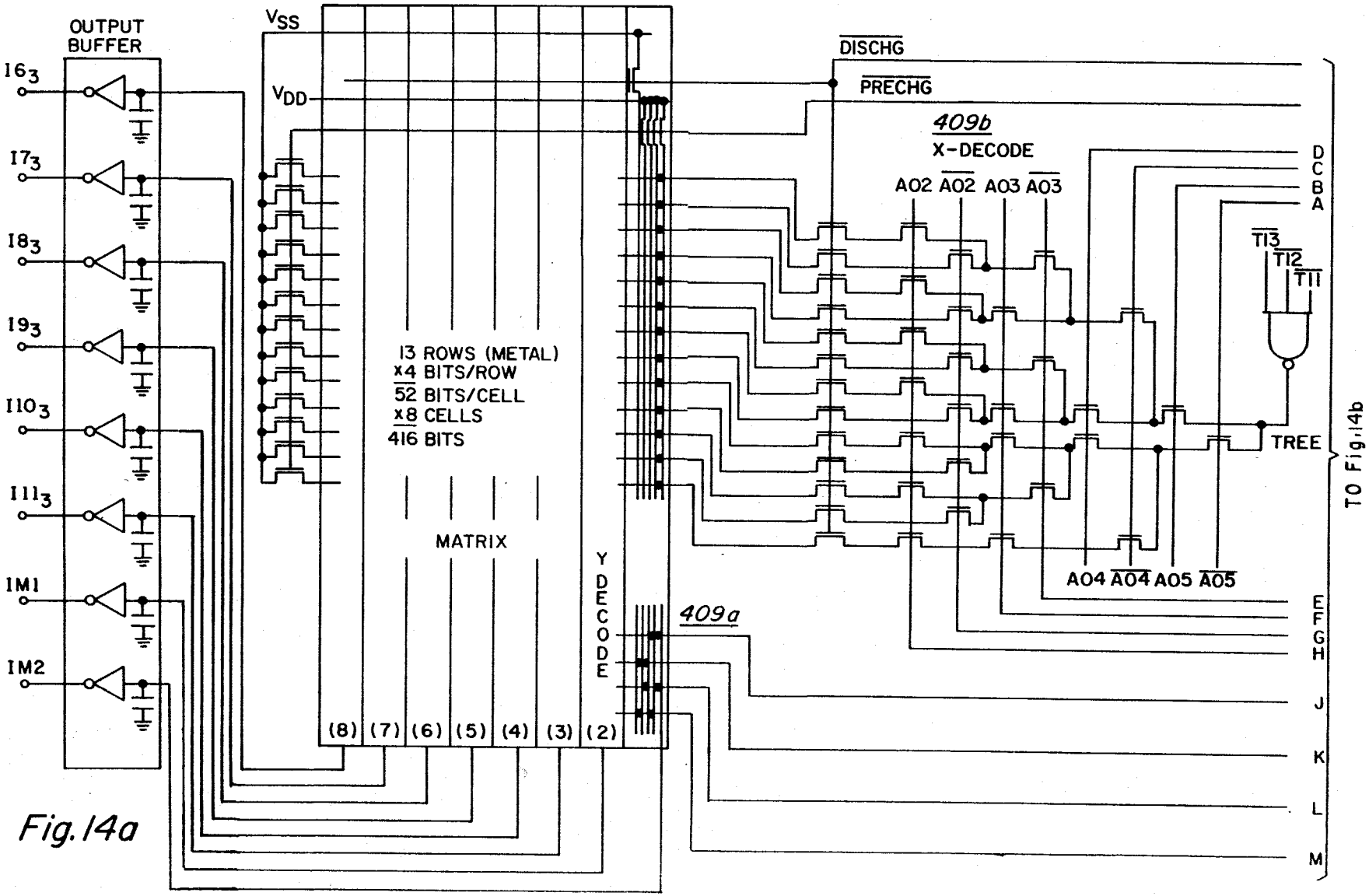
FIGS. 14*a* and 14*b* form a composite diagram of the chirp ROM.
Figure 14B:
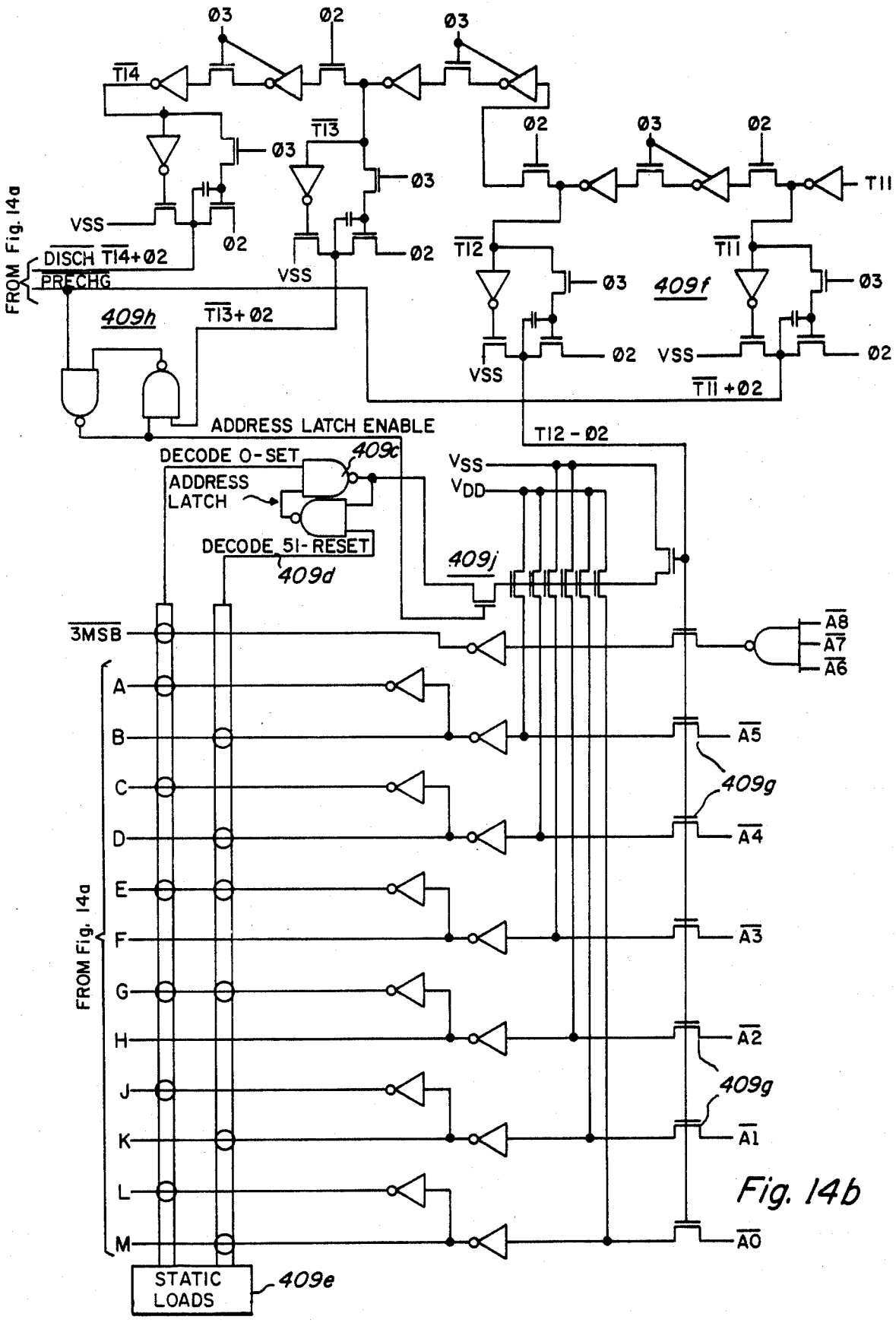

FIGS. 14*a*–14*b* form a composite diagram of chirp ROM 409. ROM 409 is addressed via address lines $\overline{A_0}$–$\overline{A_8}$ from register 410 (FIG. 11*c*) and output information on lines $I_6$–$I_{11}$ to multiplier multiplexer 415 and lines $IM_1$ and $IM_2$ to gates 421 and 420, all of which are shown in FIG. 11*c*. As was previously discussed with reference to FIGS. 11*a*–11*d*, chirp ROM outputs all zeroes after a predetermined count is reached in register 410, which, in this case, is the count equivalent to a decimal 51. ROM 409 includes a Y-decoder 409*a* which is responsive to the address on lines $\overline{A_0}$ and $\overline{A_1}$ (and $A_0$ and $A_1$) and an X-decoder 409*b* which is responsive to the address on lines $\overline{A_2}$ through $\overline{A_5}$ (and $A_2$–$A_5$).

ROM 409 also includes a latch 409*c* which is set when decimal 51 is detected on lines $\overline{A_0}$–$\overline{A_5}$ according to line 409*c* from a decoder 409*e*. Decoder 409*e* also decodes a logical zero on lines $\overline{A_0}$–$\overline{A_8}$ for resetting latch 409*c*. ROM 409 includes timing logic 409*f* which permit data to be clocked in via gates 409*g* at time period T12. At this time, decoder 409*e* checks to determine whether either a decimal 0 or a decimal 51 is occurring on address lines $\overline{A_0}$–$\overline{A_8}$. If either condition occurs, latch 409*c*, which is a static latch, is caused to flip.

An address latch 409*h* is set at time period T13 and reset at time period T11. Latch 409*h* permits latch 409*c* to force a decimal 51 onto lines $A_0$–$A_5$ when latch 409*c* is set. Thus, for addresses greater than 51 in address register 410, the address is first sampled at time period T12 to determine whether it has been reset to zero by reset logic 412 (FIG. 11*c*) for the purpose of resetting latch 409*c* and if the address has not been reset to zero then whatever address has been inputted on lines $A_0$–$A_8$ is written over by logics 409*j* at T13. Of course, at location 51 in ROM 409 will be stored all zeroes on the output lines I6–I11, IM1 and IM2. Thus by the means of logics 409*c*, 409*h* and 409*j* addresses of a preselected value, in this case a decimal 51, are merely tested to determine whether a reset has occurred but are not permitted to address the array of ROM cells via decoders 409*a* and 409*b*. Addresses between a decimal 0 to 50 address the ROM normally via decoders 409*a* and 409*b*. The ROM matrix is preferably of the virtual ground type described in U.S. Pat. No. 3,934,233. As aforementioned, the contents of ROM 409 are listed in Table III. The chirp function is located at addresses 00–40 while zeroes are located at addresses 41–51.

Truncation Logic and Digital-To-Analog Converter

Turning again to FIGS. 11*a*–11*d*, the truncation logic 425 and Digital-To-Analog (D/A) converter are shown in detail. Truncation logic 425 includes circuitry for converting the two's complement data on $YL_{13}$–$YL_4$ to offset binary data. Logics 425*a* and 425*b* test the most significant bit from Y-latch 403 on line $YL_{13}$ for the purpose of determining the sign bit and for generating the truncation signals CLIP0 and CLIP1. Logics 425*a* generate the CLIP0 signal and drive all of the inputs to D/A converter 426 to zero whenever $YL_{13}$ is a logic one and either $YL_{12}$ or $YL_{11}$ are logic zeroes. Logics 425*b* generate the CLIP1 signal and drive all of the inputs to D/A converter 426 to one whenever $YL_{13}$ is a logic zero and either $YL_{12}$ or $YL_{11}$ *are logic ones. Logics* 425*c* test $YL_{13}$–$YL_{11}$ for the opposite conditions from the conditions just enumerated and generate the NORM signal when no truncation is to take place. This magnitude truncation function effectively truncates the more significant bits on $YL_{11}$ and $YL_{12}$. It is realized that this is a somewhat unorthodox truncation, since normally the less significant bits are truncated in most other circuits where truncation occurs. However, in this circuit, large positive or negative values are effectively clipped. It has been found that more important digital speech information, which has a smaller magnitude, is effectively amplified by a factor of four by this truncation scheme. Logics 425*d* convert the two's complement data from Y-latches 403 in lines $YL_{10}$–$YL_4$ to simple magnitude information on lines $\overline{D/A_6}$–$\overline{D/A_0}$. Line $\overline{D/A_7}$ is connected to $YL_{12}$, since when conditions are such that no truncation is occurring, $YL_{12}$ and $YL_{11}$ are identical.

The effects of the truncation scheme utilized are demonstrated in Table V. When the outputs $YL_{13}$–$YL_4$ result in a decimal number greater than +127, the D/A converter inputs are all driven to logical ones, and the output current is zero. When the outputs $YL_{13}$–$YL_4$ result in a decimal number less than −128, the D/A converter inputs are all driven to logical zeroes, and the output current is 1500 microamps. The midpoint occurs when $YL_{13}$–$YL_4$ is equivalent to a −1 in decimal notation, and the D/A output current is equal to 250 microamps. Thus, D/A converter 426 generates an analog output which varies about a static level (750 microamps in this embodiment). Additionally, when the Speech Module has ceased talking, the TALKST signal is utilized to drive output current to zero, in order to conserve power consumption.

The outputs $\overline{D/A_7}$–$\overline{D/A_0}$ are coupled to D/A converter 426. $\overline{D/A_7}$–$\overline{D/A_0}$ are preferably connected to the gates of eight MOS switching devices 429*a*. $\overline{D/A_7}$–$\overline{D/A_0}$ are also connected through inverters 429*b* to the gates of eight MOS switching devices 429*c*. The sources of switching devices 429*a* are connected to the Vss and the sources of switching devices 429*c* are connected to the Vref. Vref is a predetermined voltage calculated to bias current sources 429*d* into the saturated mode of operation. The drains of switching devices 429*a* and 429*c* are connected at a common point in each leg of D/A converter 426 and tied to the gates of current source devices 429*d*. Current sources 429*d* have their current carrying electrodes coupled in parallel with the source of each current device connected to Vss. The drains of current devices 429*d* are connected to an output pin through a 1.8K ohm resistor to an audio amplifier and speaker circuit contained in a commercial or home-type computer.

It should be appreciated by those skilled in the art that D/A converter 426 has effectively converted the sign data and magnitude data contained in $YL_{13}$–$YL_4$ to an analog signal, which can be characterized as an alternating signal with a fixed component. And, it should be apparent that D/A converters, such as disclosed here will find use in other embodiments in addition to speech synthesis circuits.

Read-Only-Memories

Read-Only-Memories 12*a* and 12*b* are preferably of the type shown and described in U.S. Pat. No. 4,189,779.

ALTERNATIVE EMBODIMENTS

Although the invention has been described with reference to a specific embodiment, this description is not meant to be construed in a limiting sense. Various modifications of the described embodiment as well as alternative embodiments of the invention will become apparent to persons skilled in the art upon reference to the description of the invention. It is therefore contemplated that the appended claims will cover any such modifications or embodiments that fall within the true scope of the invention.

TABLE I

The synthesizer 10 includes interpolation logics to accomplish a nearly linear interpolation of all twelve speech parameters at eight points within each frame, that is, once each 2.5 msec. The parameters are interpolated one at a time as selected by the parameter counter. The interpolation logics calculate a new value of a parameter from its present value (i.e. the value currently stored in the K-stack, pitch register or E-10 loop) and the target value stored in encoded form in RAM 203 (and decoded by ROM 202).

The value computed by each interpolation is listed below.

Where $P_i$ is the present value of the parameter
$P_{i+1}$ is the new parameter value
$P_t$ is the target value
$N_i$ is an integer determined by the interpolation counter The values of N for specific interpolation counts and the values $\frac{P_i - P_0}{P_t - P_0}$ ($P_0$ is initial parameter value) are as follows:

| INTERPOLATION COUNT | $N_i$ | $\frac{P_i - P_0}{P_t - P_0}$ |
|---|---|---|
| 1 | 8 | 0.125 |
| 2 | 0 | 0.234 |
| 3 | 8 | 0.330 |
| 4 | 4 | 0.498 |
| 5 | 4 | 0.623 |
| 6 | 2 | 0.717 |
| 7 | 2 | 0.859 |
| 0 | 1 | 1.000 |

TABLE II

DATA OUTPUTTED FROM K-STACK 302 TO RECORDING LOGIC 301 BY TIME PERIODS

| K-STACK OUTPUT | | TIME PERIODS | | | | | | | | | | | | | | | | | | | |
|---|---|---|---|---|---|---|---|---|---|---|---|---|---|---|---|---|---|---|---|---|---|
| BIT | LINE | T8 | T9 | T10 | T11 | T12 | T13 | T14 | T15 | T16 | T17 | T18 | T19 | T20 | T21 | T22 | T23 | T24 | T25 | T26 | T27 |
| LSB | 31-2 | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ | $K_3$ |
| | 32-2 | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ | $K_3$ |
| | 32-3 | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ | $K_3$ |
| | 32-4 | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ | $K_3$ |
| | 32-5 | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ |
| | 32-6 | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ | $K_4$ |
| | 32-7 | $K_4$ | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ |
| | 32-8 | $K_4$ | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ | $K_5$ |
| | 32-9 | $K_5$ | $K_4$ | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ |
| MSB | 32-10 | $K_5$ | $K_4$ | $K_3$ | $K_2$ | $K_1$ | A | $K_9$ | $K_8$ | $K_7$ | $K_6$ | $K_5$ | $K_4$ | $K_3$ | $K_2$ | $K_1$ | $K_{10}$ | $K_9$ | $K_8$ | $K_7$ | $K_6$ |

TABLE III

CHIRP ROM CONTENTS

| ADDRESS | CHIRP FUNCTION VALUE | STORED VALUE (COMPLEMENTED) |
|---|---|---|
| 00 | 00 | FF |
| 01 | 2A | D5 |
| 02 | D4 | 2B |

TABLE III-continued

| CHIRP ROM CONTENTS | | |
|---|---|---|
| ADDRESS | CHIRP FUNCTION VALUE | STORED VALUE (COMPLEMENTED) |
| 03 | 32 | CD |
| 04 | B2 | 4D |
| 05 | 12 | ED |
| 06 | 25 | DA |
| 07 | 14 | EB |
| 08 | 02 | FD |
| 09 | E1 | IE |
| 10 | C5 | 3A |
| 11 | 02 | FD |
| 12 | 5F | A0 |
| 13 | 5A | A5 |
| 14 | 05 | FA |
| 15 | 0F | F0 |
| 16 | 26 | D9 |
| 17 | FC | 03 |
| 18 | A5 | 5A |
| 19 | A5 | 5A |
| 20 | D6 | 29 |
| 21 | DD | 22 |

TABLE III-continued

| CHIRP ROM CONTENTS | | |
|---|---|---|
| ADDRESS | CHIRP FUNCTION VALUE | STORED VALUE (COMPLEMENTED) |
| 22 | DC | 23 |
| 23 | FC | 03 |
| 24 | 25 | DA |
| 25 | 2B | D4 |
| 26 | 22 | DD |
| 27 | 21 | DE |
| 28 | 0F | F0 |
| 29 | FF | 00 |
| 30 | F8 | 07 |
| 31 | EE | 11 |
| 32 | ED | 12 |
| 33 | EF | 10 |
| 34 | F7 | 08 |
| 35 | F6 | 09 |
| 36 | FA | 05 |
| 37 | 00 | FF |
| 38 | 03 | FC |
| 39 | 02 | FD |
| 40 | 01 | FE |

TABLE IV

| | | | DECODED PARAMETERS | | | | | | | | |
|---|---|---|---|---|---|---|---|---|---|---|---|
| CODE | E | P | K1 | K2 | K3 | K4 | K5 | K6 | K7 | K8 | K9 |
| 00 | 000 | 000 | 205 | 2DA | 23F | 1EF | 28B | 32B | 20A | 33D | 386 |
| 01 | 001 | 00E | 207 | 2FG | 250 | 2F2 | 2A5 | 350 | 2F8 | 38B | 3C9 |
| 02 | 002 | 00F | 209 | 315 | 265 | 324 | 2C2 | 377 | 318 | 3E0 | 00F |
| 03 | 003 | 010 | 20B | 336 | 27F | 35C | 2E4 | 3A0 | 33A | 036 | 053 |
| 04 | 004 | 011 | 20F | 359 | 29E | 39F | 309 | 3CA | 35F | 089 | 095 |
| 05 | 006 | 012 | 213 | 37E | 263 | 3D8 | 332 | 3F5 | 386 | 005 | 0D2 |
| 06 | 008 | 013 | 218 | 3A4 | 2EF | 019 | 3SE | 021 | 3AE | 117 | 108 |
| 07 | 00B | 014 | 21F | 3CC | 321 | 059 | 38D | 04B | 3D7 | 14F | 137 |
| 08 | 010 | 015 | 227 | 3F4 | 359 | 096 | 3BF | 075 | 001 | | |
| 09 | 017 | 016 | 231 | 01C | 395 | 0CF | 3F1 | 090 | 02B | | |
| 0A | 021 | 017 | 23E | 044 | 305 | 103 | 024 | OC3 | 054 | | |
| 0B | 02F | 018 | 24E | 06C | 016 | 130 | 056 | 0E7 | 07D | | |
| 0C | 03F | 019 | 262 | 091 | 057 | 157 | 087 | 108 | 0A3 | | |
| 0D | 055 | 01A | 27A | 0B6 | 094 | 178 | 0B5 | 126 | OC8 | | |
| 0E | 072 | 01B | 296 | 008 | 0CE | 193 | 0E0 | 142 | 0EA | | |
| 0F | 000 | 01C | 2B8 | 0F8 | 102 | 1A9 | 107 | 15B | 10A | | |
| 10 | | 01D | 2E0 | 116 | 202 | 202 | 202 | 202 | | | |
| 11 | | 01E | 30E | 131 | 20A | 20A | 20A | 20A | | | |
| 12 | | 01F | 341 | 14A | 139 | 139 | 139 | 139 | | | |
| 13 | | 020 | 379 | 160 | 13E | 13E | 13E | 13E | | | |
| 14 | | 022 | 3B5 | 174 | | | | | | | |
| 15 | | 024 | 3F3 | 186 | | | | | | | |
| 16 | | 026 | 031 | 196 | | | | | | | |
| 17 | | 028 | 06E | 1A4 | | | | | | | |
| 18 | | 029 | 0A8 | 1B0 | | | | | | | |
| 19 | | 02B | 0DD | 1BB | | | | | | | |
| 1A | | 02D | 10D | 1C5 | | | | | | | |
| 1B | | 030 | 137 | 1C0 | | | | | | | |
| 1C | | 031 | 15C | 1D4 | | | | | | | |
| 1D | | 033 | 17B | 1DA | | | | | | | |
| 1E | | 036 | 194 | 1DF | | | | | | | |
| 1F | | 037 | 1AA | 1E6 | | | | | | | |
| 20 | | 039 | 202 | 202 | | | | | | | |
| 21 | | 03C | 20A | 20A | | | | | | | |
| 22 | | 03E | 139 | 139 | | | | | | | |
| 23 | | 040 | 13E | 13E | | | | | | | |
| 24 | | 044 | | | | | | | | | |
| 25 | | 048 | | | | | | | | | |
| 26 | | 04A | | | | | | | | | |
| 27 | | 04C | | | | | | | | | |
| 28 | | 051 | | | | | | | | | |
| 29 | | 055 | | | | | | | | | |
| 2A | | 057 | | | | | | | | | |
| 2B | | 05A | | | | | | | | | |
| 2C | | 060 | | | | | | | | | |
| 2D | | 063 | | | | | | | | | |
| 2E | | 067 | | | | | | | | | |
| 2F | | 06B | | | | | | | | | |
| 30 | | 070 | | | | | | | | | |
| 31 | | 075 | | | | | | | | | |
| 32 | | 07A | | | | | | | | | |
| 33 | | 07F | | | | | | | | | |
| 34 | | 085 | | | | | | | | | |

TABLE IV-continued

| | | DECODED PARAMETERS | | | | | | | | | |
|---|---|---|---|---|---|---|---|---|---|---|---|
| CODE | E | P | K1 | K2 | K3 | K4 | K5 | K6 | K7 | K8 | K9 |
| 35 | | 08B | | | | | | | | | |
| 36 | | 091 | | | | | | | | | |
| 37 | | 097 | | | | | | | | | |
| 38 | | 09D | | | | | | | | | |
| 39 | | 0A4 | | | | | | | | | |
| 3A | | 0AB | | | | | | | | | |
| 3B | | 0B2 | | | | | | | | | |
| 3C | | 0BA | | | | | | | | | |
| 3D | | 0C2 | | | | | | | | | |
| 3E | | 0CA | | | | | | | | | |
| 3F | | 0D3 | | | | | | | | | |

TABLE V

| | Y LATCH OUTPUT | | | | | D/A | ANALOG OUTPUT |
|---|---|---|---|---|---|---|---|
| | $Y_{L13}$ | $Y_{L12}$ | $Y_{L11}$ | $Y_{L10}$ | $Y_{L4}$ | INPUT | p AMPS |
| | 0 | 1 | 0 | X | | 11111111 | 0 |
| >+127 | 0 | 1 | 0 | X | | 11111111 | 0 |
| | 0 | 0 | 1 | X | | 11111111 | 0 |
| 127 | 0 | 0 | 0 | 1111111 | | 11111111 | 0 |
| 126 | 0 | 0 | 0 | 1111110 | | 11111110 | 5.86 |
| | | | . | | | | |
| | | | . | | | | |
| | | | . | | | | |
| +1 | 0 | 0 | 0 | 0000001 | | 10000001 | 738 |
| 0 | 0 | 0 | 0 | 0000000 | | 10000000 | 744 |
| *−1 | 1 | 1 | 1 | 1111111 | | 01111111 | 750 |
| −2 | 1 | 1 | 1 | 1111110 | | 01111110 | 755.8 |
| | | | . | | | | |
| | | | . | | | | |
| | | | . | | | | |
| −128 | 1 | 1 | 1 | 0000000 | | 00000000 | 1500 |
| <−128 | 1 | 1 | 0 | X | | 00000000 | 1500 |
| | 1 | 0 | 1 | X | | 00000000 | 1500 |
| | 1 | 0 | 0 | X | | 00000000 | 1500 |

*NO OUTPUT, RESTING LEVEL

What is claimed is:

1. A speech synthesizer comprising:

means for receiving an input from an external control device;

first memory means for permanently storing a first plurality of coded speech data;

second memory means coupled to said receiving means for temporarily storing a second plurality of coded speech data, said second plurality of coded speech data being provided by said external control device;

speech synthesizer processor means for converting coded speech data into digital speech signals representative of human speech;

selector means for selectively activating one of said first and second memory means to apply selected coded speech data to said speed synthesizer processor means from either one of said first and second pluralities of coded speech data in response to a control signal provided by said external control device designating which of said first and second memory means is active; and digital-to-analog converter means operably associated with said speed synthesizer processor means for converting said digital speech signals into analog signals representative of human speech.

2. A speech synthesizer as set forth in claim 1, wherein said first memory means is a read-only-memory.

3. A speech synthesizer as set forth in claim 1, wherein said second memory means is a shift register.

4. A speech synthesizer as set forth in claim 1, wherein said speech synthesizer processor means includes a controllable digital filter.

5. A speech synthesizer as set forth in claim 4, wherein said coded speech data included in each of said first and second memory means comprises speech parameters representative of reflection coefficients for controlling said digital filter.

6. A speech synthesizer comprising:

means for receiving an input from an external control device;

first memory means for permanently storing a first plurality of coded speech data;

second memory means coupled to said receiving means for temporarily storing a second plurality of coded speech data, said second plurality of coded speech data being provided by said external control device;

a module having a plurality of electrical contacts;

third memory means for storing a third plurality of coded speech data, said third memory means being disposed in said module;

speech synthesizer processor means for converting coded speech data into digital speech signals representative of human speech;

a receptacle for temporarily interconnecting said plurality of electrical contacts on said module with said speech synthesizer processor means;

selector means for selectively activating one of said first, second, and third memory means to apply selected coded speech data to said speech synthesizer processor means from one of said first, second, and third pluralities of coded speech data in response to a control signal provided by said external control device designating which of said first, second, and third memory means is active; and digital-to-analog converter means operably associated with said speech synthesizer processor means for converting said digital speech signals into analog signals representative of human speech.

7. A speech synthesizer as set forth in claim 6, wherein said first memory means is a read-only-memory.

8. A speech synthesizer as set forth in claim 6, wherein said second memory is a shift register.

9. A speech synthesizer as set forth in claim 6, wherein said third memory means is a read-only-memory.

10. A speech synthesizer as set forth in claim 6, wherein said speech synthesizer processor means includes a controllable digital filter.

11. A speech synthesizer as set forth in claim 10, wherein said coded speech data from each of said first, second, and third memory means comprises speech parameters representative of reflection coefficients for controlling said digital filter.

12. A computer system capable of producing audible synthesized human speech, said computer system comprising:

a computer input device;

a central processing unit;

audio means for receiving analog signals representative of human speech and converting said analog signals into audible sound;

speech synthesizer means responsive to control signals generated by said central processing unit, said speech synthesizer means including first memory means for permanently storing a first plurality of coded speech data, second memory means for temporarily storing a second plurality of coded speech data, said second plurality of coded speech data being provided by said central processing unit, speech synthesizer processor means for converting coded speech data into digital speech signals representative of human speech, selector means for selectively activating one of said first and second memory means to apply selected coded speech data to said speed synthesizer processor means from either one of said first and second pluralities of coded speech data in response to a control signal provided by said central processing unit designating which of said first and second memory means is active, and digital-to-analog converter means operably associated with said speech synthesizer processor means for converting said digital speech signals into analog signals representative of human speech; and means for coupling said digital-to-analog converter means to said audio means such that said audio means is effective to convert said analog signals into audible sound.

13. A computer system as set forth in claim 12, further including a module in which said speech synthesizer means is disposed, said module having a plurality of electrical contacts for temporarily interconnecting said speech synthesizer means to said computer input device.

14. A computer system as set forth in claim 12, wherein said first memory means is a read-only-memory.

15. A computer system as set forth in claim 12, wherein said second memory means is a shift register.

16. A computer system as set forth in claim 12, wherein said speech synthesizer processor means includes a controllable digital filter.

17. A computer system as set forth in claim 16, wherein said coded speech data from each of said first and second memory means comprises speech parameters representative of reflection coefficients for controlling said digital filter.

18. A speech synthesizer comprising:

data storage means for receiving a data input from an external control device, wherein the data input may include any of coded speech data, address information and instruction information;

first memory means for permanently storing a first plurality of coded speech data;

second memory means coupled to the output of said data storage means for selectively receiving coded speech data provided by said external control device so as to temporarily store a second plurality of coded speech data;

speech synthesizer processor means for converting coded speech data into digital speech signals representative of human speech;

address storage means operably coupled to said data storage means for accepting address information therefrom;

command storage means operably coupled to said data storage means receiving instruction information as coded command data from the external control device via said data storage means including at least first and second coded commands;

command decoder means operably coupled to said command storage means for selectively activating one of said first and second memory means to apply selected coded speech data to said speech synthesizer processor means from either one of said first and second pluralities of coded speech data in response to the decoding of one of said first and second coded commands as provided from said external control device designating which of said first and second memory means is active;

means for generating a disable signal to disable said command decoder means in response to the decoding of said second coded command by said command decoder means;

said second memory means accepting a data input as coded speech data from the external control device via said data storage means during the time period that said command decoder means is in a disabled state; and digital-to-analog converter means operably associated with said speech synthesizer processor means for converting said digital speech signals into analog signals representative of human speech.

19. A speech synthesizer as set forth in claim 18, wherein said address storage means is operably coupled to said first memory means for selectively identifying specific coded speech data stored therein by the address information in said address storage means obtained from the external control device for application to said speech synthesizer processor means.

20. A speech synthesizer as set forth in claim 19, further including control logic means operably coupled to said command decoder means and responsive to the decoding of said first coded command by said command decoder means to control said first memory means in the application of the specifically identified coded speech data stored therein to said speech synthesizer processor means.

21. A speech synthesizer as set forth in claim 20, wherein said data storage means is bi-directional for receiving a data input from said first memory means to be accessed by the external control device;

the coded command data from the external control device further including a third coded command for reception by said command storage means via said data storage means;

said command decoder means directing said control logic means in response to the decoding of said third coded command by said command decoder means to control said first memory means in the application of data stored therein to said data storage means for access by the external control device.

22. A speech synthesizer as set forth in claim 20, wherein said first memory means is a read-only-memory.

23. A computer system capable of producing audible synthesized human speech, said computer system comprising:

computer means including a central processing unit;

audio means for receiving analog signal representative of human speech and converting said analog signals into audible synthesized human speech; and speech synthesizer means responsive to control signals generated by said central processing unit for producing analog signals representative of human speech, said speech synthesizer means including data storage means operably coupled to said central processing unit for receiving a data input from said central processing unit, wherein the data input may include any of coded speech data, address information and instruction information, first memory means for permanently storing a first plurality of coded speech data, second memory means coupled to the output of said data storage means for selectively receiving coded speech data provided by said central processing unit so as to temporarily store a second plurality of coded speech data, speech synthesizer processor means for converting coded speech data into digital speech signals representative of human speech, address storage means operably coupled to said data storage means for accepting address information therefrom, command storage means operably coupled to said data storage means for receiving instruction information as coded command data from said central processing unit via said data storage means including at least first and second coded commands, command decoder means operably coupled to said command storage means for selectively activating one of said first and second memory means to apply selected coded speech data to said speech synthesizer processor means from either one of said first and second pluralities of coded speech data in response to the decoding of one of said first and second coded commands as provided from said central processing unit designating which of said first and second memory means is active, means for generating a disable signal to disable said command decoder means in response to the decoding of said second coded command by said command decoder means, said second memory means accepting a data input as coded speech data from said central processing unit via said data storage means during the time period that said command decoder means is in a disabled state, and digital-to-analog converter means operably associated with said speech synthesizer processing means for converting said digital speech signals into analog signals representative of human speech; and means for coupling said digital-to-analog converter means to said audio means such that said audio means is effective to convert said analog signals into audible synthesized human speech.

24. A computer system as set forth in claim 23, wherein said address storage means is operably coupled to said first memory means for selectively identifying specific coded speech data stored therein by the address information in said address storage means obtained from said central processing unit for application to said speech synthesizer processor means.

25. A computer system as set forth in claim 24, wherein said speech synthesizer means further includes control logic means operably coupled to said command decoder means and responsive to the decoding of said first coded command by said command decoder means to control said first memory means in the application of the specifically identified coded speech data stored therein to said speech synthesizer processor means.

26. A computer system as set forth in claim 25, wherein said data storage means is bi-directional for receiving a data input from said first memory means to be accessed by said central processing unit, the coded command data from said central processing unit further including a third coded command for reception by said command storage means via said data storage means, and said command decoder means directing said control logic means in response to the decoding of said third coded command by said command decoder means to control said first memory means in the application of data stored therein to said data storage means for access by said central processing unit.

27. A computer system as set forth claim 25, wherein said first memory means is a read-only-memory.

28. A computer system as set forth in claim 27, further including a module in which said speech synthesizer means is disposed, said module having a plurality of electrical contacts for temporarily interconnecting said speech synthesizer means to said central processing unit of said computer means via said data storage means.

* * * * *